US006085477A

United States Patent [19]

Hiese et al.

[11] Patent Number: 6,085,477

[45] Date of Patent: Jul. 11, 2000

[54] METHOD AND KIT FOR PRODUCING STRUCTURAL PARTS AND COMPLETE STRUCTURAL MEMBERS USING INTERCONNECTED STRUCTURAL ELEMENTS, AND ARRANGEMENT FOR INTERCONNECTING THE STRUCTURAL ELEMENTS

[75] Inventors: Maren Hiese, Langensalza; Christian Wuest, Eisenach, both of Germany

[73] Assignees: Christina Alder, Herrenhof; Juergen Jaeckisch, Monchenholzahausen; Frank Metzger, Tannroda, all of Germany

[21] Appl. No.: 09/011,111

[22] PCT Filed: Aug. 2, 1996

[86] PCT No.: PCT/DE96/01483

§ 371 Date: May 4, 1998

§ 102(e) Date: May 4, 1998

[87] PCT Pub. No.: WO97/05339

PCT Pub. Date: Feb. 13, 1997

[30] Foreign Application Priority Data

Aug. 2, 1995 [DE] Germany ..... 195 29 929

[51] Int. Cl.[7] ..... E04B 1/00

[52] U.S. Cl. ..... 52/270; 52/284; 52/584.1; 52/263

[58] Field of Search ..... 52/270, 284, 285.1, 52/584.1, 763, 764; 446/105, 108, 111, 112, 114, 115, 127

[56] References Cited

U.S. PATENT DOCUMENTS

| | | | |
|---|---|---|---|
| 2,394,702 | 2/1946 | Lindsay et al. . | |
| 3,640,039 | 2/1972 | McKee et al. . | |
| 3,916,589 | 11/1975 | Richter . | |
| 4,621,467 | 11/1986 | Golden . | |
| 4,907,382 | 3/1990 | Schwam . | |
| 5,163,257 | 11/1992 | Crowell | 52/584.1 X |
| 5,452,555 | 9/1995 | Lee | 52/584.1 |
| 5,640,816 | 6/1997 | Reiland et al. | 52/284 X |

FOREIGN PATENT DOCUMENTS

| | | | |
|---|---|---|---|
| 0284537 | 9/1988 | European Pat. Off. . | |
| 2383278 | 3/1978 | France . | |
| 2301184 | 7/1974 | Germany . | |
| 2265017 | 3/1976 | Germany . | |
| 2714378 | 9/1978 | Germany . | |
| 2830798 | 1/1980 | Germany . | |
| 2921599 | 12/1980 | Germany . | |
| 2950138 | 6/1981 | Germany . | |
| 3123342 | 1/1983 | Germany . | |
| 8803863 | 7/1988 | Germany . | |
| 4130478 | 4/1992 | Germany . | |
| 9206346 | 8/1992 | Germany . | |
| 2277539 | 11/1994 | United Kingdom . | |
| WO86/00360 | 1/1986 | WIPO . | |
| WO 93/24714 | 5/1992 | WIPO | 52/220.2 |

*Primary Examiner*—Beth A. Aubrey
*Assistant Examiner*—Brian E. Glessner
*Attorney, Agent, or Firm*—Jordan and Hamburg LLP

[57] ABSTRACT

The invention relates to a method and a kit for producing structural parts and complete structural members using structural elements, which are to be connected, as well as to an arrangement for connecting the structural elements to one another. It is an object of the invention to provide a method, a kit and an arrangement of the generic type, with which it is possible to assemble structural bodies of different form and development of the structural elements into self-supporting structural members, structural sections and areas. Pursuant to the invention, this objective is accomplished owing to the fact that the structural elements are assembled together into planar structural parts and structural members by means of edge-overlapping and surface over-lapping connecting elements, which are to be inserted, and are fixed and locked in the completely assembled state as compact structural bodies. The invention is developed owing to the fact that the structural elements of the kit are constructed as basic elements and as connecting elements, the connecting elements having guides, in which the basic elements are accommodated and brought into a relationship with one another, in which they form planar, as well as spatial structures of different geometric shape and are assembled using direction-changing elements.

56 Claims, 55 Drawing Sheets

METHOD AND KIT FOR PRODUCING STRUCTURAL PARTS AND COMPLETE STRUCTURAL MEMBERS USING INTERCONNECTED STRUCTURAL ELEMENTS, AND ARRANGEMENT FOR INTERCONNECTING THE STRUCTURAL ELEMENTS

BACKGROUND OF INVENTION

The invention relates to a method for producing structural parts and complete structural members using premanufactured structural elements of different form and construction, which are to be interconnected and are preferably manufactured from plastics and which, when interconnected, result in planar structures, the joining of which leads to complete structural members. The invention furthermore relates to a kit for using the method and to an arrangement using the structural elements of the kit.

The production and assembly of structural members and other structures from kits, which consist of structural elements that can be combined with one another in the grid, is known. It is furthermore known to combine such structural elements with guides or equip them with connecting elements, which hold the individual structural elements together. In this connection, the planar structural bodies are supported in connecting elements and thus result in a structural member, which has certain static properties. The German patent 41 30 478 C2 discloses a spatial body, which is constructed in such a manner, that surface elements, pushed into its guide, are held and disposed in certain planes for connection with other connecting elements. Accordingly, the German patent shows a spatial body, which is assembled by the insertion of surface elements. At the same time, the surface structures of two adjacent surface elements are held together by an elastic tape. The technical solution of this publication arises only for the construction of spatial bodies, which find use as illustrative material for instructional purposes.

The German patent 29 50 138 C2 introduces a panel system, for producing particularly containers. The technical solution of this invention is based on introducing connectors into the end faces of the panel elements, thus locking the elements positively. By using edge elements, edge-overlapping connections of the panels are produced in order to build up spatial bodies by these means. It is extremely complicated to connect the individual panels in one plane as well as over an edge, since clamps, which must be moved horizontally and vertically into the elements, have to be used for the connection in one plane. For the flat connections, large-format reinforcing rods, which secure the position of the panel elements in the plane and to stiffen the surface, have to be introduced. When the surface elements meet at right angles to one another in order to form a body edge, angle elements are inserted into the panel elements and the horizontal and vertical surfaces are held together by using eccentric bolt lever fasteners. The use of such panel systems for constructing spatial bodies is very complicated. On the one hand, the use of this system of German patent 29 50 138 does not permit gap-free structural members to be produced. Furthermore, the variability of the contours of the spatial bodies so produced is very limited. On the whole, the costs of constructing spatial bodies with this panel system are extremely high and do not permit spatial bodies to be produced, which meet the requirements of weather, such as rain, snow and a wind loads and protect the interior of the structure against the effects of temperature. The German patent 29 21 599 C2 introduces an apparatus for detachably holding wall and ceiling elements. In accordance with the introductory portion of the main claim, the apparatus finds use in the construction of exhibition facilities and stores for producing furniture, room dividers and partitions. In accordance with the technical teachings, connectors are disclosed, in which slot-shaped receptacles permit wall and floor parts to be inserted and, in one embodiment of an element, enable vertical and horizontal elements to be accommodated simultaneously by insertion. For this purpose, the connecting elements have one-arm or multi-arm slot-shaped receptacles, into which the elements can be inserted. Depending on the position of the slot-shaped receptacles in the connecting element, the introduction of 1 to 4 horizontal or vertical elements, separately or combined, in a horizontal and a vertical arrangement is possible. However, this publication discloses only the connecting elements for the spatial body planes, without showing the elements, which are inserted into these connecting elements. The use, limited in the introductory portion of the main claim, leads to the conclusion that a use of this apparatus in structural members, which must withstand the inclemencies of the weather, must be constructed in large dimensions corresponding to its use.

It is an object of the invention to provide a method for the production of structural parts and complete the structural bodies, using pre-manufactured structural elements of different shape and construction, which are produced preferably from plastic, can be interconnected to provide planar formations, the joining of which leads to complete structural bodies, as well as to provide a kit for using this method and an arrangement using the structural elements of the kit, with which it is possible to assemble structural members of different shape and arrangement to form self-supporting structural members, structural member sections and surfaces.

SUMMARY OF THE INVENTION

Pursuant to the invention, this objective is accomplished owing to the fact that the structural elements are assembled together into planar structural parts and structural members by means of connecting elements, which are to be inserted and overlap edges and surfaces and are fixed and locked in the completely assembled state as compact structural bodies. It is within the sense of the invention that an interconnection of the structural elements is carried out by self-locking connections, in collaboration with slidable connections of the different elements, selected from differently constructed types of guides of the elements. The invention is developed owing to the fact that the structural members of planar formations are interconnected into compact structural bodies by incorporating corner-overlapping and edge-overlapping structural elements in the process of interconnecting the planar structural part. One development is to be seen therein that the structural elements are connected by means of a guided sliding motion of one or several elements, along their outer edge in profiled guides. The continuation of the development also permits the structural elements to be connected by means of a guided sliding motion in the direction counter to the outer contour of one or several connecting elements in open guides, which are not profiled. Pursuant to the invention, the structural elements are connected with a fastening element, engaging the connecting element, along and in the direction counter to the outer contour of the structural elements in the profiles. The invention is developed further owing to the fact that the production of the structural members and structural parts, as well as their adjustment is carried out without mechanical processing and without changing the shape of the structural elements for adapting them to the shape of the structural member. In a further development of the inventive method, the sliding motion takes place with a clamp placed on the T-shaped profile in a hollow profile of the connecting element, along the T-shaped profile of a guide.

Meaningfully developed, the sliding motion of the clamps is carried out in a similar plane of two axes, superimposed in two directions, against the inner regions of the guides of the connecting elements in order to secure the position, the sliding motion of the clamps being carried out in a similar plane in at least two directions in one or more connecting elements. It is a particularly advantageous development of the invention that, for the production of structural members, edge-overlapping and continuous with all body surfaces, edge-overlapping elements are used, the connection of the elements with one another being carried out from the position of the guides in a horizontal and a vertical direction.

In an advantageous development of the invention, which permits an extremely variable configuration of structural members and structural parts, the structural elements are formed from basic and connecting elements and the basic elements with the connecting elements, held in guides and brought into a relationship with one another to form planar and spatial formations of different shape, are interconnected. At the same time, the basic elements and element groups are brought by a plurality of differently developed, edge-overlapping connecting elements, which meet the respective requirements, into an arrangement forming the contours of the structural body. With their edge lengths, the basic elements form a uniform multiple of the connecting elements, placed in connection with their guides, the basic elements, in the configuration of the structural member and the assurance of high static requirements, being surrounded completely in their contours by the connecting elements and connected with one another. Due to this configuration of the basic elements and the connection elements, checkerboard-like locking of the surfaces of the structural member is ensured and the necessarily high, static load-carrying ability is assured. It must be mentioned here that the uniform configuration of the contours of the connecting element, their screening and suitability, permit an aesthetic configuration of the surface of the structural body. Last, but not least, due to the mutual insertion of the guides of direction-changing connecting elements, whereby here direction changing as edge-overlapping for the surface formation or the inclination of the surface of the structural member, the manufacture and assembly of a rigid spatial formation of different geometric shape and spatial arrangement is assured. It is an advantage, which is reflected in the configuration of the elements, that, at the structural elements, which have been constructed as basic elements, these guides, which are constructed as T-shaped profiles, have exposed contours and that the thereto fitting connecting elements have guides, which extend on the inside and into which basic and securing elements are introduced, surrounded by these and held for absorbing tensile, compressive and bending stresses. The invention turns out to be advantageous owing to the fact that the connecting elements are constructed with guides, which are not bent or divided, for pushing onto the respective basic element. This type of configuration of the connecting elements permits a simple assembly, if the basic elements are exposed at their corners and permit sliding on of the connecting elements. A different type of configuration of the connecting elements is necessary, when it is not possible to slide them on, but the use of inner profiles is available. In this case, the connecting elements are constructed in divided fashion. The guides with their profile are then disposed with uniform divisions. After the element halves are disposed on either side of the basic elements, the latter are assembled once again. The assembly takes place in such a manner, that the element halves embrace the guides, holding them, and are fixed with fastening elements. It is a development of the invention that the connecting elements alternatively, depending on the nature of their use and the installation possibilities in the structural members, have profiled guides or guides which are not profiled. The expert has the option of sliding the connecting elements with profiled guides, the profile of which is congruent with the T-shaped profiles of the basic elements, onto these basic elements, the basic elements with guides, which are not profiled, accommodating the profiles of the basic elements by insertion in their guide; in the case of corner-overlapping elements, there can be insertion or sliding on. It is self-evident now and becomes clear when the following further comments are considered, that the profiled guides are self-holding and that, however, holding elements, such as clamps, must be used in the guides which are not profiled. It is therefore a feature of the invention that the guides of the basic elements are provided with a T-shaped profile. In order to permit their use in the structural member, selected connecting elements, as already mentioned, are provided with a T-shaped inner profile, in which the profile of the basic elements is guided by insertion. It is an advantageous development of the invention if the guides of the connecting elements, in their longitudinal extent, are provided on the divided elements and are disposed symmetrically divided and on either side thereto. It fulfills the logic of the invention that, in the divided elements, elements for connecting the parts are disposed, which are formed from profiled openings, into which profiled fastening elements, which permit a positive connection, are inserted. Pursuant to the invention, the fastening elements have been selected as a dowel arrangement with a straddling dowel and an expansion screw. In a logical connection, the use of a holding clamp in the total system of the kit has already found mention above. It is therefore an advantage of the invention that a holding clamp is provided, which has an inner profile, which is congruent with the T-shaped profile of the basic element, extends parallel to this and has a clamping clasp at its underside, which permits a holding engagement with a connecting element. This engagement of the clamping clasp is achieved owing to the fact that the clamp is moved on the T-shaped profile of the connecting element, pushed into the basic element and, with that, both elements, the basic element and the connecting element, are fixed in position. Of course, and it becomes clear here in the following consideration of the basic elements, that the respective connecting element must be adapted in shape to the geometry of the other connecting element for assembling the basic and connecting elements. This adaptation enables the connection between the two elements to be secured by inserting clamps with their holding clasps in two axial directions into the connecting elements. Owing to the fact that the clamps are pushed in a horizontal and a vertical direction into the connecting elements, the position is secured also in two axes. It is an embodiment of the inventive solution that the kit has basic elements, which are constructed in their basic geometric shape as a square, rectangle or triangle, the length of the edge of the respective basic element being at least twice the effective length of the guides of the connecting elements and, according to the diction of the solution, the length of the edge of basic elements and the lengths of the connecting elements forming a grid, for which the length of the edge of the basic elements is a multiple of the length of the guides of the connecting elements. It is within the meaning of the invention that the smallest angle of a corner of a basic element is 27°. A development of the basic elements should be mentioned, which finds its expression therein that the T-shaped profiles of the guides are constructed continuously at the side edges of the basic element, but are flattened in the corner regions down to the thickness of the cross member of the T-shaped profile. In a continuation of the representation of the elements of the kit, a connecting strip is provided, which has a basic rectangular shape with end faces, which are narrower than the side faces. At the side faces of the strip, profiled guides are disposed, the cross section of which is T-shaped and thus is congruently shaped with the basic elements and permits the connecting strip to be pushed onto the basic elements. As already mentioned, the assembly regime is of decisive importance for the use of the respective connecting elements, as becomes clearer below in connection with the configuration of the structural member. For this reason, in employing the invention, the connecting strip, as shown above in its totality, advantageously is constructed in a divided fashion. In this connection, the division proceeds in the longitudinal direction of the element through its center, divides the profile of the guides into two equal halves and permits the connecting element to be attached from the inside of the structural body and the outside in each case with its halves to the basic elements and to be connected by means of fastening elements. As already disclosed in the procedure section, the connection is accomplished by means of straddling dowels, which are inserted into a seat provided for this purpose, connect the two parts of the strip and fix them in position. It is one type of application of the invention that a cross connector is available in the kit. The cross connector is formed from a cross, which is provided with legs of equal length; guides, into which four basic elements can be pushed, are provided at the mutually facing sides of the legs extending on the outside. With that, versatility is ensured for the installation by using this structural element in the interlocking system of the structural body. The guides for accommodating the basic elements are not profiled and, for fastening the basic elements, permit a clamp to be pushed in which, with its inner profile, encloses the T-shaped profile of the basic elements and, with its side surfaces, is inserted in the guides of the cross connector. Eight clamping clasps, two in each of the xth of the legs, hold the four basic elements securely in position in the cross connector. As already explained above, the clamping clasps engage the inner cross beams of the hollow profile of the cross connector. In consideration of the installation regime, the cross connector is also provided in divided form. In this connection, the guides advantageously are provided with T-shaped inner profiles, which surround the T-shaped profiles of the basic elements, holding them, when the cross connector, in the installation cycle, is inserted as a respective half into the structural member and connected with straddling dowels. Of course, the cross connector is divided symmetrically and the dowel seats are disposed uniformly on the axis cross of the surface of the connector. The dowel seats are provided on the upper part and the correspondences are provided with the incorporated denticulations on the lower part. It should not remain unmentioned that the fixed halves are locked at the structural member with an expansion screw, which is introduced into the straddling dowel. It is an advantageous development of the invention that surfaces can be produced with the kit in manifold positions and assembled into structural members. A corner element for accommodating three basic elements, which are parallel and two basic elements, which are not parallel, is provided for producing an edge-overlapping section of a structural body. The summary information of the basic elements, which are to be incorporated, is intended here to emphasize the universality of the element selected. In detail, the element is constructed as follows. Guides, into which basic elements of triangular or parallel shape can be incorporated, are provided in all legs. In this connection, an inclined continuous leg, a vertical leg and a horizontal leg intersect at a point for the introduction into a vertical plane. Two mutually opposite, triangular basic elements and one square or rectangular basic element are inserted into the free spaces of the legs. Parallel to the upper edge of the inclined leg, at an angle of 90° thereto, a further horizontal leg, extending in the plane, is disposed, into which guides are incorporated, which ensure that two rectangular or square basic elements are accommodated in a plane. All basic elements are held in guides and fixed in position with clamps. The inventive kit is developed by an angular strip, which makes it possible to accommodate two basic elements aligned at an angle of 90° to one another. The angular strip has guides with T-shaped inner profiles, the longitudinal center axes of which run parallel to one another, the thereupon directed transverse center axes being disposed at an angle of 90° to one another. This development of an angular strip ensures an edge-overlapping incorporation of basic elements which, in their allocation to one another, form two structural body planes, which are placed at right angles to one another. It is an advantageous development of the angular elements if the element along the center axes of the T-shaped inner profiles is divided into an upper part and a lower part. In this connection, the division proceeds along the center axes of the inner profiles, forming the guide, in such a manner, that the profile is divided into two halves of equal size which, in their longitudinal extent, in each case carry half an inner profile, the planes of which of course are directed at an angle of 90° to one another. After the inner profiles encircle the T-shaped profiles of the basic elements, which are to be connected, a straddling dowel is introduced in each case into the dowel seats, which are disposed in the apex of the angle, that is, precisely in the xth of the two legs. The straddling dowel, introduced with its denticulation into the correspondence in the other part of the angular strip, fixes the latter by way of the denticulation and holds it at the intended place. The invention achieves a meaningful development through an end corner for accommodating four basic elements. The corner is formed from legs with leg necks, which are directed at an angle of 90° to one another. In this connection, two leg pairs are always directed at right angles to one another and thus form a connecting element, into which the four, already shown basic elements are introduced in each case in pairs next to one anther and aligned at an angle of 90° to one another. Of course, the guides in the legs proceed in the same manner, so that, after insertion of the basic elements into the guide of the end corner, an edge-overlapping assembly of two structural body planes is undertaken. A ceiling corner, for assembling three basic elements in three planes, represents an advantageous further development of the inventive solution. Two legs are placed here at an angle of 90° to one another and two further legs adjoin these legs at an angle of 90°. The first pair of legs permits the insertion of two vertical basic elements, which are, however, at an angle of 90° to another, to which a horizontally lying basic element is disposed at the same angle for forming a ceiling plane. A ceiling corner of a structural member is formed by the element. Basic elements, provided with guides, are pushed once again into the ceiling corner and held in the guides with clamps. As also in all other connecting elements, hollow profiles, in the end regions of which recesses are formed for accommodating the clamps, are disposed here in the apex region of the guides. By means of the recesses, which are incorporated in the hollow profiles of all elements, which have guides that are not profiled, a straight flat-surfaced end of the head sides of the connecting element is attained, since the separators, with which the clamping clasp is hinged in the clamp, are taken up by the recesses and since the connecting element forms a plane with the end surface of the clamp or with the end or head surface of the connecting element. The invention is developed owing to the fact that a cross connector with a T-shaped construction is provided, which has guides at both sides of its and at the long edges of the holding body, which guides have such a positional orientation, that four basic elements can be aligned simultaneously in the same direction in one plane and held to one another in guides. On the upper side of the holding body, which extends at right angles to a cross member disposed centrally thereon, the guides are interrupted by a stop, so that the basic elements, disposed on the holding body counter to the cross member, hit the cross member and make it possible to put the connecting strips in place between their edges. These connecting strips may or may not be divided, that is, they can be installed by being pushed on or as halves. Of course, the basic elements, introduced here, are held with clamps in the guides. In order to utilize the advantages of the course connector comprehensively and to be able to produce a structural body plane inclined and bent vertically, the previously shown cross connector is bent in the region of the cross member striking the holding body. The angle of bending is 27°, so that a basic element pair is inclined at an angle of 27° from the horizontal towards the perpendicularly disposed basic elements. Here also, connecting strips are interposed, which can be pushed on or attached as halves, ensure the locking of all parts by means of clamps in the guides provided for the purpose. The edge-overlapping connecting elements of the inventive kit are completed further by a bent ceiling corner. With the ceiling corner, the termination of an inclined ceiling plane with two structural body planes, which are vertical and at an angle of 90° to one another, is brought about. The inclination of the horizontal plane is taken into account at a vertical plane in such a manner, that a triangular basic element is inserted, one leg of which follows the inclination of the plane. Starting out from the intended effects, the ceiling corner is formed owing to the fact that two additional legs intersect at an angle of 90° with legs lying in a vertical plane. All legs carry guides, which are suitable for accommodating quadrilateral and rectangular basic elements. In the horizontal legs, which intersect with the vertical legs at an angle of 90° and follow the course of the inclination of 27°, guides are provided, which take up the horizontally intersecting, yet inclined basic elements. It is self-evident that all three rectangular or square basic elements are secured in the ceiling corner with clamps. The triangular element is also connected with the opposite connecting element by means of a clamp; as a result, it is fixed in position in the acute angle of the apex between the horizontal and the inclined leg of the vertical plane of the ceiling corner. In accordance with the basic idea of the inventive kit of providing a high variability and adaptability of all elements of a kit that is to be produced, an angular strip is provided, which adapts to the conditions of the bent ceiling corner and represents an edge-overlapping, parallel constructed connecting element. The angular strip has two legs of unequal size, which are inclined at an angle of 27° to one another and the outsides of which carry guides with T-shaped inner profiles. Into these inner profiles, the T-shaped profiles of basic elements are pushed, which then, edge-overlapping, form a vertical structural body plane, which is moreover inclined horizontally thereto at an angle of 27°. To lessen the weight, this connecting element, like other connecting elements, has an exceptionally statically effective distortion-resistant incorporation of hollow profiles. As also with other connecting elements described above, this connecting element can be constructed in divided fashion, in order to permit installation from the inside and the outside. For this purpose the element is divided centrally with its cross section following the course of the leg. Moreover, the parts carry dowel seats, which are disposed on the upper part of the leg and have their correspondence in the lower part of the angular strip. When the angular strip parts are nailed in the structural body from the inside and the outside to the basic elements, the straddling dowels are pushed into the dowel seats and fixed in the correspondences and denticulations of the lower part provided for this purpose. It is an embodiment of the invention that a connecting strip is provided, which has a planar, rectangular extent. At the long sides of the strip, guides with a T-shaped inner profile are incorporated. These inner profiles permit the T-shaped profiles of basic elements to be pushed into the profiles of the connecting strip. The configuration of the strip permits basic elements to be installed in one plane. So that the connecting strip receives its approximately square shape, hollow profiles are incorporated between the guides, in order to attain a greater width of this connecting strip. It is an advantageous development of the inventive solution if the above-described connecting strip is constructed in a divided fashion. For this purpose the division is undertaken in such a manner, that two halves are formed, which in each case have half a T-shaped inner profile. Consequently, two half shells result, constructed as upper part and lower part, which can be mounted on the basic elements from the inside and from the outside from structural body planes, the respective inner profile halves connecting with and encircling the T-shaped profiles of the basic elements. The upper part and the lower part of the connecting strip is fixed by means of straddling dowels. For this purpose, on the upper part of the connecting strip along the longitudinal center axis, the straddling dowel seats are provided, into which the straddling dowels are introduced and into which the correspondences of the lower part are introduced. The connecting part becomes effective largely in conjunction with corner-overlapping connecting elements used in the region of inclined planes. The invention is developed further by a floor corner. On the underside, this element has a contact surface and is formed by legs, which proceed horizontally and vertically from the contact surface. Adjoining at an angle of 90° the so set angle, the one leg of which is inclined at an angle of 27° to the horizontal leg, is a further angle consisting of two legs, the long leg of which follows the course of the direction of the vertically extending, inclined leg. The construction of this floor corner permits mutually adjoining basic elements of two planes, one of which is inclined at an angle of 27°, to be incorporated in a corner region and to support the therefrom constructed walls on a contact surface. Guides without disposed T-shaped inner profiles permit basic elements to be inserted and to be secured by pushing clamps into the corresponding hollow profiles adjoining the guides. A connecting element, adjoining the floor corner, is constructed as an inclined floor strip. The floor strip has a basic body, which carries T-shaped inner profiles of guides along its upper edge. A contact surface, extending at an angle on the basic body, is constructed at the lower longitudinal edge. The contact surface extends from the outer long surface of the floor strip inclined at an angle of 27° to the rear, short surface. Due to the fact that this contact surface is inclined, the basic element is provided with the necessary inclination for supporting basic elements, incorporated in or pushed onto their guides, in an inclined position on a foundation material. Within the installation regime, it may be necessary to put the floor strip in place and not to push it on; for this reason, in a meaningful development of the invention of the kit, the floor strip is constructed in divided fashion. The division proceeds in the direction of the center axis of the guide directed perpendicularly to the longitudinal center axis and divides the T-shaped inner profile of the strip up to the region of the basic body. Moreover, the upper part and the lower part have dowel seats, into which the straddling dowels are pushed when the upper part and the lower part of the floor strip are disposed at the respectively provided basic element and the inner profile of the floor strip embraces the T-shaped profile of the basic element. The floor strip, protruding in an inclined version, is now constructed for absorbing vertical loads from the structural body planes in such a manner, that a contact surface, which places the contact strip in a precisely vertical direction of its center axis and thus assures a secure contact surface for vertically extending walls, is disposed along surface sides opposed by T-shaped inner profiles. Of course, despite all variability and specific properties of the connecting elements, a divisibility of the floor strip is attained here. Of course, despite all the variability and specific properties of the connecting elements, a divisibility of the floor strip is achieved here. The division proceeds in a manner equivalent to that of the inclined floor strip, along the vertically directed center axis through the guide with its incorporated T-shaped inner profiles. In a continuation of the inventive solution and developing the latter, a wall corner is provided. The wall corner serves to support a structural member surface inclined at an angle of 27° from the horizontal plane. For forming the corner configuration, a leg is provided at a vertically extending leg, in which guides for introducing the pointed corner of a triangular basic element are provided and which endows the vertical surface with the edge-extending inclination of 27° from the horizontal, and adjoins thereto at an angle of 90° and carries at its side directed to the opening of the guide in the vertical leg a horizontally extending guide. Counter to the incorporated horizontal guide, a leg is bent vertically downwards and has a bearing surface at its thus extending outer side. This bearing surface supports the forces of the structural body, acting approximately horizontally from the inclined surface, against a wall, which is, for example, already present. A contacting surface, below the two legs, permits a secure support for the corner constructed at the wall. Pursuant to the invention, the guides are constructed so that the basic elements, here a rectangular and a triangular basic element, are pushed in and secured appropriately with clamps. Following the basic concept of the construction of the horizontal, inclined surface and ensuring an interaction with the just now described wall corner, a wall strip is provided. The wall strip consists of a horizontal, short leg and a horizontal long leg. The long leg is linked at an angle of 27° to the short leg and, at its upper side, a guide provided with a T-shaped inner profile is disposed. At its head, the short leg has a bearing surface, which is caused to lie against a wall, which may, for example, be present. In this connection, the bearing surface is aligned with the construction of the wall corner and ensures a distribution of the load over several connecting elements. At the underside, a contact surface is provided for absorbing the vertical components of the load from the structural body plane. In accordance with the construction of its guide, the wall strip is pushed onto the T-shaped profiles of a basic element. Should the installation regime of the kit require a different type of incorporation, then the wall strip, in accordance with an inventive development, is constructed in a divided fashion. The division, moreover, proceeds perpendicularly to the guide, through the long leg and divides the greater portion of the leg into an upper part and a lower part, each of which carries half a T-shaped inner profile. Dowel seats with the planned correspondences incorporated in the upper and lower parts, permit these parts to be assembled in the installation state, in order to permit the basic element and an introduction of straddling dowels for fixing the wall strip in the structural body plane. Here, as with all divided connecting elements, the final locking together at the structural member takes place when all connecting elements of the section or of the structural member are aligned with one another in their final position. The final, static effectiveness of the composite construction of the elements in the structural member is attained, as explained repeatedly already above, by the locking, which is concluded advantageously here with the introduction of expansion screws into the straddling dowels. Pursuant to the invention, the kit is developed further owing to the fact that a T-shaped connector is provided. The T-shaped connector consists of a holding body, which extends horizontally and on which, in its longitudinal extent, a centrally adjoining cross member is provided. The T-shaped connector has guides at its holding body, as well as at the sides of the cross member and the thereon adjoining sectors of the holding body. Within the scope of assembling the structural member, three basic elements can be introduced into these guides. The basic elements are provided here as rectangular or square elements. Of course, it is of no importance here if, in a continuation of the inventive concept, a triangular element would be introduced with its right angle into the guide between the holding body and the cross member. Of course, the basic elements are locked by clamps, which are pushed into the guides and, with their clamping clasps, hold the basic elements and the T-shaped connector together. Of course, as with other connecting elements also, the separators of the clamping clasps are pushed into recesses, in order to provide a smooth alignment for the next connecting element.

The inventive floor connector, which is to be introduced, has a configuration similar to that of the T-shaped connector. The floor connector has the shape of an inverted T with a holding body, which extends transversely, and a vertical cross member, which is nailed to it centrally. The lower edge of the holding body is provided with a contact surface and provides a secure upright position for the floor connector. Guides are provided on either side of the cross member with the remaining legs. Basic elements, which in this case have a vertical effective position and extend flush in one plane, are pushed into these guides. The basic elements are effectively connected by the floor connector by clamps pushed onto them. A floor-wall corner is provided in order to complete the kit of the connecting elements in the bottom region. The corner is formed from two legs, which are directed at an angle of 90° to one another and to the back surfaces of which active planes are assigned as bearing surface on the vertical leg and as contact surface on the horizontal leg. In the inner region of the leg, directed towards its apex, guides are provided, in which a basic element, held with clamps, may be provided. For the further completion of the kit, a ceiling-wall corner must be introduced. The ceiling-wall corner consists of two angles, which are formed from three legs, of which one leg proceeds at an angle of 90°, starting from the apex of the first angle. Guides are disposed in the inner regions of the three legs. The configuration of the legs permits the introduction of three basic elements. Of these, two basic elements form the perpendicularly extending structural member planes and the horizontally extending basic element forms the ceiling or the roof plane of a structural member. Of course, the basic elements are pushed into the guides here also and held at the connecting element by means of clamps and holding clasps. In order to enable the sliding installation of three planes directed mutually towards one another, an element, which is introduced pursuant to the invention and constructed as transition part, connects three structural member planes with one another. Supported by a vertical plane, a horizontal ceiling plane and a horizontal, inclined plane, bent therefrom, are formed here. In this connection, the transition part has a vertical leg, adjoining which there is a horizontal plane and a plane inclined at 27° to the horizontal. These three legs form a vertical plane. Two further legs are provided, which border on the course of the contour of the horizontal as well as the inclined leg at an angle of 90° and form the ceiling and the inclined, horizontal plane by taking up appropriate basic elements. A rectangular or square basic element and a triangular basic element are inserted in the vertical region of the transition part and two either horizontal or square basic elements are incorporated in the horizontally extending leg regions of the transition part. With this part, it is possible, in a sliding construction course, to connect horizontally and vertically colliding planes continuously and to fuse them into a united structural body. Here also, as with all connecting elements, which do not have a guide with a T-shaped inner profile, the basic elements with pushed-on clamps, are pushed into the guides and are secured by overlapping clamping clasps. In the above explanations of the connecting elements and the basic elements and of the manner in which they are assembled and connected, there has frequently been mention of clamps. The clamps have not been disclosed at the beginning, because the method has played a role only now for the configuration of the individual connecting elements to the basic elements. With that, it is now necessary to describe the clamps, their configuration and construction, as well as their mode of action in the inventive solution in greater detail. The clamp is constructed from a longitudinally extending basic body, into which an inner profile is incorporated, which extends longitudinally and is formed congruently with the T-shaped profile of the basic elements. At the back of the clamp, a tongue-shaped clamping clasp is provided which, with an appropriate gap, is connected with the clamp over an appropriate separator at the back of the clamp. The clamp is opened in the region of the gap, that is, below the aligned tongue. The clamp is pushed with its inner profile onto the T-shaped profile of a basic element and protrudes with the opening of the clamping clasp against the corner of the basic element. With the clamp pushed on and set back by the length of the clamping clasp, the basic element is pushed into the guide of the connecting elements, which do not have a T-shaped inner profile. By shifting the clamp into the connecting element, the clamping clasp is pushed over the hollow profile, which is disposed under each guide. To accommodate the separator, the hollow profile is set back somewhat in the region of the bottom of the guide and forms a recess, into which the separator of the clamp is pushed. By these means, it is assured that the stop surface of the connecting element is plane parallel with that of the next connecting element and extends correspondingly. A corresponding arrangement of the clamp is claimed pursuant to the invention and explained. A connecting element, with guides placed at an angle to one another in a plane, is connected with a basic element. At each of its two T-shaped profiles, placed at an angle to one another, the basic element carries a clamp, which is pushed with its clamping clasps into the hollow profiles of the connecting elements for holding and securing the basic element. As a result, the position of the basic element in the connecting element is secured horizontally in an x axis and vertically in a y axis. Owing to the fact that the recesses take up the separators of the clamps, a planar contact of the following connecting element, as already explained, is assured. The disclosed incorporation of the clamps in the guides and the therewith attained positional securing of the basic elements in the guides, is advantageously supported additionally by the fact that mutually opposite sealing elements are inserted in the hollow places of the guides in their side walls in the region of the base and of the head of the guides. These sealing elements are disposed in all guides of the connecting element, irrespective of whether they have a corresponding or a T-shaped inner profile. The sealing elements at the foot of the guides enclose the side wall of the clamps and seal the necessarily resulting gap between the head of the T-shaped profiles of the basic element and the side wall of the guide. The sealing elements, which enclose a profiled region of the basic element used and lie against it, sealing it, and which are disposed in the head region, seal all types of guides precisely.

However, the straddling dowel, which is to be provided pursuant to the invention, is a completing element, essential for the kit. The straddling dowel has a rectangular head part, which is bent at right angles and adjoining which there is a parallel shaft with a rectangular cross section. At the lower end of the shaft, a denticulation is provided, which protrudes into the correspondences of the respective lower parts of the connecting elements and is connected with the therein disposed denticulation. If the straddling dowels are inserted into the dowel seats of the connecting elements, then they lock the basic elements and connecting elements, brought into effective connection with one another, by the expanding force of the dowel and by the holding force of the denticulations, which are brought into engagement. Accordingly, it is possible to bring the configuration of the structural body first of all into a position, which is fixed, but not secured statically. After all parts are aligned and their gap-free position checked, expansion screws are inserted in the straddling dowels, the elements are brought into a statically effective position and the structural member is finally fixed. In the sense of the invention, it is self-evident that the advantages and solutions, noted in the technical explanations, cannot be presented completely. The exceptionally advantageous design and variation possibility of the kit are reflected in the originality and versatility of the elements associated with it. The most important advantage and also its functional, basic condition is seen to lie therein that the kit permits structural members to be produced in various forms and sizes, without having to change a part mechanically. It follows logically that this advantage is even a constraint since, when changes are made in the modular dimensions of any part of the kit, the logistics of its use are made inoperative and its advantage is canceled. Practical demands are taken into consideration in that, as far as possible, connections are largely aimed for here, the elements of which can be fitted and act uniformly. Not only the length, as the measure of the connecting elements forming the grid, is uniform, but also, looked at more precisely here, the connection—basic element connecting element with a T-shaped inner profile and the connection—basic element connecting element with a straight guide and a clamp with a T-shaped profile. The elements are brought into concordance to such an extent, that the matchability of the guide and the holding mechanism employed for the basic elements differ in them only by the insertion of the clamp. Even the integration of the sealing elements in the guides, which actually belongs to the state of the art, as seen from the original incorporation in the guides, with the overlapping sealing action on the basic element in the region of its profile, is an innovation here and contributes to the fact that the finished structural member or its partial planes have high use properties. In the following explanation of an example, only one structural body plane is explained. The inventive solution permits so many possible variations and so many possible designs are made available to the expert, that the presentation even of several possible applications would not be sufficient to represent the variability and design possibility of the inventive solution exhaustively. The solution is not to be limited to forming closed structural members or vertical surfaces. Rather, it is conceivable to construct the ceilings of light domes, inner courtyards, workshop roofs in serrated or shed form and much more. From the explanations above, the expert infers that additions to and intermediate constructions of structural members in existing buildings are also possible without difficulties or adaptation work.

The invention is to be explained in greater detail by means of an example, in which like reference numerals designate the same elements.

DETAILED DESCRIPTION OF THE INVENTION

Figure 1:
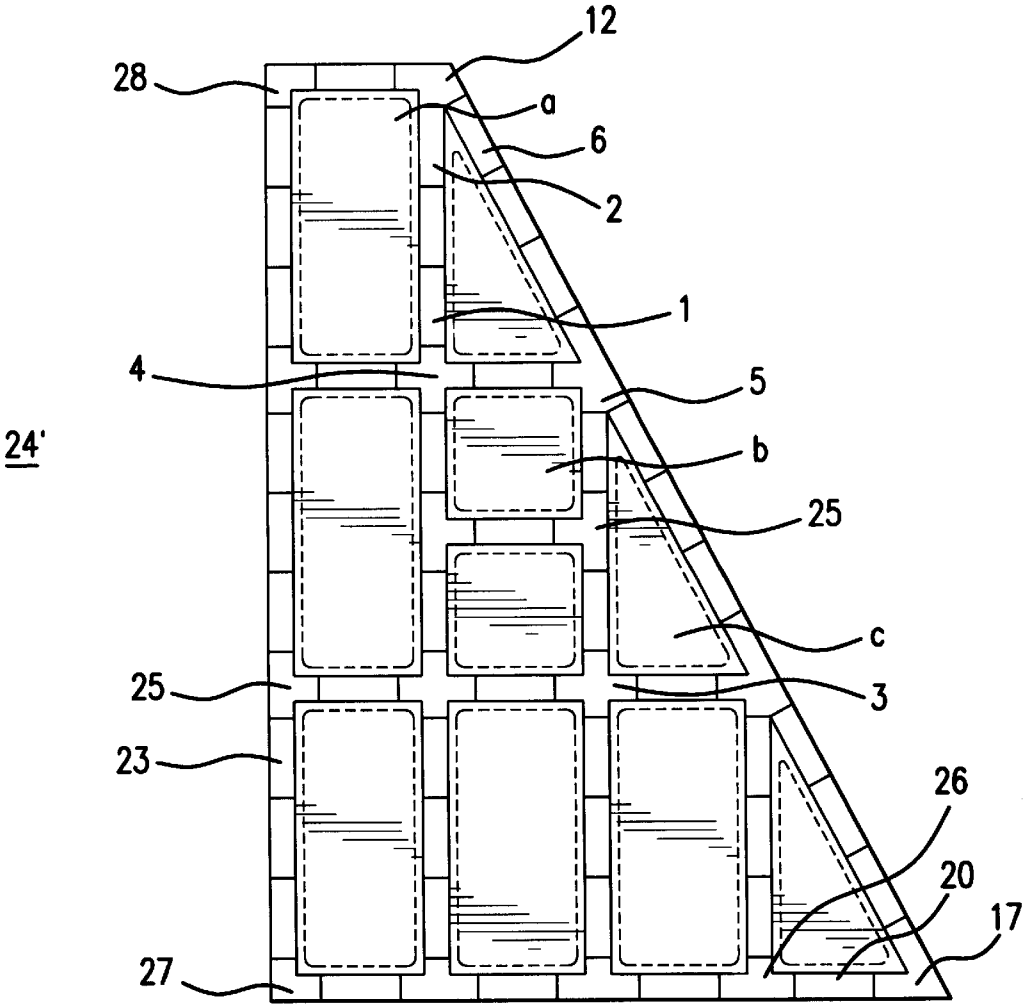
FIG. 1 shows the kit in a selected combination of the side wall of a supplementary building with an inclined frontage.

One type of application of the kit is shown in FIG. 1. It is a question here of a side wall of a structural body, which is disposed with its back front at a house wall 24'. The wall is constructed of square, rectangular and triangular basic elements a; b; c and held together with connecting elements. The connecting elements 1–29 enclose the basic elements a; b; c in framework fashion. At the corner and crossing places of the connecting elements, floor connectors and cross connectors 3; 26 are disposed. These connectors 3; 26 are connected horizontally as well as vertically with connecting strips 20; 26. In the floor region, the connecting elements are assembled from the floor strips and the floor connectors 20; 26 into a level line. The floor corners 17 and floor-wall corners 27 are incorporated in the corner regions. Simultaneously, at an angle of 90° to the already built-up line of elements, a further basic line for a kit plane is connected over these elements 17; 27. A second plane of the planar wall of the structural body is produced from the basic elements a; b and c. The lower connecting strap is formed here from wall connectors 25, connecting strips 1, cross connectors 3; 4 and corner elements 5; 17.

The basic elements b are disposed above one another and, in framework fashion, developed by means of connecting elements, such as T-shaped connectors and connecting strips, into a surface assembled to the size of the basic element a.

Figure 1A:
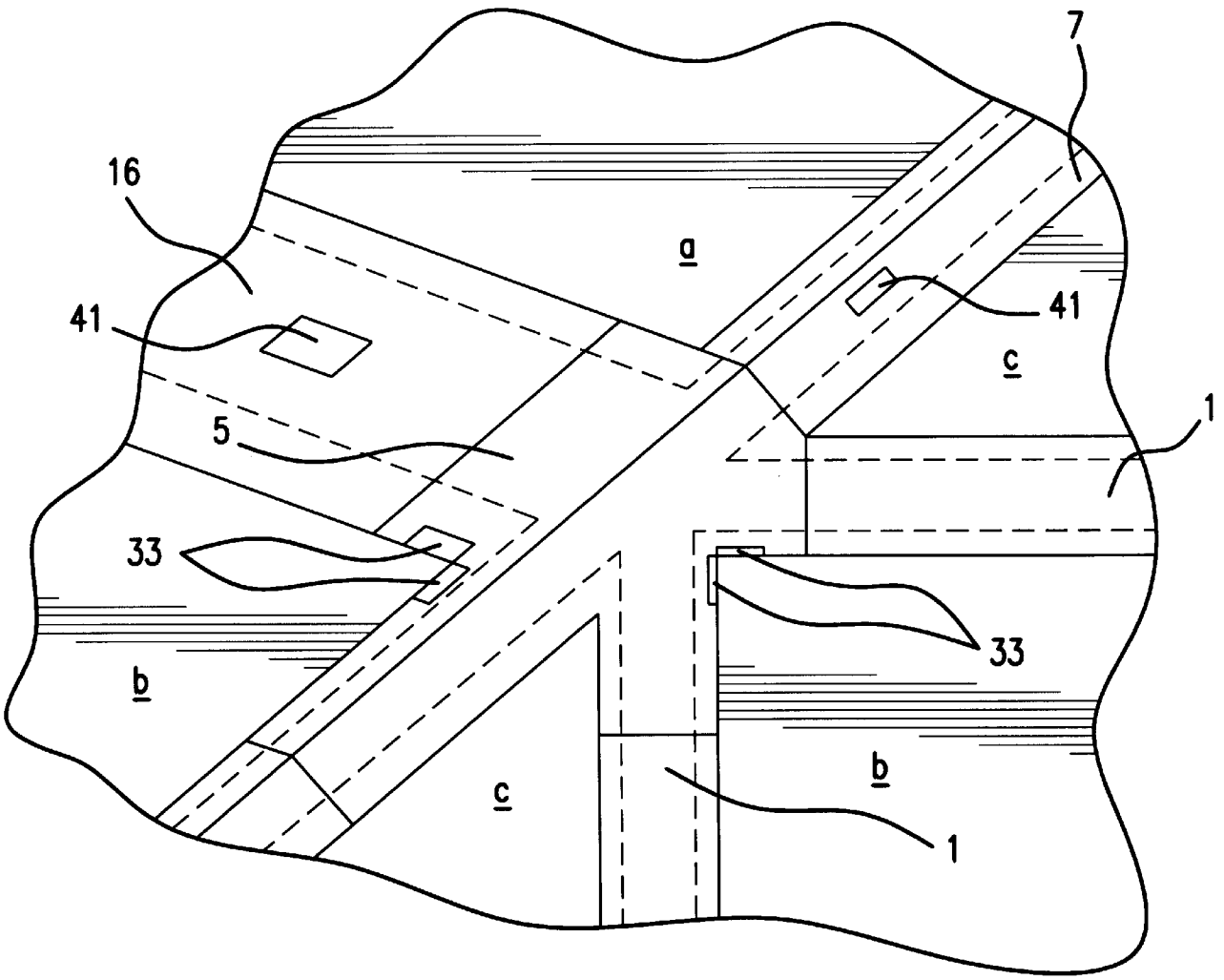
FIG. 1*a* shows an edge-overlapping construction of a structural body with the lateral face as in FIG. 1.

In the third plane, the basic elements a; c are combined into a section of the wall and inserted with a ceiling corner, a ceiling-wall corner and the necessary connecting strips 1, including the corresponding connectors 3 and 5, into the composite of the surface. The overview of the representation, corresponding to FIG. 1, gives an insight into the framework-like grid of connecting elements 1–29, surrounding the basic elements a; b; c, for erecting planar structural members of different symmetrical construction. The basic elements a; b and c, used for this purpose, and the connecting elements of different symmetrical and functional construction, are shown and explained in detail in the following Figures. FIG. 1*a* represents the possibility of assembling planar and edge-overlapping basic elements a; b; c within a structural body in such a manner, that not only horizontal and vertical body planes are connected to one another, but also, as here, a horizontal directed, but inclined body plane is connected at a vertical surface with an inclined edge in a part of a structural member, which, for example, is complicated. This is realized by a corner 5, with a 27° leg inclination. In the horizontal, inclined zone of the corner 5, a rectangular basic element a and a square basic element b are incorporated in the guides 42 and secured with clamps 33, as indicated in only one corner here. A basic element c, engaging the connecting element with the acute angle, opposite to this, following the inclination of the edge, a basic element c introduced with the obtuse angle in the guides 42, are in the vertical body plane in the legs or in the guides 42 disposed therein in the upper region, the basic element b, inserted between the basic elements c, initiating the horizontal alignment of the vertical structural member plane. In the horizontal, inclined region, a connecting strip 16, as well as a divided angular strip 7, pushing against the connecting element 5, and for connecting with the basic element b, in each case a horizontal and vertical, nailed-on connecting strip 1 is drawn on the divided connecting strips 16 and 7, here indicated dowel seats 41. This arrangement of basic and connecting elements in the region of an inclined surface, which pushes against a vertical body plane at an angle of 90°, permits the high degree of variability of the kit to be recognized.

Before the individual connecting elements of the kits are described, it is necessary to provide an explanatory insertion for understanding the repeating elements parts, their function in the kit and their connecting elements. At the places where they connect, the connecting elements are provided with inner profiles 34' and 42'. The inner profiles 34' are congruent with the shape of the T-shaped profile 34 disposed on the outer edges of the basic elements a; b; c. When these inner profiles are present, two types of incorporation of the respective connecting elements in the structural body are possible. On the one hand, it is permitted, at the start of the installation, to push the elements with their inner profiles 34' onto the T-shaped profiles 34 and, with that, to connect the basic element or elements a; b; c.

When the state of installation has progressed and it is no longer possible to push-on the connecting element with an incorporated T-shaped profile 34, a division of the respective connecting element takes place. The division is undertaken so that the separation into an upper part and a lower part in each case passes through the T-shaped inner profile 34', as a result of which the guide 37 is opened and the basic elements a; b; c, which are already fixed in position, can be embraced by the connecting element. After they are embraced, the parts are fixed, as illustrated, for example, in FIGS. 15*a*, 32*a*, 53*a*, 58*a*, 67*a*, 72*a* and 81*a*. Fixing takes place by inserting the straddling dowel 32 into the appropriate dowel seats 41, which are embedded in the upper parts 40 of the connecting elements and have their correspondences 77 in the lower parts 40'. The straddling dowel 32 is passed through the upper part into the correspondence of the lower part. In the lower part 40', a denticulation is incorporated, which is engaged by the denticulation 31 of the shaft 75 of the straddling dowel 32. Due to the clamping action of the denticulation 31; 31', the straddling dowel 32 is held and locks the parts 40; 40' of the respective connecting element and the therein held basic elements a; b; c. After a section of the structural body or a structural plane is finished, all elements are fixed by the insertion of an expansion screw 30 into the straddling dowel 32 and a pressing together of the guide 37 with the incorporated T-shaped profiles 34. Sealing elements 38; 38', which embrace the T-shaped profile and the profile region 80 of the basic elements, sealing them, are incorporated in each case in a manner, the details of which are not described, in the inner profile 34' of the guides 37. The arrangement refers only to elements, which are installed in one direction. If the basic elements must be installed in the connecting elements in two incorporation directions analogous to an x and a y axis, then the guides 42 are constructed parallel and open, have a rectangular cross section and permit insertion of the basic elements a; b; c, which are provided with a clamp 33, into the guide 42 of the respective connecting element. In this connection, the clamps 33, which are provided for holding purposes, are pushed with their inner profiles 34' onto the T-shaped profiles 34 of the basic elements a; b; c and brought approximately into the region, in which they are to be connected with the respective hollow profiles 39 in the guides 42. Accordingly, the basic elements are always installed in the guides 42 with clamps 33, which hold the basic elements a; b; c in the guides 42 of the connecting elements.

Figure 2:
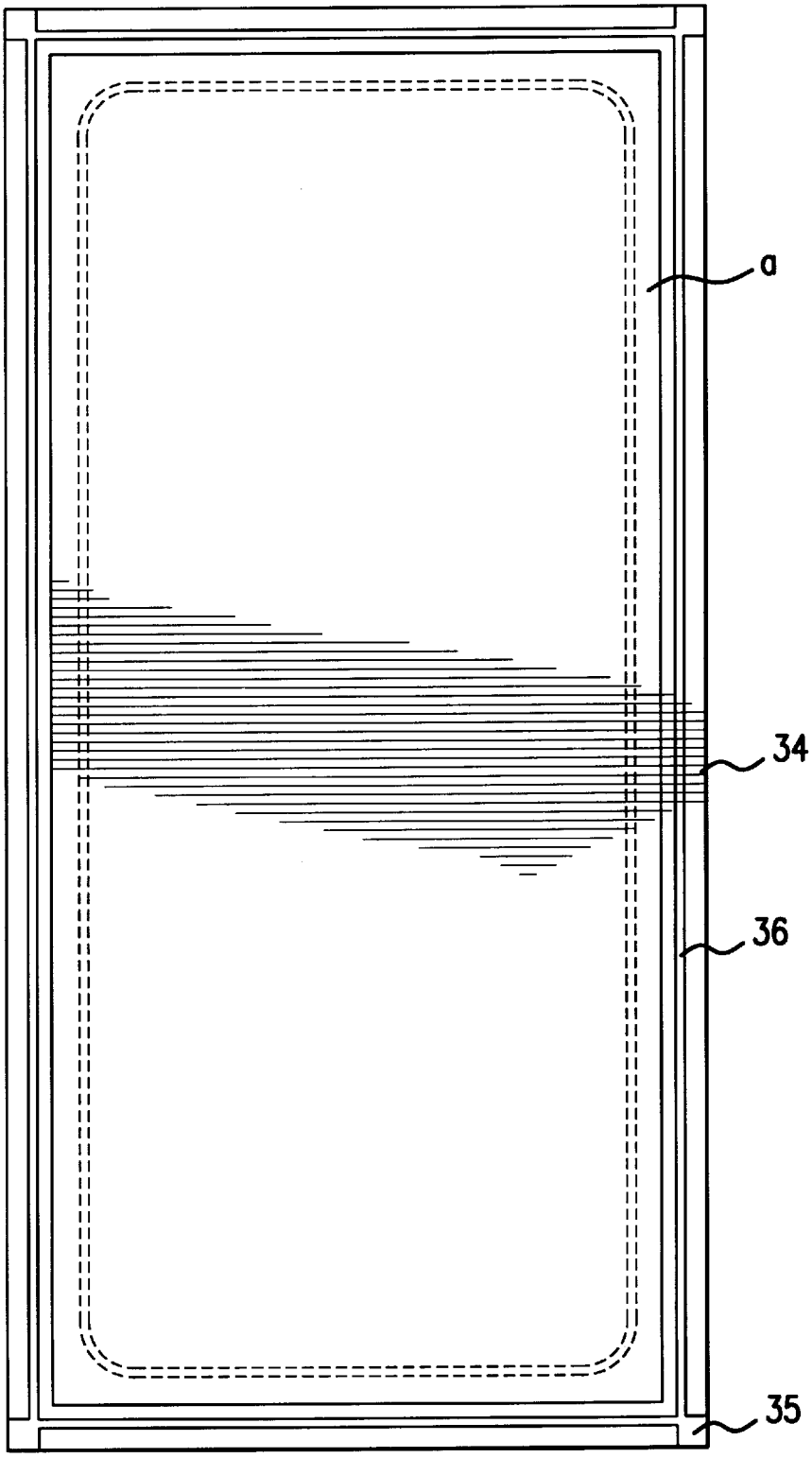
FIG. 2 shows a rectangular structural element in a front view.
Figure 3:
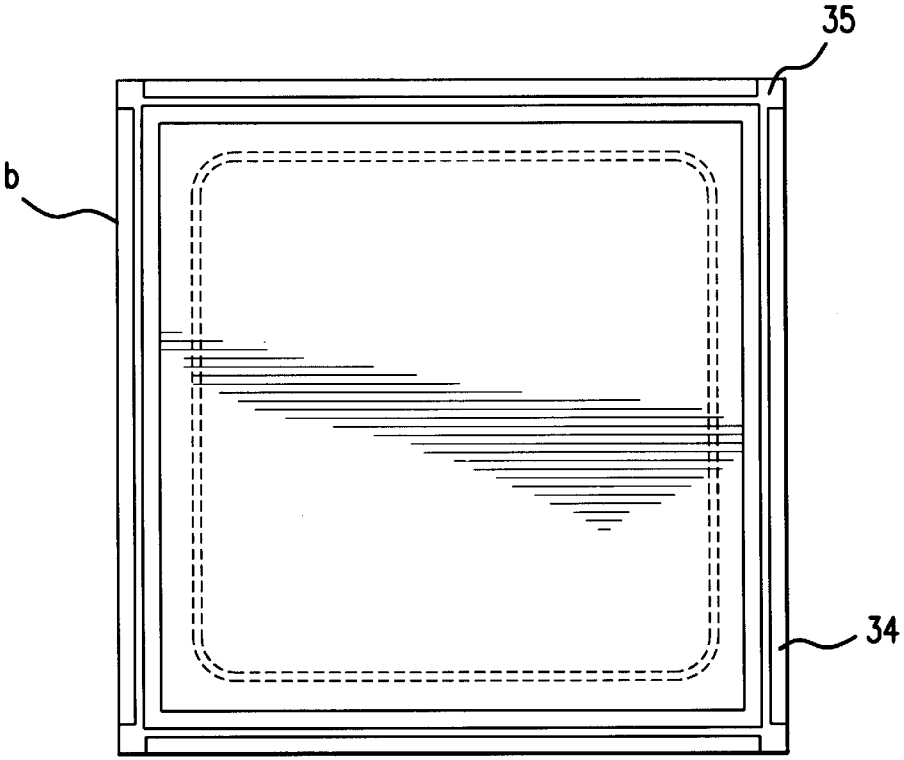
FIG. 3 shows a square structural element in a front view.
Figure 4:
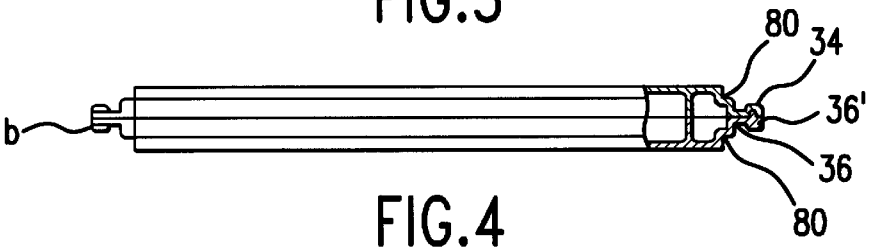
FIG. 4 shows the structural element of FIG. 3 in a plan view.
Figure 5:
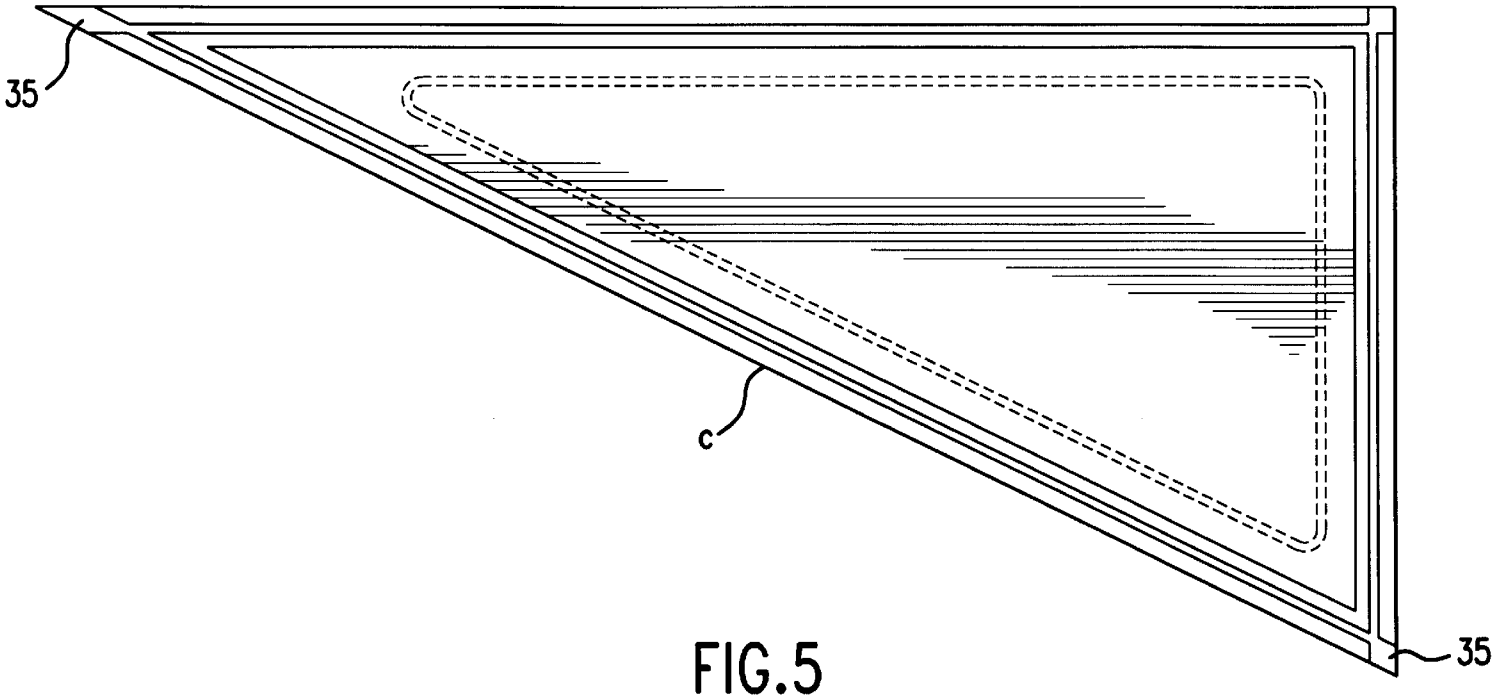
FIG. 5 shows a triangular structural element in a front view.

The expert infers particularly from FIG. 1 and 1*a*, as well as 105 and 106 that the manufacture of the structural bodies of diversified shapes and use is possible, without having to adapt mechanically even only one of the connecting elements for the given conditions. It must be emphasized that a change in the grid as well as in the modality of the connecting elements detracts from the effectiveness and from the effectivity of the kit that is to be used and would destroy its advantageous use. FIG. 2 shows a basic element a. The element a has a rectangular, planar construction. At the outer contours, guides are disposed, which are constructed as T-shaped profiles 34, which enclose the contours of the basic element a. At the corners of the basic element a, the T-shaped profiles 34 are provided with flat corner portions 35 up to the thickness of the cross member 36. The flat portions 35 are technologically necessary, in order to ensure that connecting elements, with T-shaped profiles 34 of the same type as those of the inner profiles 34', can be pushed onto or placed on the basic elements and connected with one another by means of clamps 33 (not shown). The shape of the T-shaped profile 34 is shown in connection with FIG. 4 on the square basic element b of FIG. 3. FIG. 3 shows a basic element b of square shape and similar planar construction as the basic element a. At the corners, flat corner portions 35 are provided, as they are in the case of the basic element a. FIG. 4 shows the basic element b in a plan view, partially in section. It can be seen that the basic element b, like the basic element a, consists of a hollow body, the edges and corner regions of which are combined into a peripheral T-shaped profile 34. The transition of the profile takes place over a cross member 36 to the basic element b, so that the T-shaped profile 34, with its thickened end, outlines the outer contours of the basic elements a; b. The T-shaped profile 34 is formed so that its thickened head can be inserted into the guides 37; 42 of the connecting elements and a clamp 33 can be pushed into the guide 42 to secure the position of the respective basic element a; b; c. FIG. 5 shows a basic element c in a triangular form. The legs of the right-angled triangle, as well as the hypotenuse are provided with a T-shaped profile, which has the same dimensions as well as the same shape as the basic elements a; b. The corners of the element c are provided with flattened corner portions 35 and permit the T-shaped profiles 34 to be pushed on freely and the clamps 33 to be accommodated in the guides 42.

Figure 6:
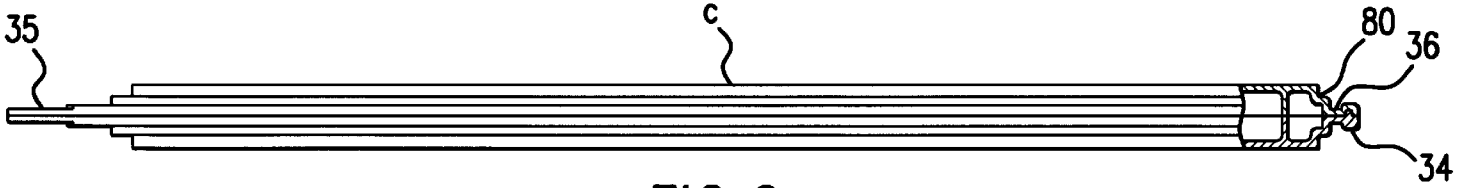
FIG. 6 shows the structural element of FIG. 5 in a plan view looking at the longer leg of right-angled triangle.
Figure 7:
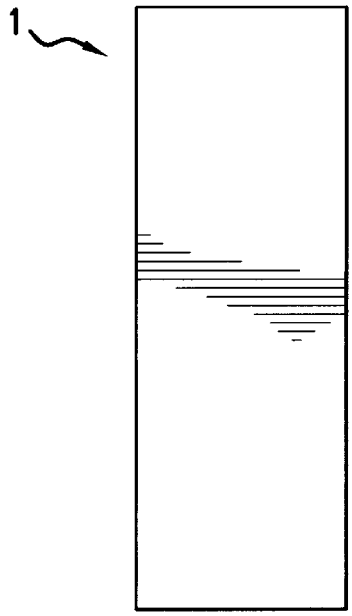
FIG. 7 shows a structural element constructed as a connecting strip in a front view.

FIG. 6 shows the construction of a T-shaped profile 34 in a partially sectional representation of a side view of the basic element c. The user is made familiar with the fact that the profile construction selected here is the same as that selected for the basic elements a; b. The basic elements a; b; c have at the transition of the cross member 36 to the basic body a thickened profile region 80 which, during the installation of the clamps 33 and with the connecting element pushed on, engages the sealing element 38', shown, for example, in FIG. 10. FIG. 7 represents a connecting strip 1 in front view. The diagrammatic front view is intended to show only the outline of the connecting strip 1 and the ratio of its length to its width which, in the following representation, is intended to be the basis for naming the grid size of the connecting elements. It may already be noted now that all connecting elements, in their longitudinal extent, have the same size as viewed from the respectively adjoining connecting element and form a certain uniform grid.

Figure 8:
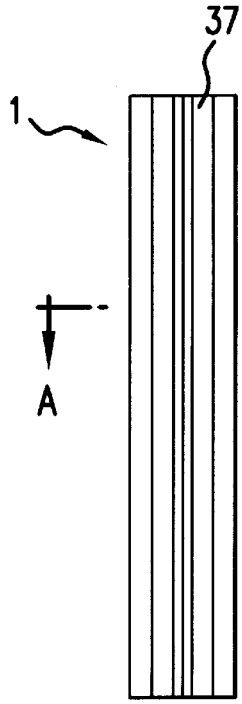
FIG. 8 shows the connecting strip of FIG. 7 in a side view.
Figure 9:
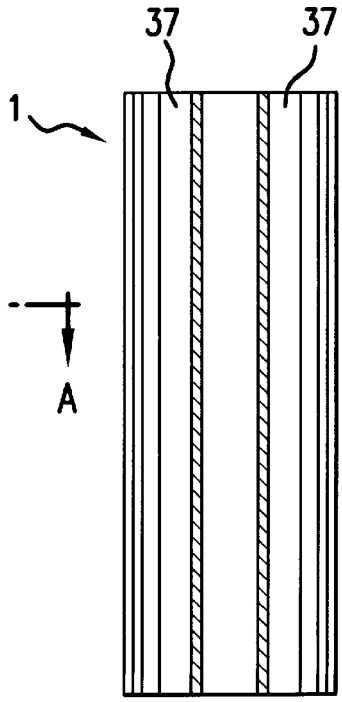
FIG. 9 shows the connecting strip of FIG. 7 in longitudinal section, FIG. 10 the connection strip of FIGS. 7 to 9 in cross section.
Figure 10:
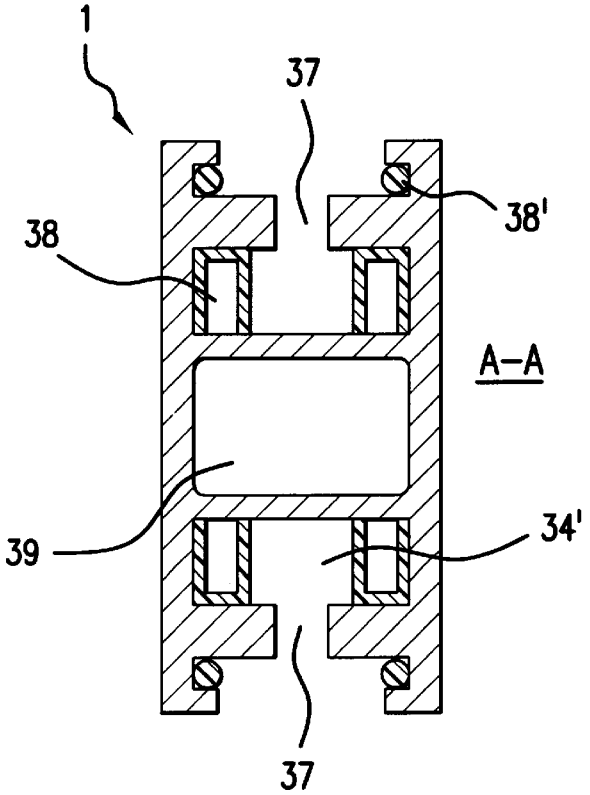
Figure 11:
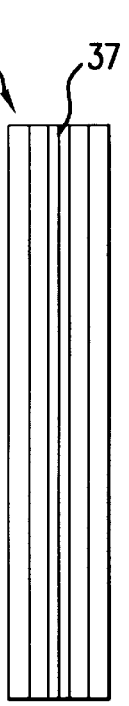
FIG. 11 shows a structural element, constructed as a connecting strip, in a divided version in side view.
Figure 12:
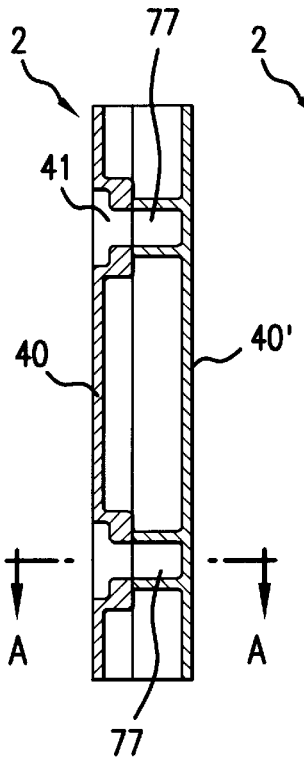
FIG. 12 shows the connecting strip of FIG. 12 in a longitudinal section along the center line.
Figure 13:
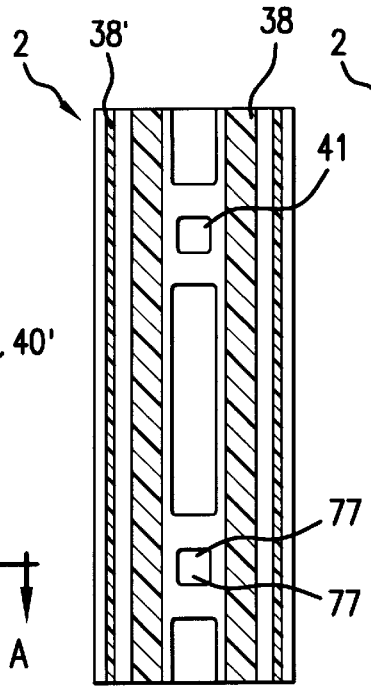
FIG. 13 shows the upper part of the connecting strip of FIG. 12 in a view from below with the sealing elements inserted.
Figure 14:
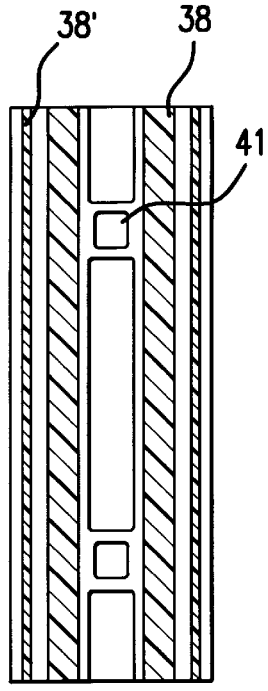
FIG. 14 shows the lower part of the connecting strip of FIG. 12 in a front view with the sealing elements inserted.
Figure 15:
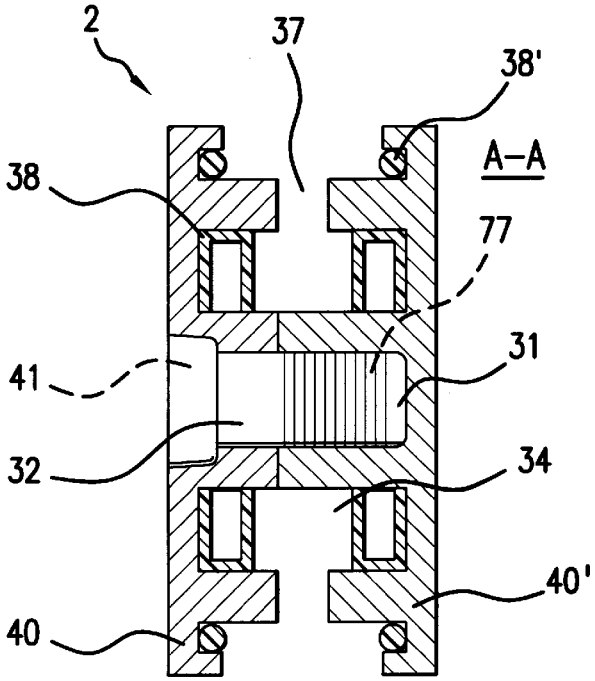
FIG. 15 shows the connecting strip of FIG. 11 in cross section.

FIG. 8 shows the side view of the element of FIG. 7. FIG. 9 illustrates a complete representation of the connecting strip 1 in a longitudinal section. The sectional representation shows the course of the guide is 37 in the connecting strip 1. In FIG. 10, the section A—A of FIG. 8 is shown. The sectional representation shows the transverse construction of the strip 1 with the lower profile 39 and the thereon adjoining guides 37, which are constructed corresponding to the T-shaped profile 34 as an inner profile 34'. Seating elements 38; 38' are incorporated in the guides 37 and act in such a manner, that the introduced T-shaped profile 34 of the basic elements a; b; c is held air-tight and with the proper fit. FIG. 11 shows a connecting strip 2 in a divided construction. The side view shows the course of the guide 37. FIG. 12 represents the connecting strip 2 in a sectional representation having the same view as FIG. 11. The cut profile of the parts 40; 40' of the strip 2 shows the connecting plane of both parts 40; 40' as well as the position of the dowel seat 41 for fixing both parts 40; 40' to the basic the profiling c. It can be seen from the profiling of the dowel seat 41, shown in FIG. 15 that the straddling dowel 32 has an insertion head and, connected with the correspondence 77 of the lower part 40', is fitted into the upper part 40 for fixing the position on the respective basic element a; b; c. FIG. 13 shows the upper part of the connecting strip 2, as seen from its inner side. The position of the sealing elements 38; 38' in the guide 37 can be seen clearly. FIG. 14 shows the lower part of the connecting strip 2, as seen from the inside. Here also, the position and incorporation of the sealing elements 38; 38', as well as the construction of the dowel seat 41 can be seen clearly. FIG. 15 shows the section A—A in FIG. 11. It can be seen here that the straddling dowel 32 is inserted in order to fix the position of the parts 40; 40' of the connecting strip 2. The dowel 32 has a denticulation 31, which is congruent with an opposite internal denticulation 31', which is in the lower part 40' of the connecting strip 2 and incorporated into the correspondence 77. By inserting the straddling dowel 32 into the borehole 41 of the lower part 40', the parts are fixed with respect to one another and form a functional unit. For finally fixing the straddling dowel 32 in the connecting strip 2, it is possible to introduce an expansion screw 30, the arrangement and function of which is to be an object of later explanations and which is not shown in FIG. 15. The construction of the guide 37 for accommodating the T-shaped profile 34 is identical to that in the connecting strip 1.

Figure 15A:
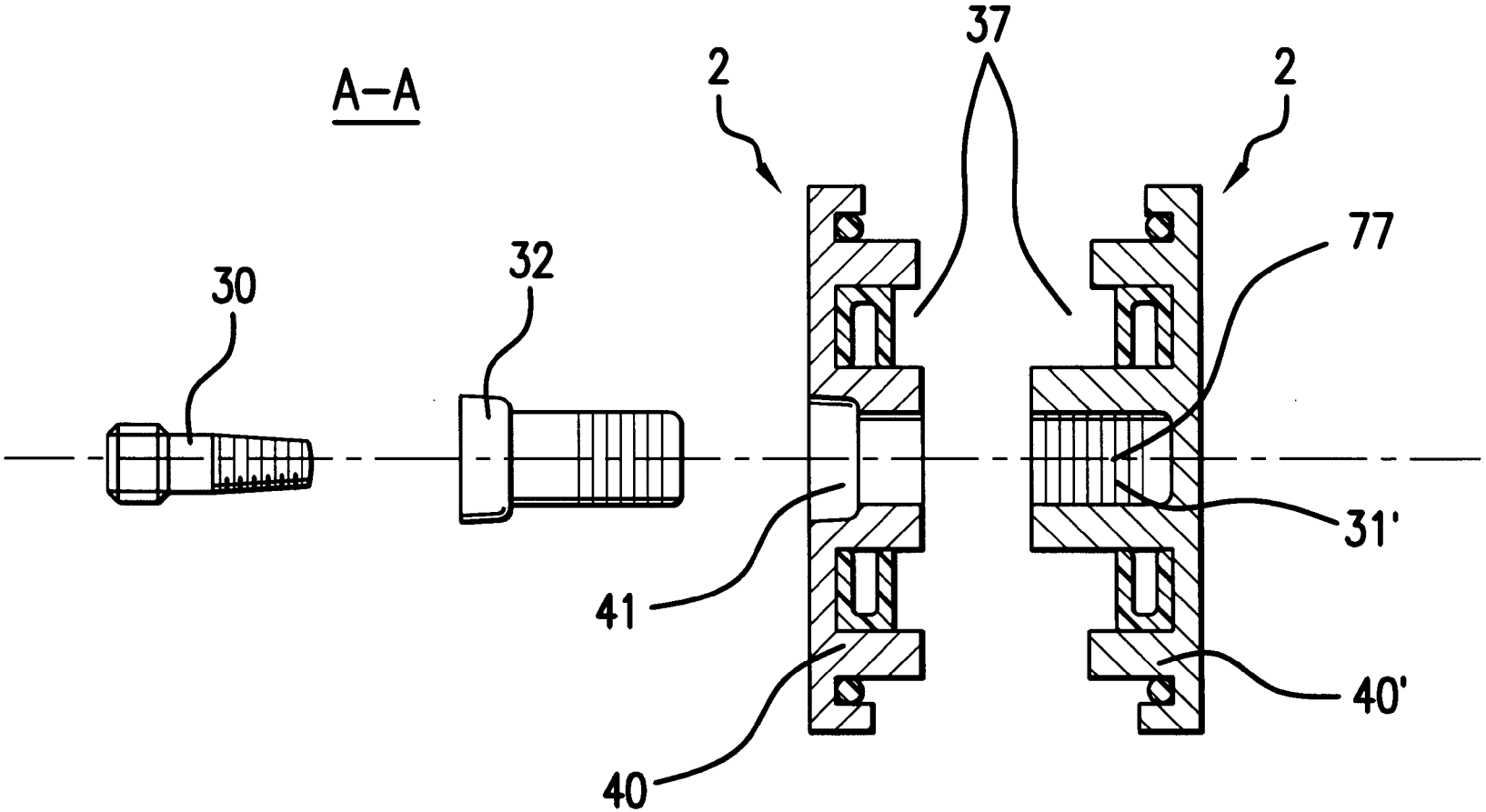
FIG. 15*a* shows the connecting strip of FIG. 15 in an exploded view.
Figure 16:
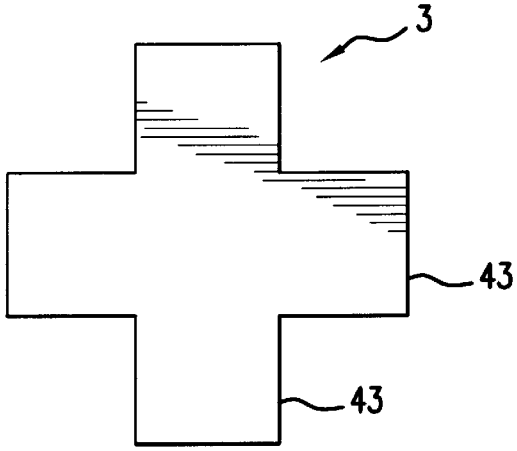
FIG. 16 shows the structural element constructed as a cross connection in a diagrammatic front view.
Figure 17:
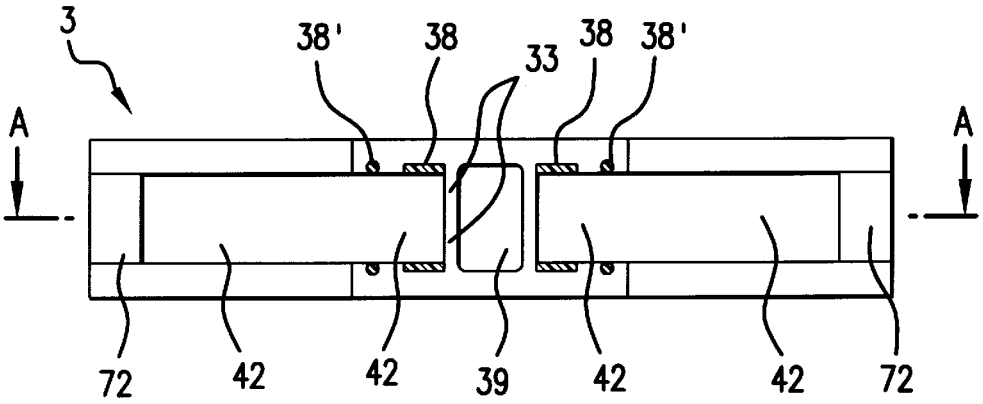
FIG. 17 shows the cross connector of FIG. 16 in plan view.
Figure 18:
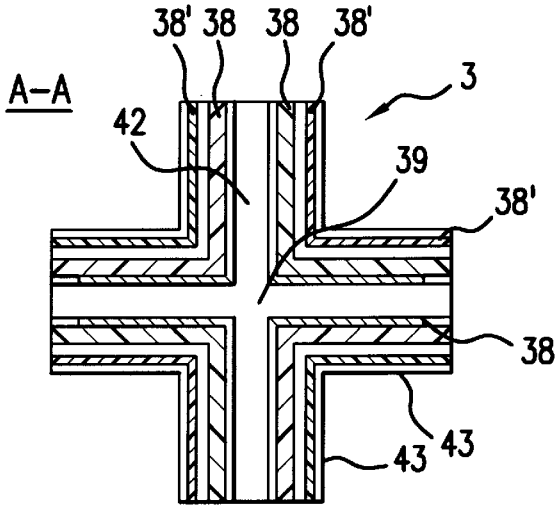
FIG. 18 shows the cross connector along the line A—A of FIG. 17.
Figure 19:
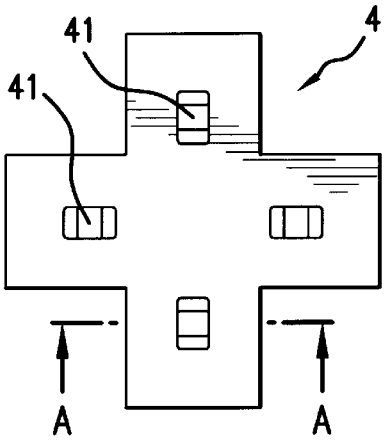
FIG. 19 shows a structural element, constructed as a cross connector, in a divided form.
Figure 20:
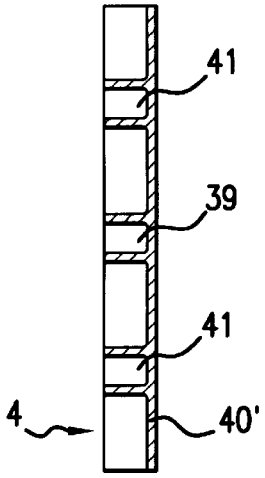
FIG. 20 shows the lower part of the cross connector of FIG. 19 in a side view.
Figure 21:
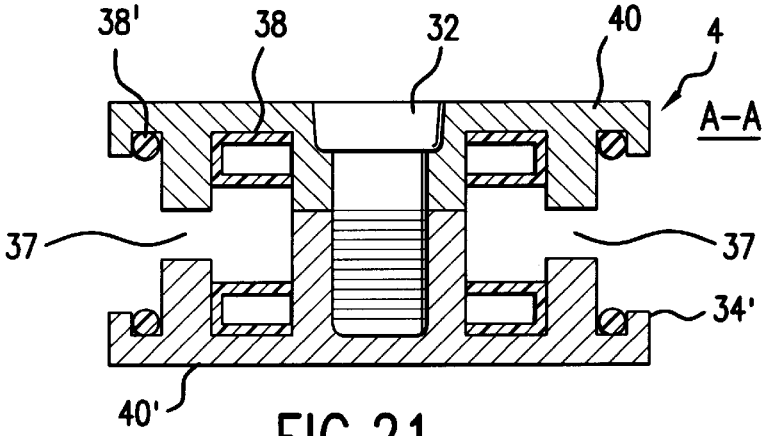
FIG. 21 shows the section A—A in FIG. 19.
Figure 22:
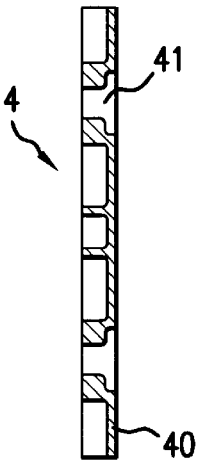
FIG. 22 shows the upper part of the cross connector of FIG. 19 in a side view along the section B—B of FIG. 23.
Figure 23:
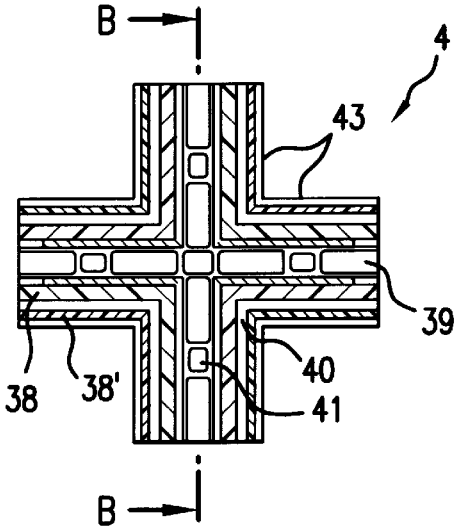
FIG. 23 shows the upper part of the cross connector of FIG. 19 in a rear view showing the sealing elements.
Figure 24:
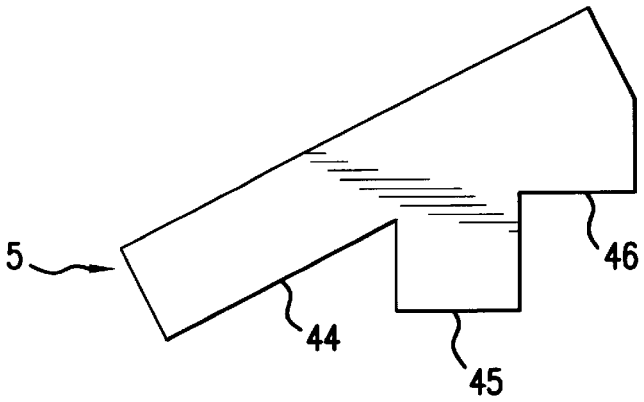
FIG. 24 shows a structural element, constructed as an inclined corner in a diagrammatic front view.

FIG. 15*a* is an exploded representation of FIG. 15. This type of representation permits the division of the connecting strip 2 by the guides 37 to be seen clearly. The correspondence 77 in the lower part 40' is characterized clearly by an internal denticulation 31', into which the straddling dowel 32 can be pushed by the dowel seat 41. FIG. 16 shows the diagrammatic front view of a connecting element, which is constructed as a cross connector 3. The cross connector 3 is constructed in the form of a cross with legs 43 of equal length. Guides 42 are provided in the legs 43, as can be seen from FIGS. 17 and 18. FIG. 17 shows the position and construction of the guides 42. Guides 42 are provided on each side of the legs and permit four basic elements a; b; c to be incorporated in a crossing region of the structural body. The guides 42 are constructed in such a shape, that the basic elements a; b; c are introduced up into the apex of the mutually crossing legs 43 and can be secured by means of clamps 33, which are pushed in. FIG. 18 shows the course of the guides 42 in the legs 43. It can be inferred precisely from the Figure that the guide 42 is directed through a hollow profile 39 in the interior space of the cross connector 3. At its outlet ends, the hollow profile 39 is provided with a recess 72, in which, during the installation of the basic elements a; b; c, the clamp 33 is incorporated. FIG. 19 shows the front view of a connecting element, which is shown as a cross connector 4 in a divided construction. The front view shows the position of the dowel seat 41, which is provided here in the center region of the legs 43 of the connector 4. Since the cross connector 4 is divided, FIGS. 20 and 22 show the side view of an upper part 40 and a lower part 40' of the connector 4 diagrammatically in section. In the profile, marked by the section, a hollow profile 39 is shown, to which the correspondences 77 of the dowel seats 41 are assigned symmetrically. FIG. 21 represents the cross sectional construction of a leg 43 of the connector 4 in the section A—A. The dowel seat 41 is provided with a straddling dowel 32, which has the same construction that has already been shown for other divided connecting elements. The two halves 40; 40' are held together by the denticulation. The cross-section shows the arrangement of the halves 40; 40' and the construction of the guide 37. The divided construction of the cross connector 4 enables the guide 37 to be constructed, so that it can be used for accommodating the T-shaped profiles 34 and for fixing the position of the basic elements a; b; c with their T-shaped profiles 34, without introducing holding elements such as clamps 33. FIG. 23 shows the upper part 40 of the connector 4 with its inner side. The position and incorporation of the sealing elements 38; 38' can be seen in the representation. The hollow profile 39 does not have a recess 72 here, since it is not necessary to use a clamp 33. FIG. 24 represents an inclined corner 5. The inclined corner 5 is a surface-overlapping and edge-overlapping connecting element 5, in order to connect body surfaces, inclined vertically and horizontally thereto, with one another in their position. FIG. 24 shows a front view of the corner 5, from the angle of the vertical wall. At an inclined plane 44, a vertical leg 45 adjoins and, at the right angles thereto, a horizontal leg 46.

Figure 25:
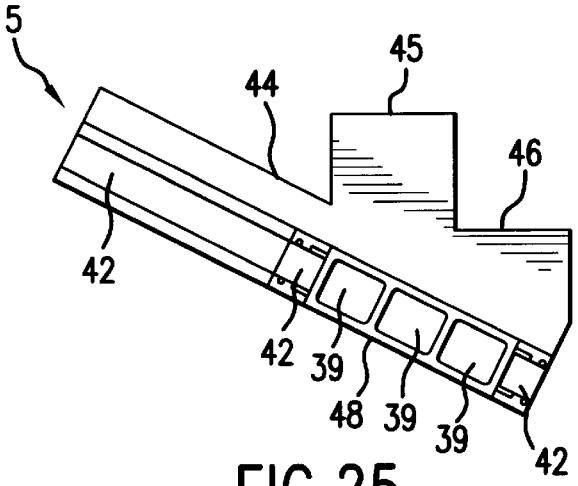
FIG. 25 shows the corner of FIG. 24, turned through 180° about a horizontal axis in a front view.
Figure 26:
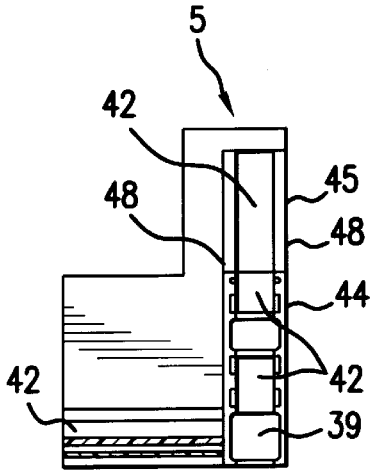
FIG. 26 shows the inclined corner of FIG. 25 in a side view.
Figure 27:
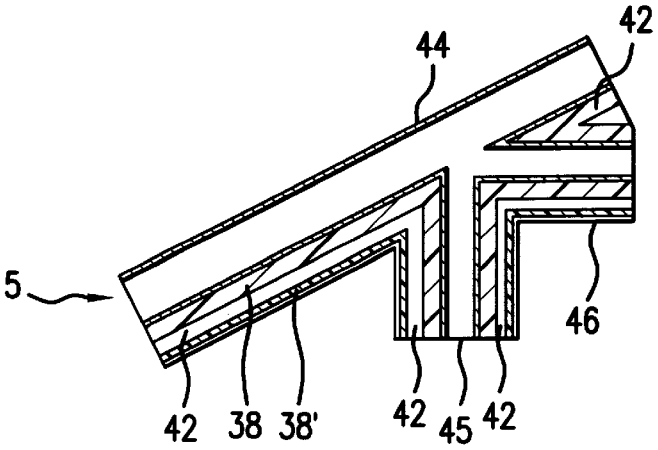
FIG. 27 shows the inclined corner of FIG. 24 in a longitudinal section showing the sealing element.

FIG. 25 shows the corner 5 in a position, turned through an angle of 180° from that shown in FIG. 24. In this position of FIG. 25, the inclined plane 44, like the vertical leg 45, points upward. Moreover, leg 48 with its guides 42 protrudes out of the plane of the drawing. In the normal position, leg 48 forms the seat for the basic elements a; b; c of the horizontally inclined body surface of the structural body. At the same time, the basic elements a; b; c are pushed into the guide 42 and secured by means of clamps 33. FIG. 26 shows a side view of the representation of FIG. 25. The leg 45 with its guides 42 can be seen clearly here. The guides 42 in the leg 48 permit at least one triangular basic element c to be accommodated. A hollow profile 39 adjoins the horizontally shown guide 42 in FIG. 26. The guide 42 is shown in FIG. 26 at the lower edge in the direction of the plane of the drawing. FIG. 27 shows a section through FIG. 24. It can be seen here that three basic elements a; b; c, of which at least two are triangular, can be incorporated in the vertical plane. The section of FIG. 27 shows the position of the guide 42 in the legs 45; 46 and of the inclined plane 44, as well as the sealing elements 38; 38', which are incorporated in it. It is surely unnecessary to explain the position of the sealing elements 38; 38' in the other legs and leg parts. FIGS. 25 and 26 show that two basic elements a; b can be incorporated and in the leg 48, which is provided for fastening the horizontally inclined body plane. It is evident to the expert that the basic elements a; b; c, which are to be incorporated in the corner 5, are pushed in and fixed in position by means of clamps 33.

Figure 28:
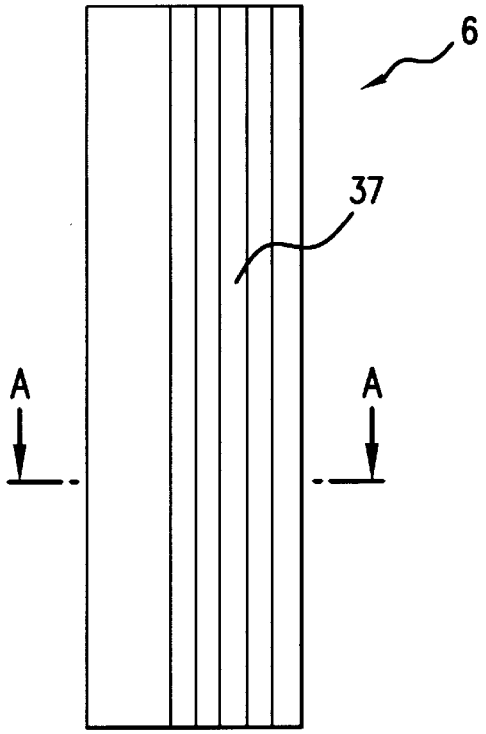
FIG. 28 shows a structural element constructed as an angular strip in a front view.
Figure 29:
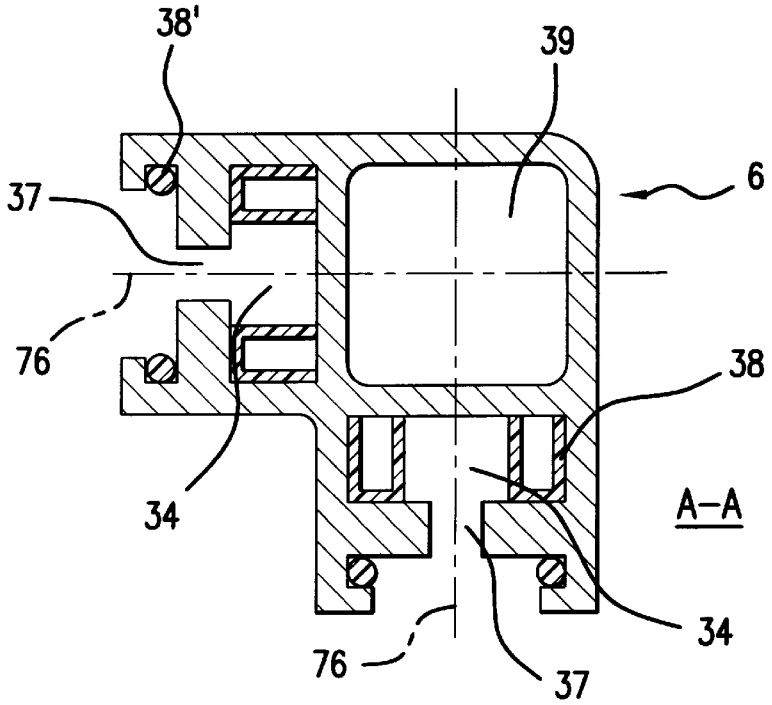
FIG. 29 shows an angular strip of FIG. 28 in cross section.
Figure 30:
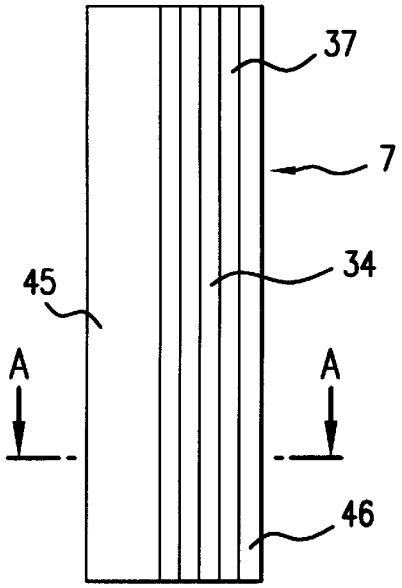
FIG. 30 shows a structural element constructed as a divided angular strip in a front view.
Figure 31:
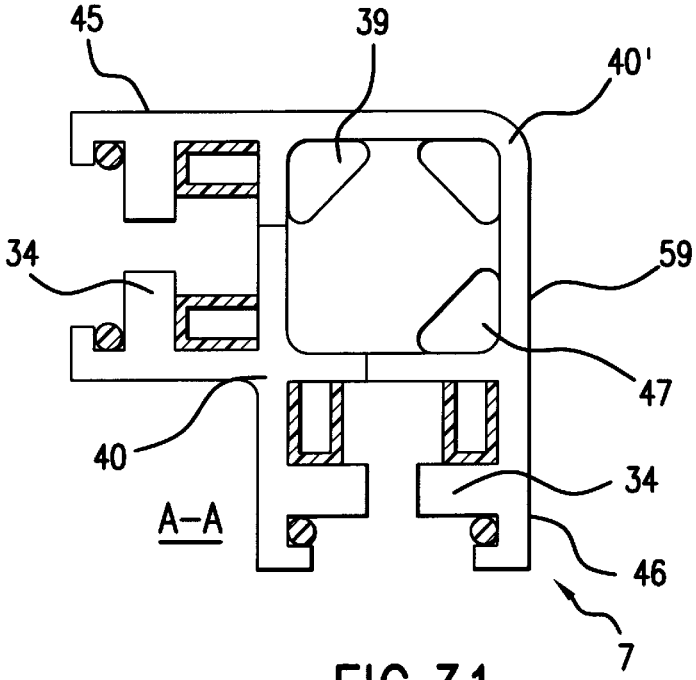
FIG. 31 shows the angular strip of FIG. 30 in a plan view.
Figure 32:
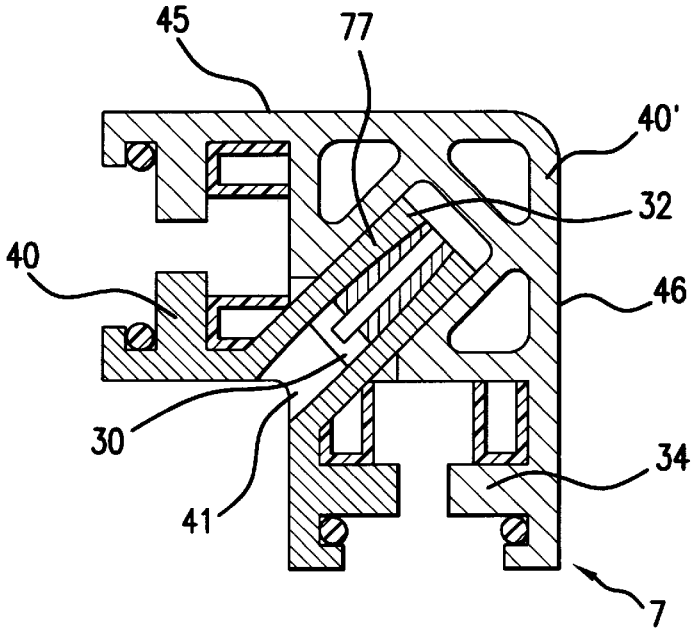
FIG. 32 shows the section A—A in FIG. 30, FIG. 32*a*: shows the section A—A of FIG. 30 in an exploded representation.
Figure 32A:
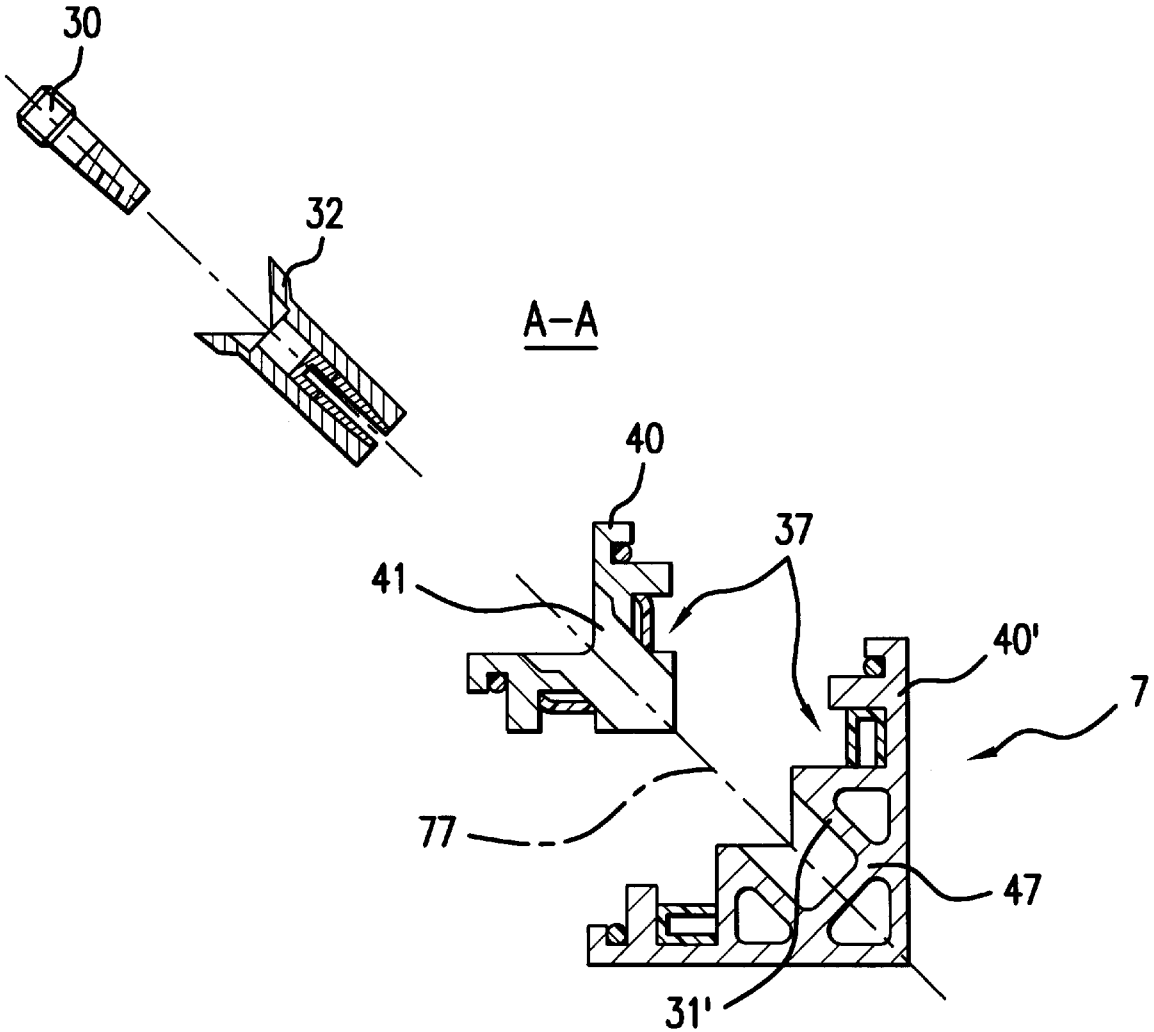

The incorporation of the corner 5 in the structural body has already been shown above in FIG. 1*a*. FIG. 28 shows a connecting element, which is constructed as an angular strip 6, in a front view. The view shows the dimensioning of the angular strip 6 and the position of the guide 37 with the course of the T-shaped profile 34 on a leg of the angular strip 6. FIG. 29 shows a plan view as section A—A of FIG. 28. Two guides 37 are disposed at an angle of 90° to one another on a hollow profile 39. The guides 37 are constructed for accommodating T-shaped profiles 34 of the basic elements a; b; c. Because of the construction of the guides 37, the angular element 6 can be pushed onto the T-shaped profiles 34 of the basic elements a; b; c and does not require additional fastening by means of a clamp 33. Sealing elements 38; 38' are incorporated in the two guides 37 in the manner already shown. A divided angular strip 7 of the same dimensions is shown in FIG. 30. The position of the guide 37 with the T-shaped profile 34 on one leg 46 shows the course of the guide 37. FIG. 31 shows a plan view of the angular strip 7. Lamellas 47 are disposed in the hollow profile 39 here for reinforcing the later accommodation of basic elements a; b; c and of dowels 32, as shown in FIG. 32. The plan views shows the dividing sites, at which the upper part 40 and the lower part 40' of the angle strip 7 have their connecting sites and are assembled. FIG. 32 shows the position of the straddling dowel 32 in the upper part 40 and the lower part 40' of the angular strip with the coordinated correspondences 77. For the final securing of the now assembled, dividable angular strips 7, an expansion screw 30 is already introduced here into the straddling dowel 32. Of course, two dowel seats 41 are disposed in the angular strip 7, as is shown in FIG. 32 by the course of the center lines. FIG. 32*a* represents an exploded diagram of FIG. 32. The exploded representation shows that the division of the strip into an upper part 40 and a lower part 40' passes through the centers of the guide. For assembling the two parts 40; 40', a dowel seat 41 is provided in the region of the apex of the angular upper part 40 for the introduction of a straddling dowel 32, which has its correspondence in the opposite correspondence with its inner denticulation 31' in the lower part 40'. It is clearly evident to the expert that the two parts 40; 40' are directed counter to the T-shaped profiles 34 of the basic elements a; b; c and fixed and locked there. Because it can be divided, the angular strip can be inserted in already pre-installed structural bodies, that is, it does not have to be pushed onto the T-shaped profiles 34, but can, because of its divided construction, be applied on both sides of the T-shaped profile 34, locked by the straddling dowel 32 and finally fixed in the installed state by the expansion screw 30. FIG. 32*a* once again shows the position of the lamellas 47, now at the intersection of the section A—A in the region of the dowel seat. The construction ensures that the connecting element 7 has a high stability and a high resistance to twisting.

Figure 33:
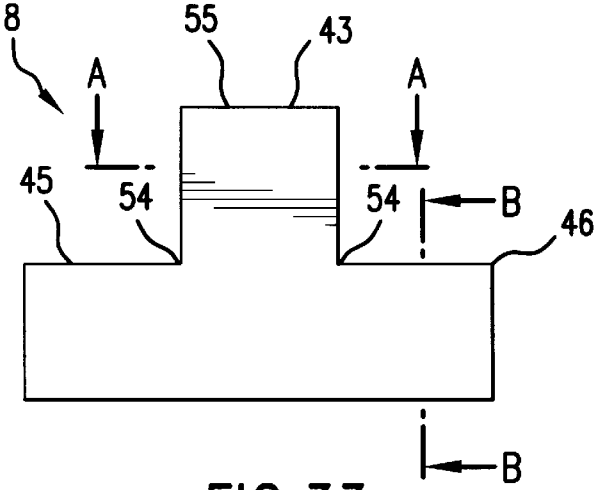
FIG. 33 shows the structural element constructed as a closing corner in a front view.

FIG. 33 shows a connecting element, which is constructed as a closing corner 8, in a front view. The front view shows the contours of the closing corner 8 in the form of an inverted T with the legs 43; 45; 46. The neck of the leg of the inverted T protrudes upwards into this view and the two legs 45; 46 protrude in diametrically opposite directions.

Figure 34:
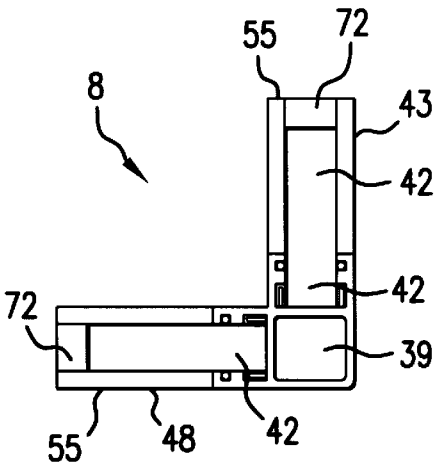
FIG. 34 shows the corner of FIG. 33 in a side view.
Figure 35:
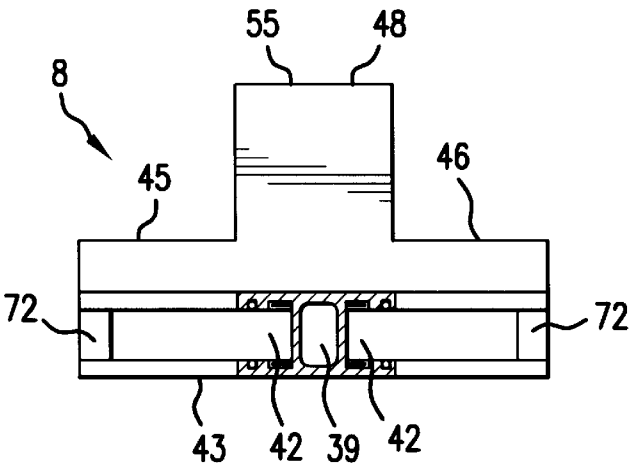
FIG. 35 shows the section A—A in FIG. 33.
Figure 36:
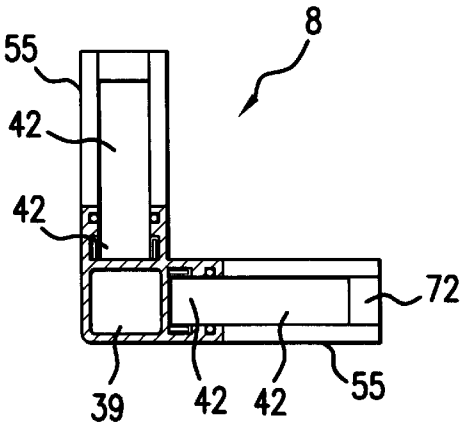
FIG. 36 shows the section B—B of FIG. 33.
Figure 37:
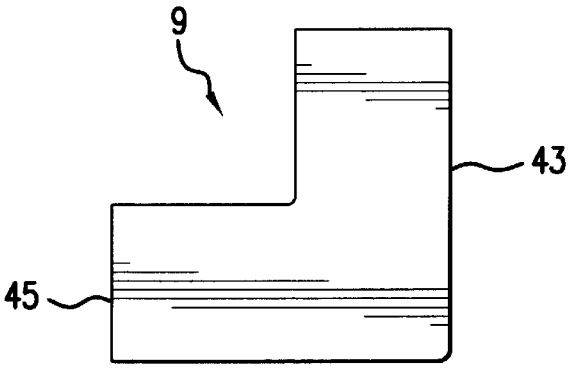
FIG. 37 shows a structural element constructed as a ceiling corner in a front view.
Figure 38:
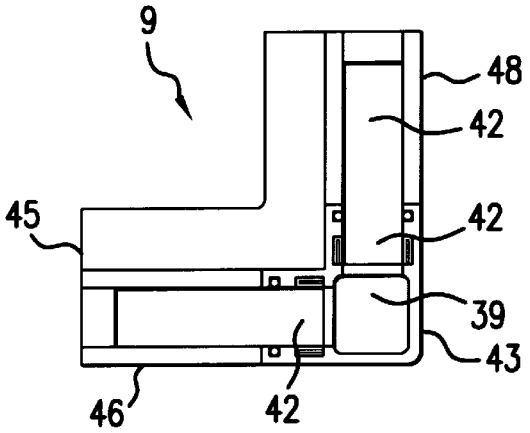
FIG. 38 shows the corner of FIG. 37 in a plan view.

FIG. 34 shows a side view of the corner 8. It can be inferred from the view that, at right angles to the course of the leg 43 and connected with the legs 45; 46, a further leg 48 is attached which, as can be inferred from the following FIG. 34, has the same construction as the legs 45; 46. FIG. 35 shows the course of the section A—A of FIG. 33. It can be seen in plan view that, at the right angles to the hollow profile 39, a further hollow profile 39 passes through the leg 43; 48 in order, as will be explained later, to ensure the insertion of holding clamps 33. For this purpose, recesses 72 are incorporated in the necks 55 of the legs. The position of the guides 42 can be inferred from the representations of FIGS. 34, 35, 36, FIG. 36 showing the section B—B of FIG. 33. Section B—B illustrates that the guides 42 are configured identically to those of the representation in FIG. 34 and in the similar view 35 in the leg 43, which is horizontal here. The constructions of the guides 42 are configured, so that the basic elements a; b; c, which are to be connected, are pushed into the guides and fixed in position with clamps 33. The possibility is opened up to the viewer that in each case four basic elements, which are located in pairs at an angle of 90° to one another, can be connected in pairs to one another by means of the closing corner 8. It is possible here to connect the basic elements a; b; c of vertical and horizontal flat formations statically positively. A connecting element, constructed as a ceiling corner 9, is shown in a diagrammatic front view in FIG. 37 and shows the legs 43; 45 of the ceiling corner 9, which are directed at an angle of 90° to one another. FIG. 38 shows the same object as FIG. 37 in a plan view. The legs 43; 45 are shown here with their guides 42, which are at right angles to one another. The course of legs 46; 48 appears here as a side view and becomes clearly visible after the corner 9 is rotated through 180° about a horizontal axis. It can be seen that the legs 46; 48 have the same position and construction of the guides 42, as do the legs 43; 45; however, in each case, they stand horizontally and vertically at an angle of 90° to one another. The ceiling corner 9 permits the insertion of three elements and connects a basic element a; b; c at an angle thereto with two angular elements a; b; c of optional construction. The connection is suitable only for the edges of the basic element a; b; c, which are at an angle of 90° to another. In this connection, it is arbitrary whether one element a; b; c is horizontal and two vertical thereto or whether the position is reversed. The guides 42 permit an effortless insertion of the basic elements a; b; c and the securing of them by clamp 33.

Figure 39:
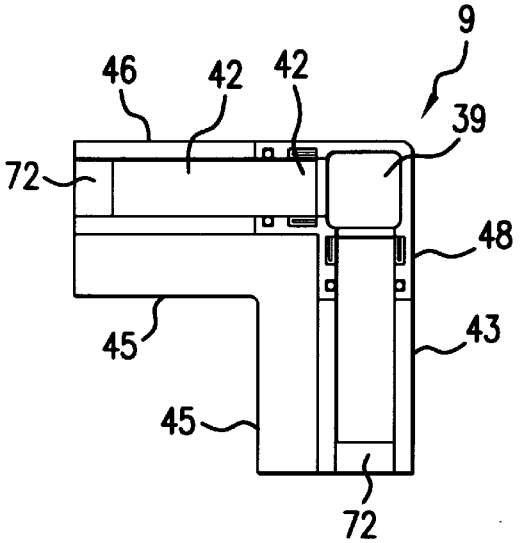
FIG. 39 shows the corner of FIG. 38, turned through 180° about a horizontal axis.
Figure 40:
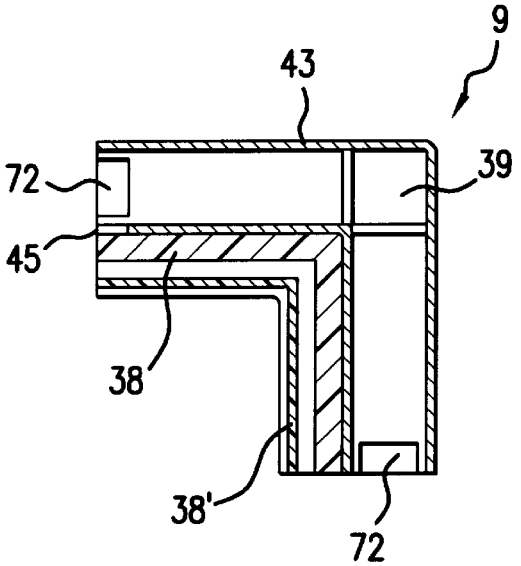
FIG. 40 shows the corner of FIG. 39 in a sectional representation with inserted sealing elements.
Figure 41:
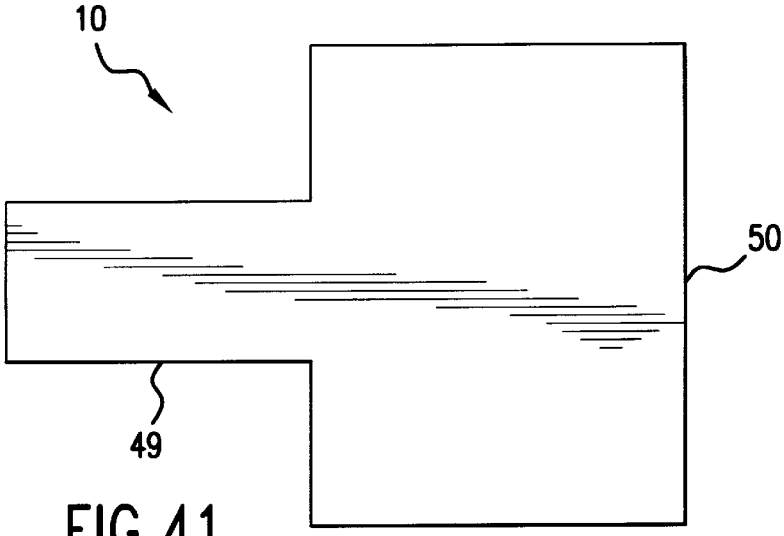
FIG. 41 shows the structural element, constructed as an asymmetrical cross connector in a front view.
Figure 42:
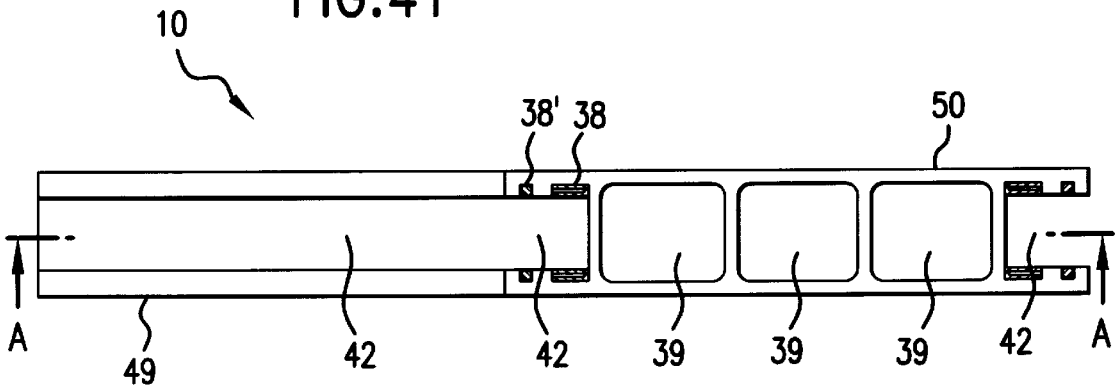
FIG. 42 shows the cross connector of FIG. 41 in a plan view.
Figure 43:
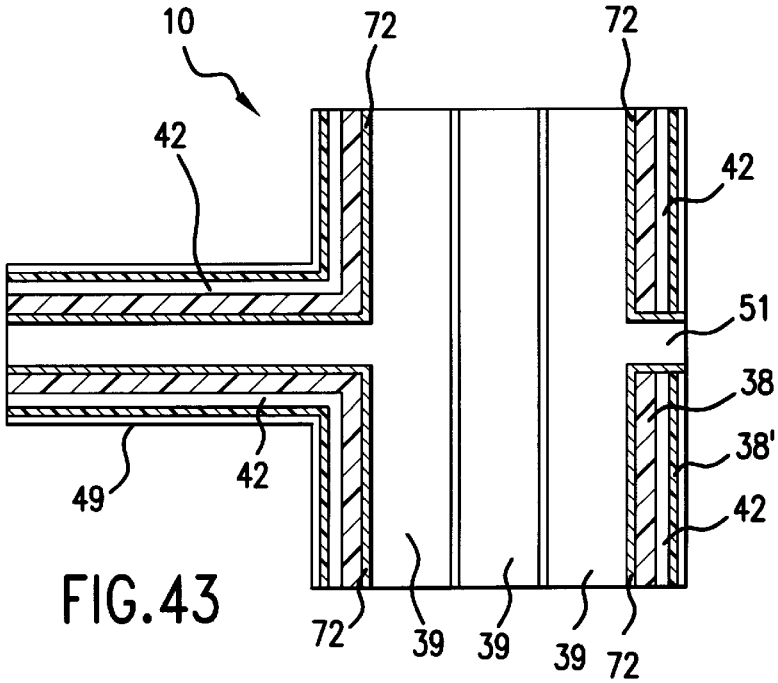
FIG. 43 shows the section A—A in FIG. 40.
Figure 44:
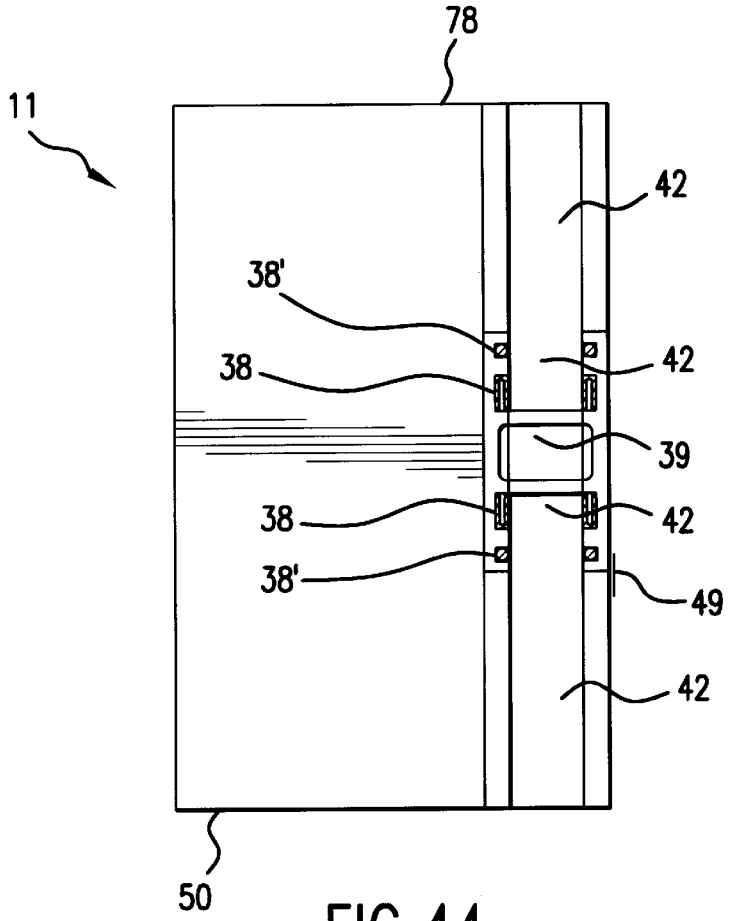
FIG. 44 shows a structural element, constructed as bent-over cross connector in a front view.
Figure 45:
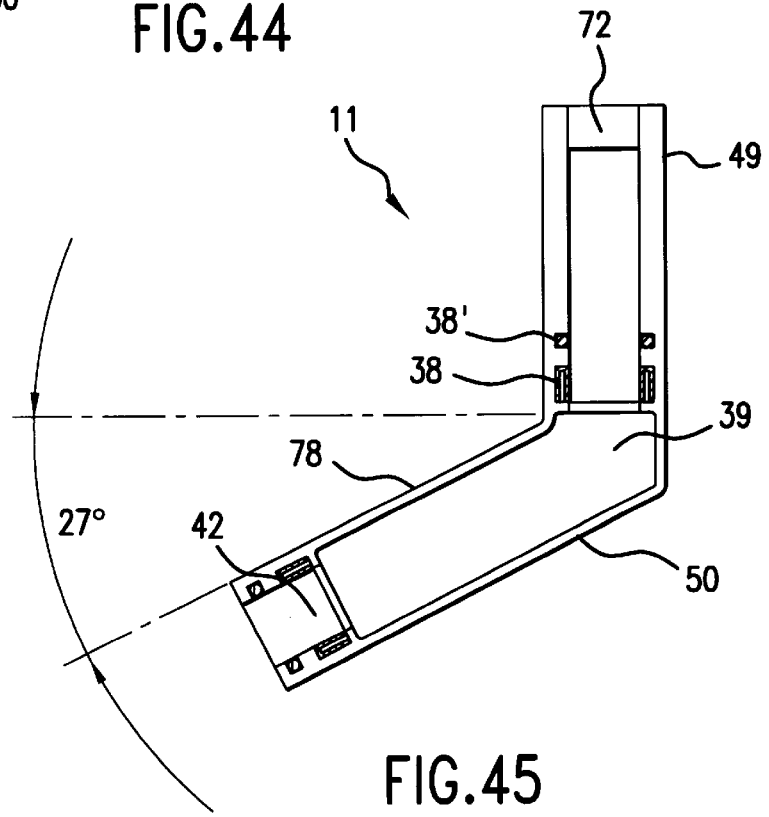
FIG. 45 shows the cross connector of FIG. 44 in a plan view.

In a manner understandable to the expert, FIG. 40 shows a section through the element 9 in the position of FIG. 39 through the legs 43; 45. The recess 72 for accommodating the clamps 33 is shown here, as is the position of the sealing elements 38; 38'. A cross connector 10, as connecting element, is shown in a front view of FIG. 41. The view shows the contours of the connecting element. The contours form a T-shape with a narrow cross member 49 and a thickened holding body 50, which is disposed at an angle of 90° centrally to the cross member 49. FIG. 42 shows the plan view of the cross connector 10. Leg 49 shows guides 42, which are seen here in plan view and approach one another at an angle of 90°. Further guides 42 are provided at the continuous side of the holding body 50 and are separated by a doubly acting stop 51. The extended construction of the holding body 50 of the connector 10 is attained by the incorporation of three hollow profiles, which are provided with recesses 72 at their inner sides. Likewise, the hollow profile 39 of the cross member 49, has a recess 72, in order to ensure, after the introduction of the respectively assigned basic element a; b; c, the incorporation of clamps 33 for fixing the position of the basic elements a; b; c. The cross connector 10 permits the insertion of four basic elements a; b; c which, directed in one plane, form a surface. FIG. 43 shows the course of section A—A of FIG. 42. The position of the guides 42 for accommodating the four basic elements a; b; c, can be seen clearly here, as can the insertion of the sealing elements 38; 38' in the guide 42. The cross connector 10, in this selected configuration, is provided for accommodating basic elements a; b; c which, in each case, assigned to their side, can have different configurations and edge formations. The guides 42 are constructed for pushing the basic elements a; b; c into the guides 42. All four basic elements a; b; c are held by clamps 33, which are incorporated into the recess 72 on the side of the hollow profiles 39. FIG. 44 shows a modification of the straight cross connector 10. The cross connector 11 is bent there in the region of the transition of the holding body 50, which is constructed here as a cross member 49. In this case, the angle of bend, measured from the horizontal plane, is 27°. The position of the cross connector 11 during use is arbitrary. The arrangement of the guide 42 is similar to the arrangements of the guides 42 on the cross connector 10. By means of this cross connector 10, it is possible to arrange the four basic elements a; b; c relative to one another, the assignment of the planes, formed by the basic elements a; b; c, being formed in one by the leg position, cross member 49 and holding body 50 of the cross connector 11. It is now possible to produce perpendicular or inclined surfaces, which are constructed in conjunction with the basic elements a; b; c and are arranged at an angle of 27° to one another. FIG. 45 shows this constellation. The position of the legs 49; 50 relative to one another is shown here, as are the guides 42, which necessarily result therefrom. The construction of the peripheral connecting elements, such as hollow profiles 39 and recesses 72, are shown similar to the arrangements shown for the straight cross connector 10.

Figure 47:
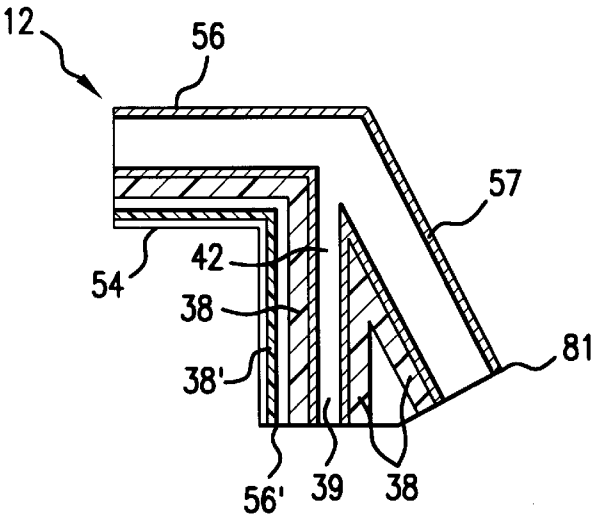
FIG. 47 shows the ceiling corner of FIG. 46 in a longitudinal section, with representation of the inserted sealing elements.
Figure 46:
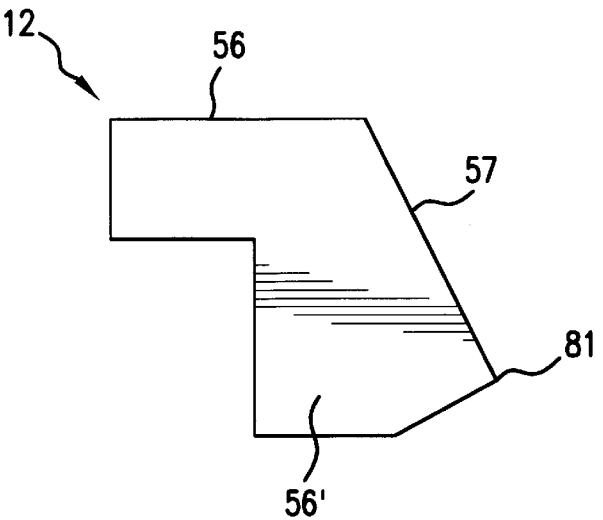
FIG. 46 shows a structural element constructed as a ceiling corner in a diagrammatic front view.
Figure 48:
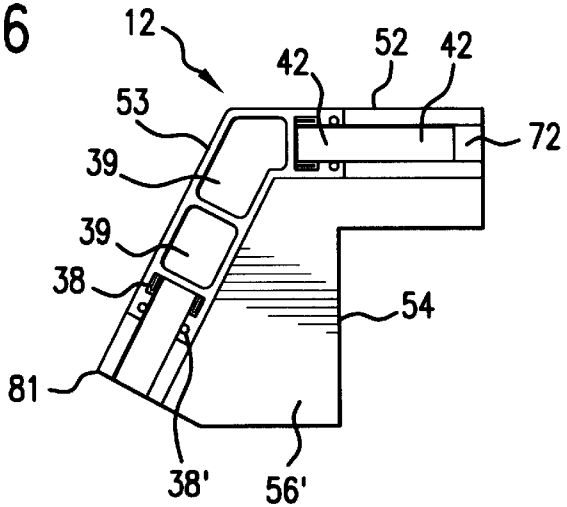
FIG. 48 shows the corner of FIG. 46, rotated through 180° about a vertical axis, in a front view.
Figure 49:
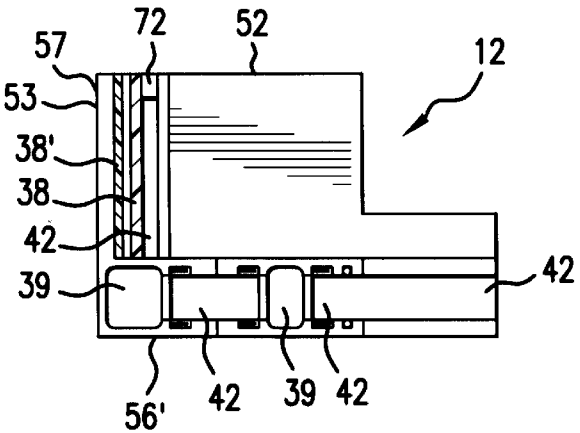
FIG. 49 shows the corner of FIG. 48 in a view from below.
Figure 50:
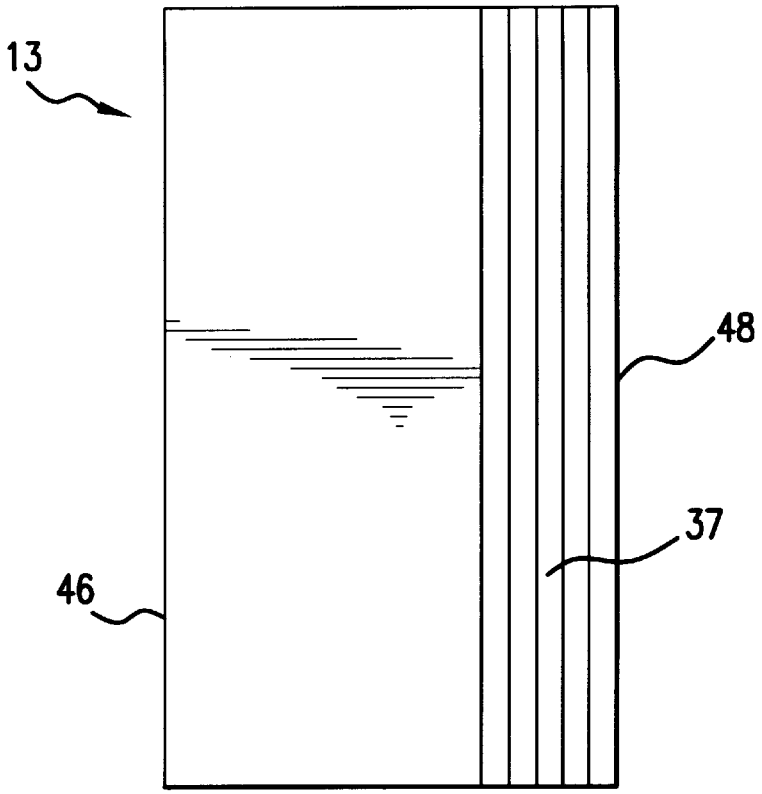
FIG. 50 shows a structural element, constructed as an angular strip in a front view.
Figure 51:
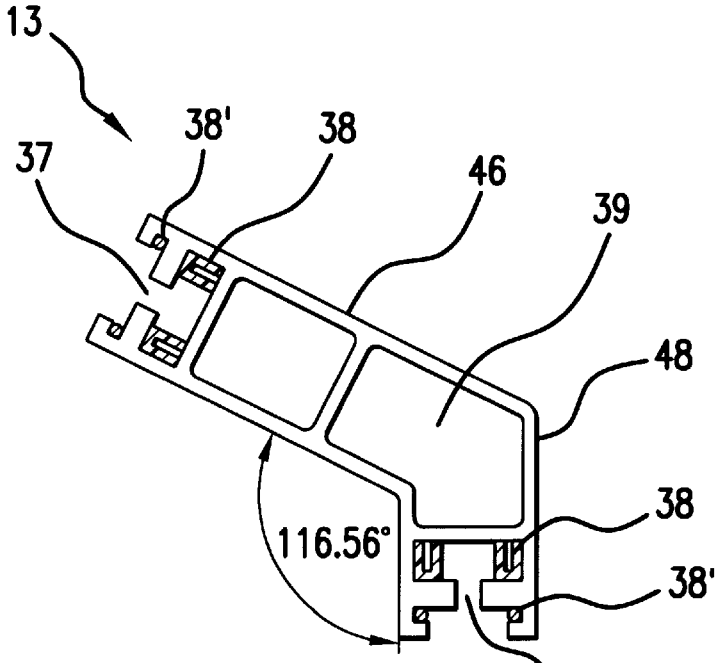
FIG. 51 shows the angular strip of FIG. 50 in a plan view.
Figure 52:
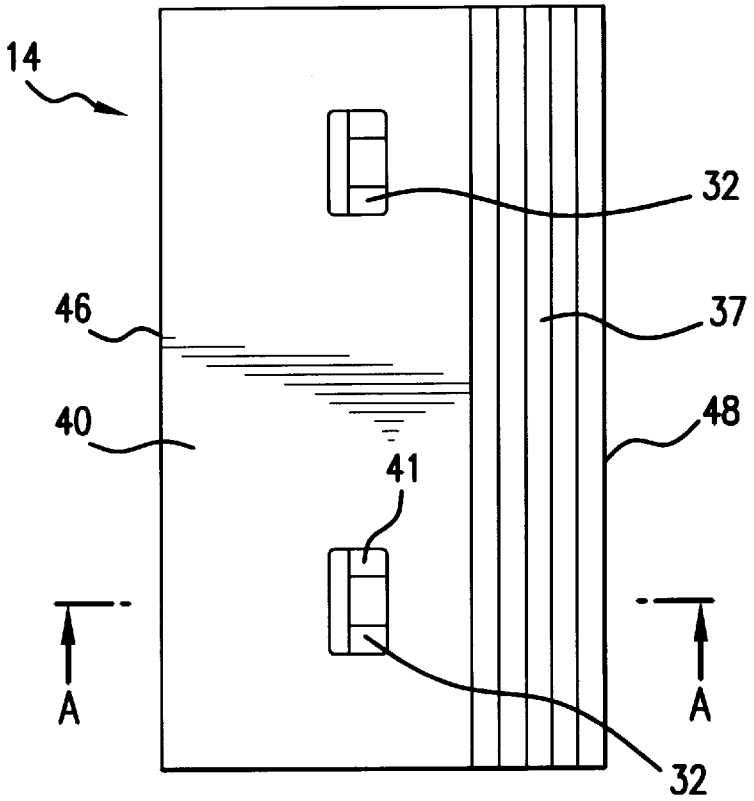
FIG. 52 shows the angular strip of FIG. 50 as a divided construction, in a front view.
Figure 53:
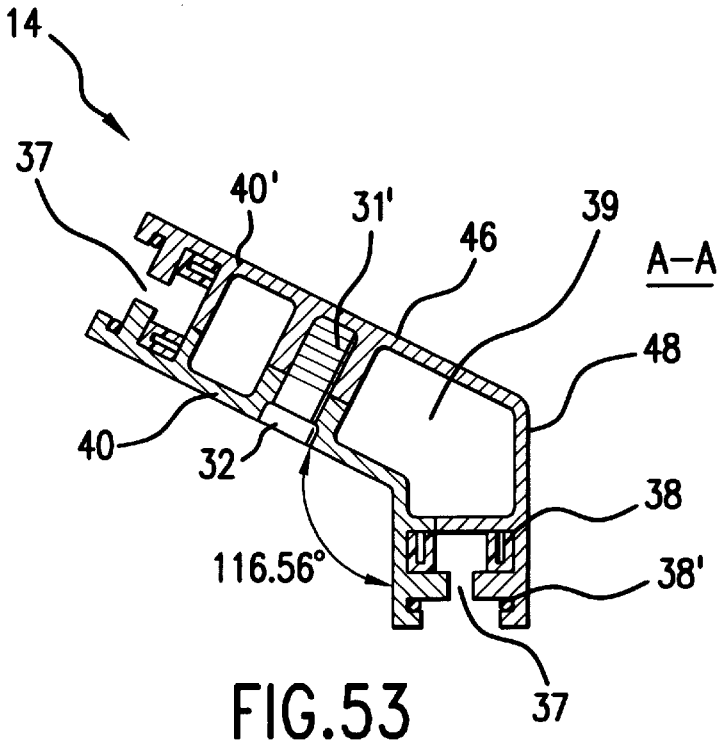
FIG. 53 shows the section A—A of FIG. 52.
Figure 53A:
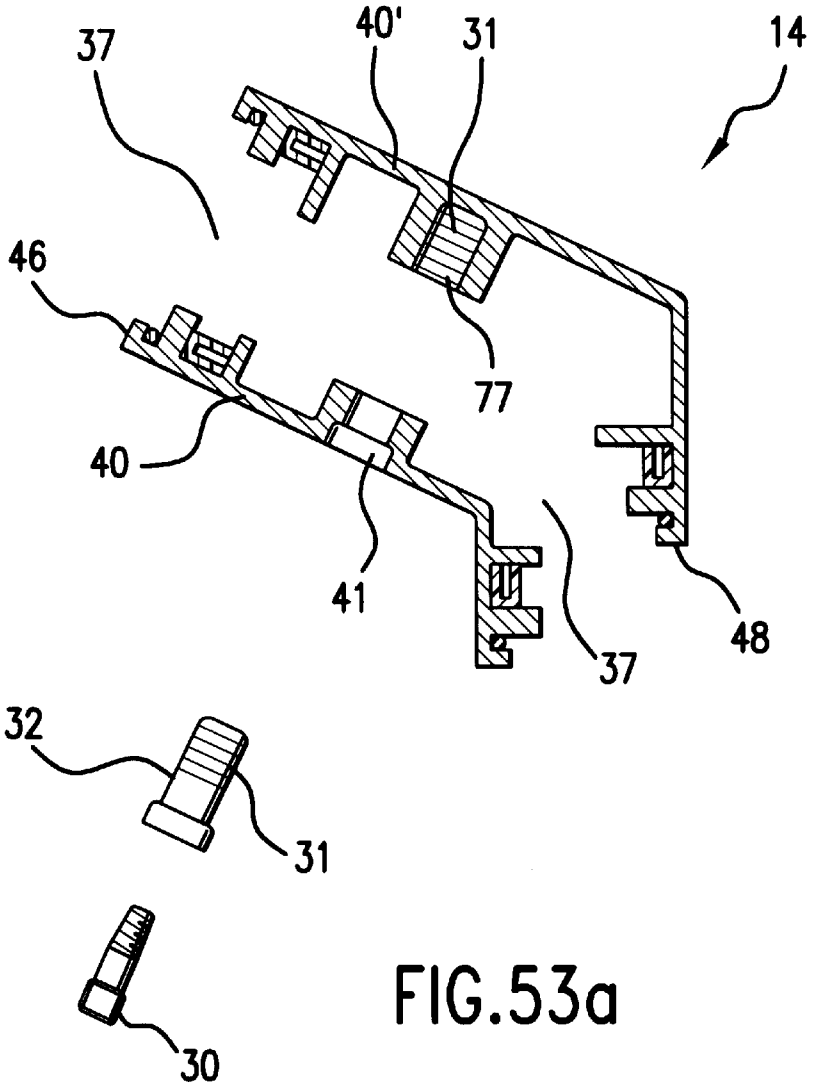
FIG. 53*a* shows the section A—A of FIG. 52 in an exploded representation.

To complete the kit, a ceiling corner is shown in a diagrammatic front view in FIG. 46. The diagrammatic view of FIG. 46 has been chosen in order to emphasize the basic function of the element in the kit already pictorially. The corner permits basic elements a; b; c to be accommodated in the upper corner region of a structural body, which has an inclined area, a horizontal area of and an area directed at an angle of 90° to the latter. FIG. 47 shows a perpendicular section through the body in the position of FIG. 46 for the basic elements a; b; c, which are to be incorporated vertically. The inclined course of leg 57 can be seen here. This sectional representation of FIG. 47 shows that two basic elements a or b and c are incorporated here and that the slope of the leg 57 is developed at the leg 56' by the basic element c. The position of the sealing elements 38; 38' of the guides 42 can be seen clearly in the Figure. FIG. 48 shows a representation of the element 12, rotated through an angle of 180° about a vertical axis. For orientation, the outer point of the contour is provided with the reference number 81 and shows its position opposite to that of FIG. 46. FIG. 48 shows that, opposite the vertically directed leg 56'; 57, other legs 52; 53 are disposed, leg 52 and leg 53 basically being at right angles to leg 57 and leg 53 being inclined outward at an angle of 27° to the vertical. The course of the guide 42 in the leg 53 as well as in the leg 52 leaves open the possibility of disposing three basic elements a; b; c in the ceiling corner 12 in the vertical plane, the basic element a; b; c in the leg 52; 53 being directed at a right angle to the basic elements a; b; c in the leg 57. The guides 42 in the leg 53 in FIG. 49, extending in the plane of the slab, enable basic elements a; b; c to be incorporated in the ceiling corner 12. FIG. 49 shows the ceiling corner 12, rotated through an angle of 90° about a horizontal axis relative to that of FIG. 48. As already explained, the leg 56 now lies horizontally and permits a view into the leg 57 with its guides 42. It can be seen clearly that guides 42, disposed next to the hollow profiles 39, the tip of a triangular basic element c can be incorporated, while the guide 42, aside from a further hollow profile 39, permits the incorporation of a rectangular basic element a; b. To the edge of the point 81, now extending with the plane of the slab, is assigned parallel on the leg 56' of the guide 42, the position of which in the space, as shown in FIG. 48, permits a distorted reproduction. Recess 72 are provided for the clamps 33, which connect the basic elements a; b; c, pushed into the guides 42, with the ceiling corner 12. The position of the sealing elements can be inferred appropriately from all Figures. A connecting element, constructed as an angular strip 13, is shown in a front view in FIG. 50. The angular strip 13 has two legs 46; 48 of unequal length, which are inclined at an angle of 117° to one another. The angular strip 13 has the same length as the other connecting elements. The guide 37, into which the T-shaped profile 34 of the basic elements a; b; c is pushed, is drawn on the view of FIG. 50. FIG. 51 shows a plan view of the angular strip. The inclination of the legs 46; 48 at an angle of 117° to one another, which was already shown in the previous Figure, can be recognized clearly here. The guide 37 on the leg 46 can be seen here. As in the case of the leg 48, it permits a T-shaped inner profile 34' of the basic elements a; b; c to be pushed in. Due to the mutually inclined legs, it is possible to dispose two basic elements a; b; c inclined at an angle of 117° to one another and, with that, achieve a bending of the surface plane of a structural body. Of course, as in the case of all other connecting elements, a hollow profile 39 is incorporated here, in order to achieve a reduction in weight. Sealing elements 38; 38' complete the construction of the guide 37. In FIG. 52, the side view shows an angular strip 14, which basically has the same construction and inclination of the legs as the angular strip 13. In order to improve the installation of the element 14 in the structural member, the angular strip is constructed in a divided form. The sectional representation A—A passes through the straddling dowel 32 in the dowel seat 41, which is drawn on the leg 46 of the strip 14. The recesses for the straddling dowel 32 are incorporated in the upper part 40 of the leg 46. FIG. 53 shows the course of the section A—A through the already mentioned straddling dowel 52. The two parts of the angle 14, that is, the upper part 40 and the lower part 40', can be recognized in this representation. In the upper part 40, the straddling dowel 32 is passed through a throughhole and, with its denticulation, reaches the lower part 40', in which it connects with the inner denticulation 31' of the lower part 40' with its correspondence 77 and holds the upper and lower parts of the connecting strip 14 together, fixing their position. After the installation and the aligning of the surfaces or of the structural member are completed, the final locking takes place by the introduction of expansion screws 30 in the straddling dowel 32. Due to their construction, the guides 37 in the legs 46; 48 embrace the T-shaped profiles 34 of the basic elements a; b; c, brought into conjunction with them, and lock them positively. The angular strip 14 has the advantage that, in the course of the installation, it can be put in place on the structural member intermittently due to the construction as an upper part 40 and a lower part 40' and, after the two parts 40; 40' are connected, can assume the full function of a connecting element. Here also, as in the case of the integral angular strip 13, it is possible to produce bent planes of a structural member. FIG. 53*a* shows the angular strip of FIG. 53 in an exploded representation. The division of the elements into an upper part and a lower part takes place basically through the guide 37. The dowel seat 41 in the upper part 40 has its contacting surface in the correspondence 77 of the lower part 40'. Like all other divided connecting elements, this connecting element has in its lower part a correspondence 77, which interacts with the dowel seat 41 in the upper part 40 and ensures the pushing in of a straddling dowel 32 and the securing of both parts in their position.

Figure 54:
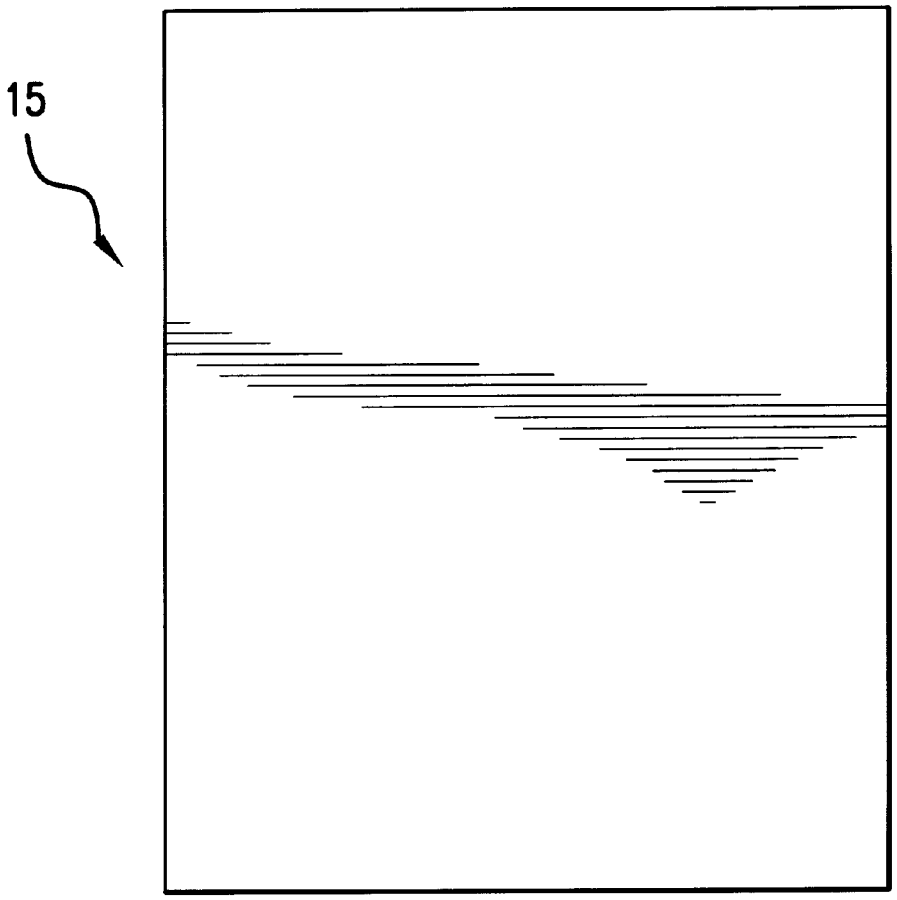
FIG. 54 shows a structural element, constructed as a connecting strip, in a front view.
Figure 55:
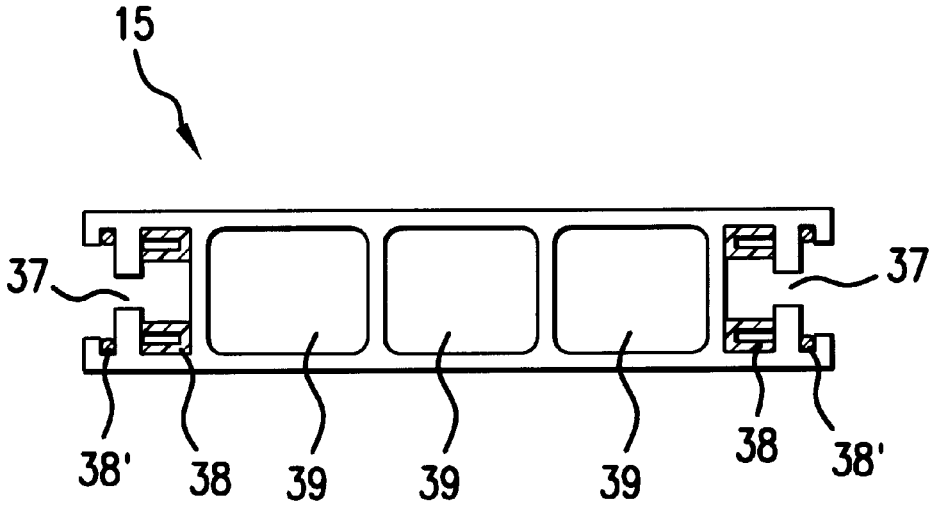
FIG. 55 shows the connecting strip of FIG. 54 in a side view.
Figure 56:
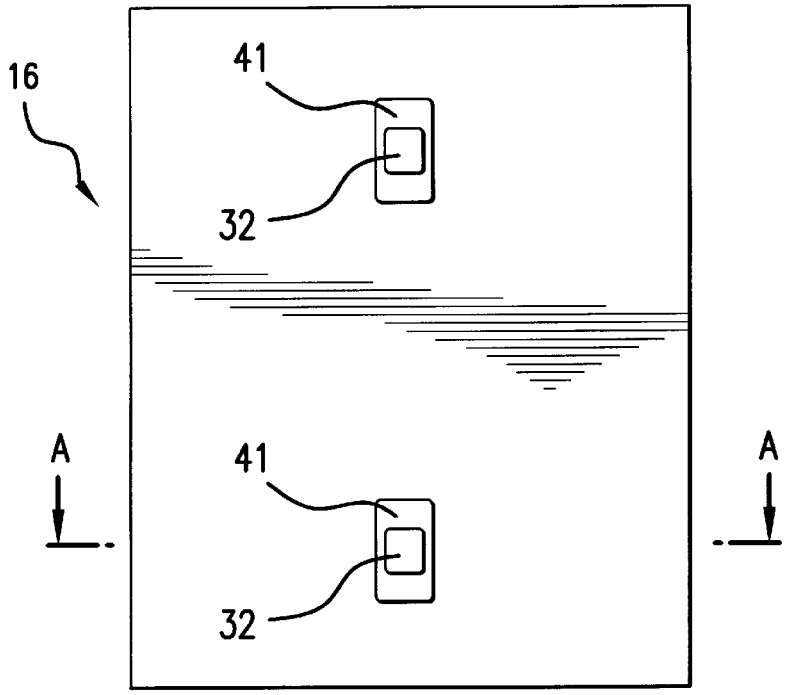
FIG. 56 shows the angular strip of FIG. 54 in a divided construction in a front view.
Figure 57:
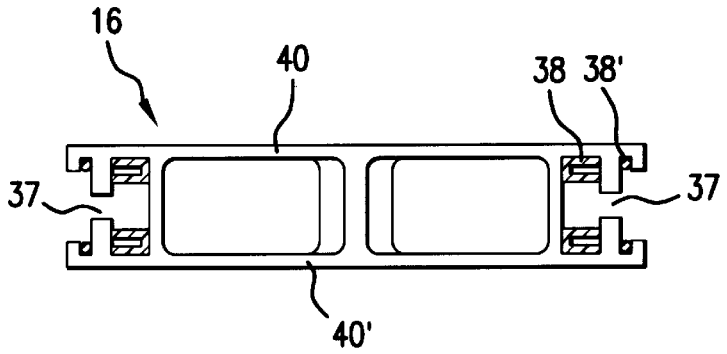
FIG. 57 shows the connecting strip of FIG. 56 in plan view.
Figure 58:
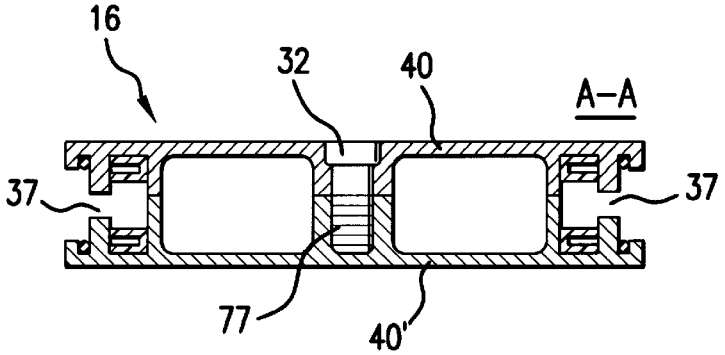
FIG. 58 shows the section A—A of FIG. 56.
Figure 58A:
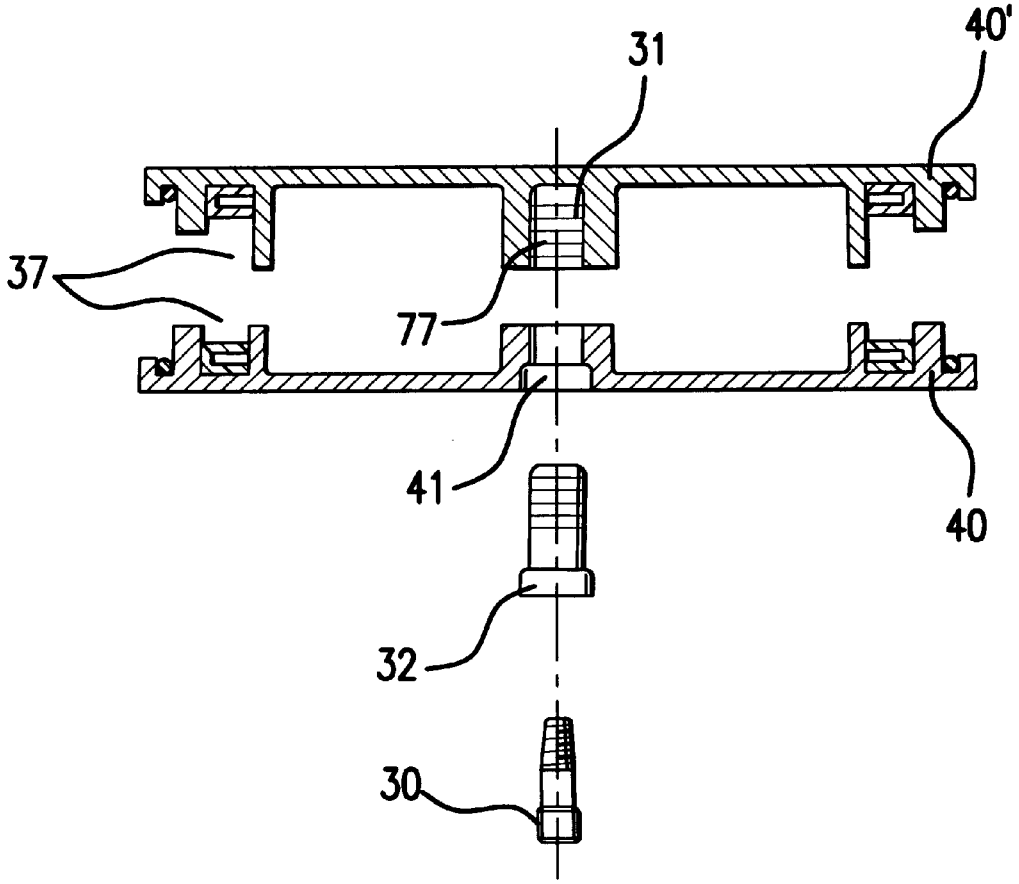
FIG. 58*a* shows the connection strip of FIG. 57 in an exploded representation.
Figure 59:
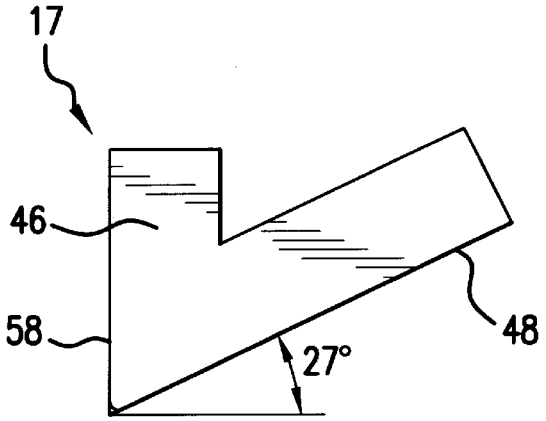
FIG. 59 shows a structural element, constructed as a floor corner in a front view.
Figure 60:
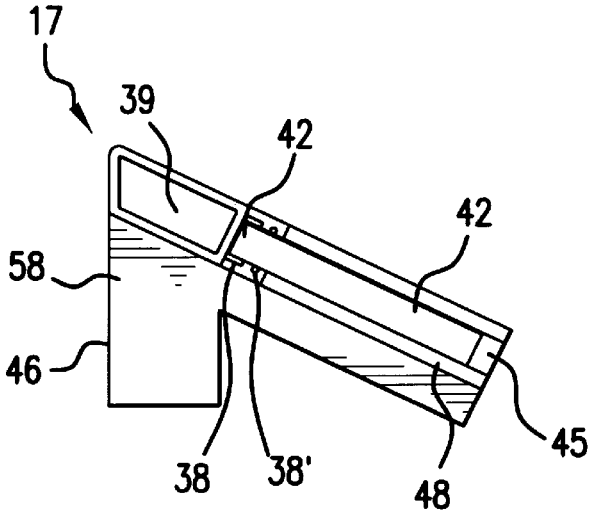
FIG. 60 shows the floor corner of FIG. 59, rotated through 180° about a vertical axis, in a front view.
Figure 61:
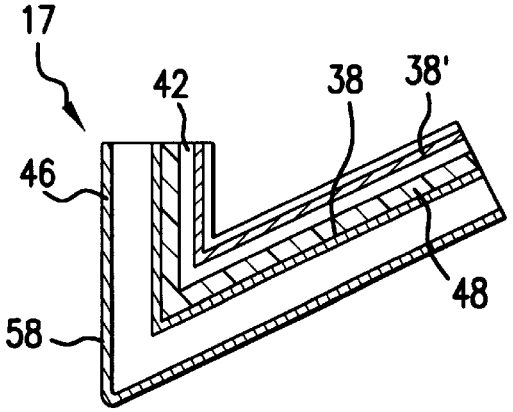
FIG. 61 shows the corner of FIG. 59 in a longitudinal section, the sealing elements being shown.
Figure 63:
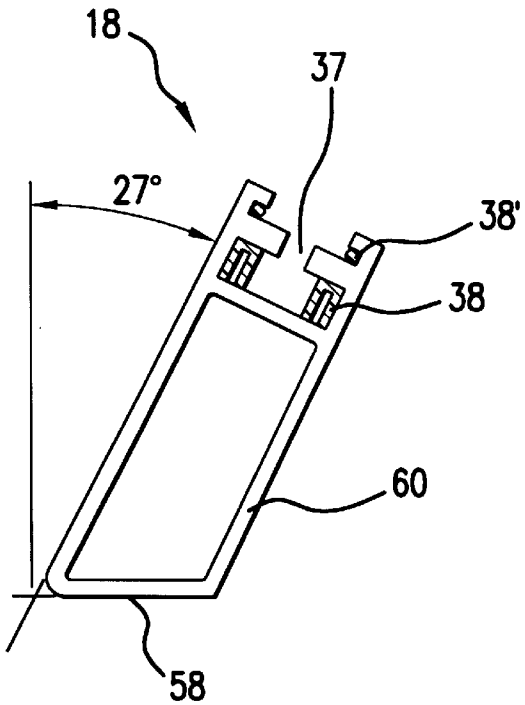
FIG. 63 shows the floor strip of FIG. 62, in a side view.
Figure 62:
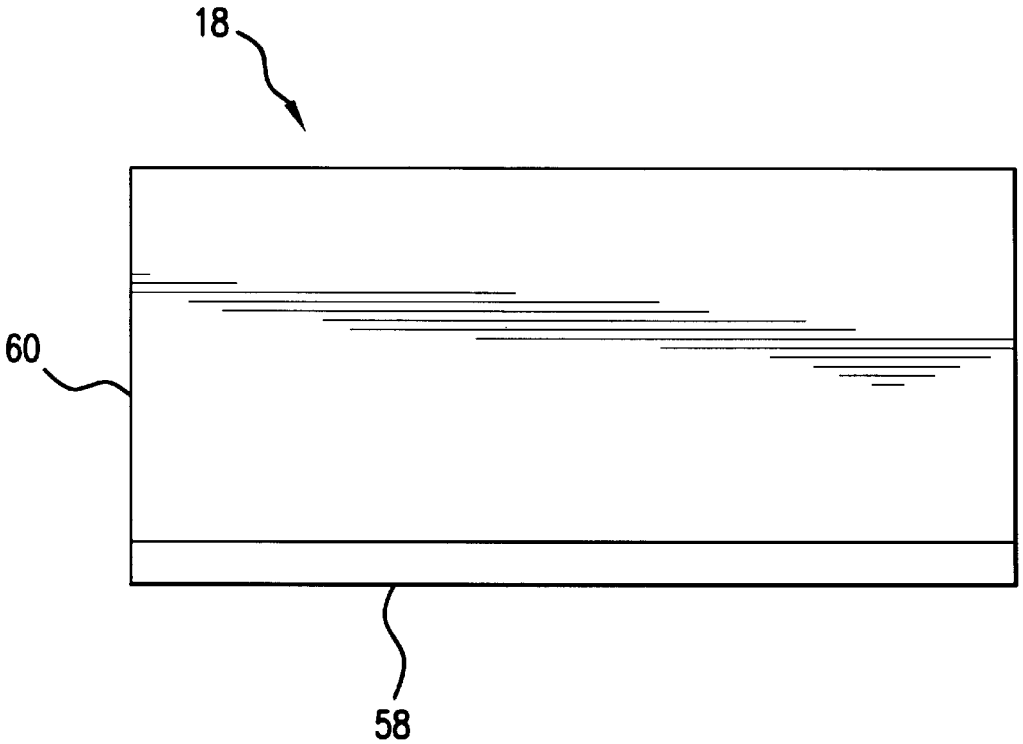
FIG. 62 shows a structural element, constructed as a floor strip, in a front view.
Figure 64:
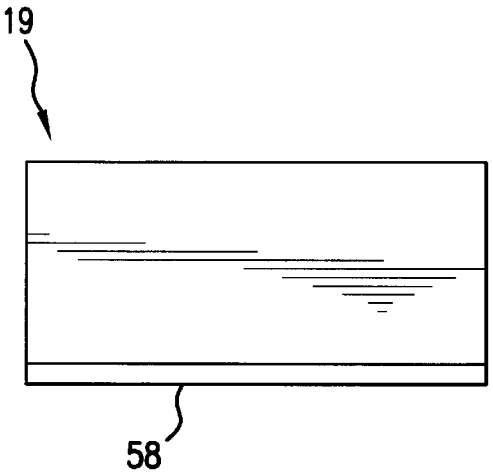
FIG. 64 shows the floor strip, divided in a front view.
Figure 65:
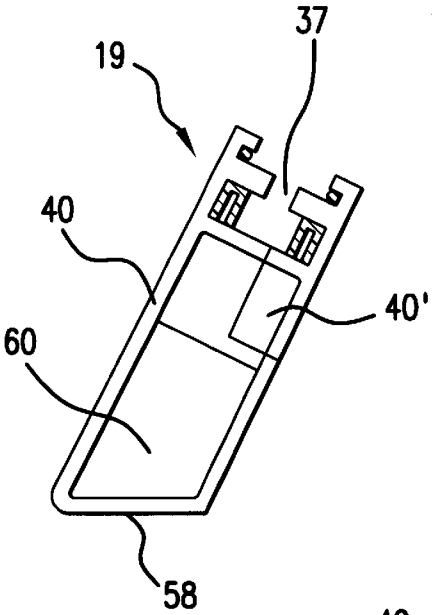
FIG. 65 shows the floor strip of FIG. 64 in a side view.
Figure 67:
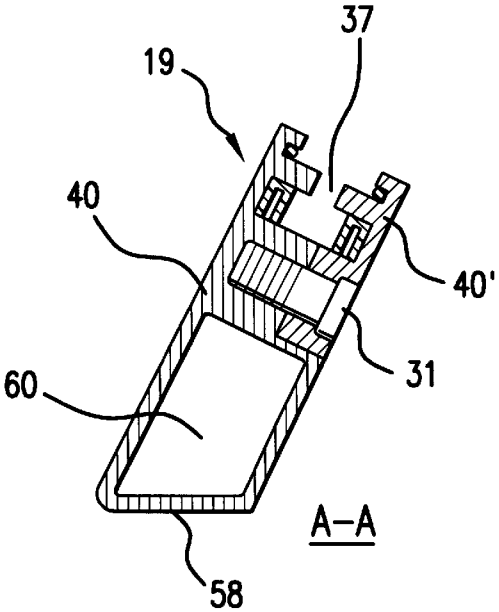
FIG. 67 shows the section A—A of FIG. 66.
Figure 66:
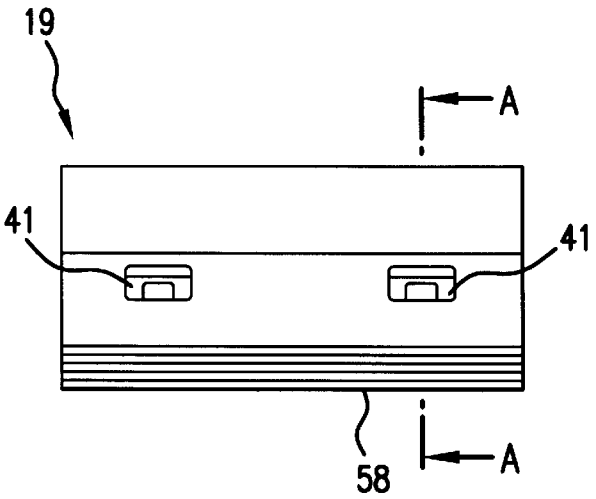
FIG. 66 shows the strip of FIG. 64, rotated through 180° about a horizontal axis, in a front view.

FIG. 54 introduces a diagrammatic front view of a connecting strip 15. The connecting strip 15 has a rectangular construction and, at its longer edges, carries guides 37, as shown in greater detail in FIG. 55. The connecting strip 15 extends further in width than do the connecting strips 1; 2. This extent is attained by incorporating hollow profiles 39, which are disposed between the guides 37 and make a planar extent of the connecting strip 15 possible. Sealing elements 38; 38', incorporated in the guide, permit a play-free introduction of the T-shaped profiles 34 into the guides 37. According to FIGS. 54, 55, the connecting strip 16 is shown in FIG. 56 in a front view as a divided element. The straddling dowel 32 is incorporated centrally at a functionally appropriate distance. The straddling dowel seats here, as with all divided connecting elements, are constructed so that the dowel 32 does not protrude beyond the plane of the surface of the connecting element 16. FIG. 57 shows a plan view of the connecting strip 16. The construction of the guide 37 and its position can be recognized here. FIG. 58 shows the course of the section B—B of FIG. 56. It can be seen here that the two parts 40; 40' of the connecting strip 16 are held together by straddling dowels 32, into which, for finally fixing the position and for taking over the function as a static element of a structural member, after incorporation between the basic elements a; b; c, which are to be connected, an expansion screw 30 is introduced into the straddling dowel 32. The connecting strips are configured as in FIGS. 56; 58, similar to the construction of the connecting strip 15, for connecting basic elements a; b; c in one plane. The incorporation of sealing elements 38; 38' is undertaken in the manner already described for other connecting elements. FIG. 58*a* shows an exploded representation of FIG. 58. The division of the guide 37 can be recognized in the shape of the T-shaped profile 34. The dowel seat 41 has a denticulation 31 in the lower part 40' with the correspondence 77. The dowel seat 41 for the dowel 32 is constructed in the upper part 40. After the upper part 40 and the lower part 40' are assembled, the connecting strip 16 of the straddling dowel 32 is introduced into and guided in the region of the denticulation 31'. In this region, the straddling dowel fixes the position of the parts of the connecting strip on the basic elements a; b; c connected by it. After all the kit parts, brought together with the connecting element, are aligned completely, the parts of the connecting strip can be fixed in their position after an expansion screw is inserted. FIG. 59 shows a connecting element, constructed as a floor corner 17, in a diagrammatic side view. With this element, it is permitted to erect the structural body with its corner regions on a contact surface. With that, the structural member is supported on the floor elements, which is shown here as the floor corner 17 of FIG. 60, rotated through 180°. In this Figure, the guide 42 is provided on a leg part of the leg 45, which is offset by 90° with respect to leg 48. The guides 42 are aligned into the slab plane here and permit basic elements a; b; c to be inserted in an inclined plane. FIG. 61 shows the arrangement of a triangular basic element c in the leg 48, which is shown in the position of FIG. 59. FIG. 61 is a longitudinal section through the plane of the leg 46; 48 of FIG. 59. The incorporation of the guides 42, fitted out with sealing elements 38; 38', can be seen in the sectional plane. The element 17 supports the structural body on the contact surface 58. With this element, it is permitted to construct a corner region, which consists of a vertical plane, adjoining which there is a surface, inclined at an angle of 90°. This inclination is realized owing to the fact that a triangular basic element c is pushed into the guides 42 of the legs 46; 48 of FIG. 61. For forming the inclined surface in the guides 42, a basic element a; b, with a guide constructed at an angle of 90° to one another, is incorporated in the leg part of the leg 48. Sealing elements 38; 38' complete the connecting element. FIG. 62 shows a further floor element 18 of the group of connecting elements in a diagrammatic front view. A guide 37 is disposed on a basic body 60 and, with a contact surface 58, forms the floor strip 18. The contact surface is incorporated in such a manner in the basic body 60, that the floor strip is inclined at an angle α of 27°, as shown in FIG. 63. The guide is disposed opposite to the contact surface and extends along the longer upper edge of the basic body 60. Due to the construction of its guide 37, the floor strip 18 can be pushed onto the T-shaped profiles 34 of the basic elements a; b; c and is sealed in the guides by sealing elements 38; 38'. FIG. 64 shows the floor strip 18 of FIGS. 63, 64 with the same dimensions, but with a divided construction. FIG. 64 shows a diagrammatic representation, in order to make the contours recognizable. FIG. 65 illustrates the exact construction of the parts 40; 40' and of the floor strip 19. The side view shows that part 40' is inserted in the part 40, and that the point of separation intervenes in the region of the guide 37, in order to make it possible to join the floor strip 19 to the basic elements a; b; c and to embrace their T-shaped profiles 34. The position of the dowel seat for inserting the straddling dowel 32 cannot be seen in FIG. 65 and is explained in greater detail in FIG. 66. The view in FIG. 66 is swiveled about a horizontal axis through an angle of 180° from the view shown in FIG. 64. The dowel seat with the straddling dowels 32, with which the two parts 40; 40' of the floor strip of 19 are held together, can be seen here. The nature of the connection has been explained in sufficient detail in conjunction with the previous explanations of the divided connecting elements. However, it is shown once again in detail in FIG. 67. It can be seen here that the part 40' is attached to the part 40 with the correspondence 77 in such a manner, that the guide 37 was closed and the T-shaped profile 34, in a firm connection, embraces the respective basic element a; b; c. A straddling dowel 32 locks the two parts 40; 40' together in the manner already described. A contact surface is assigned to the basic body 60 in such a manner, that the floor strip 19, deviating from the vertical at an angle of 27°, can stand on the contact surface and finds use for the construction of inclined structural member surfaces.

Figure 67A:
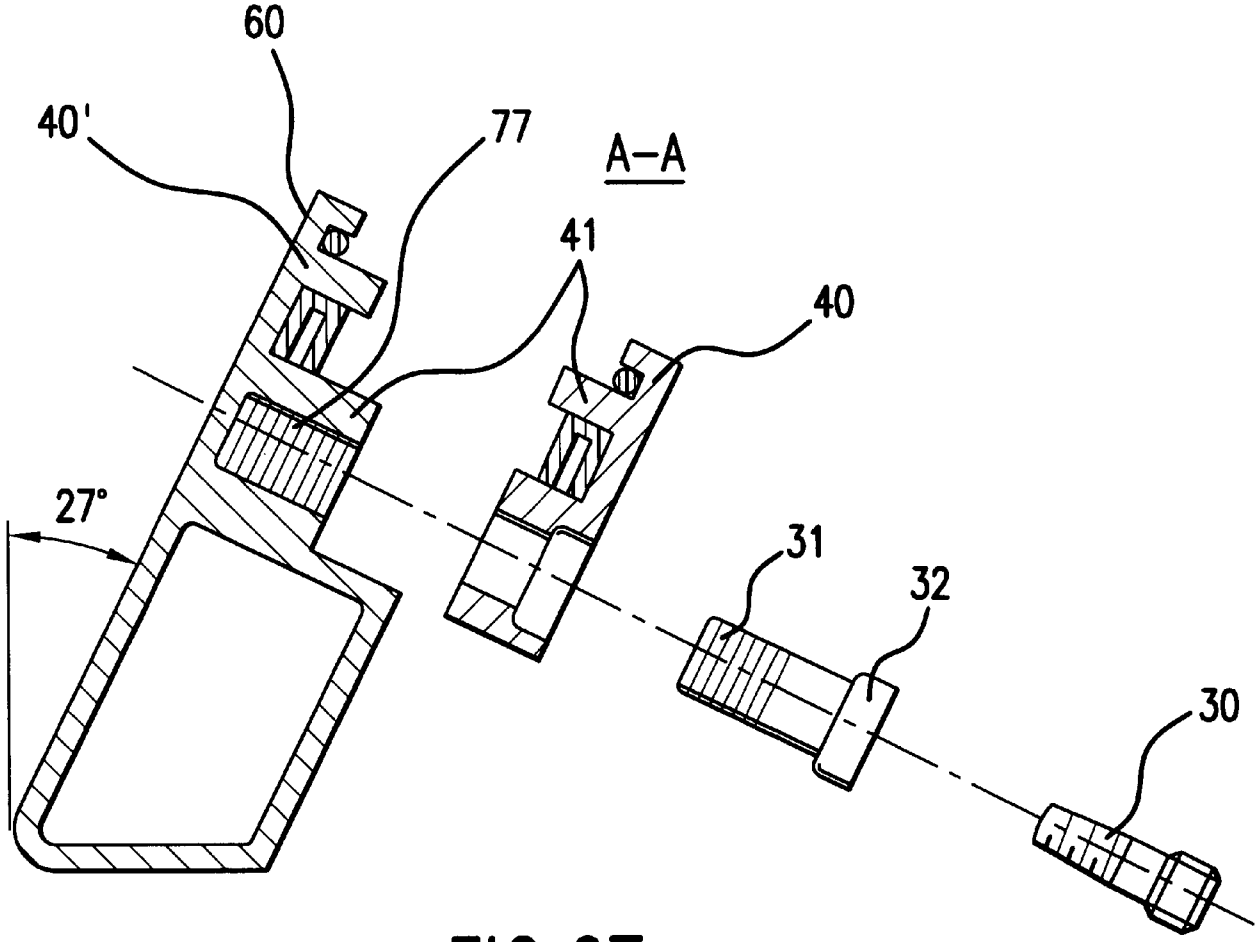
FIG. 67*a* shows the section A—A in an exploded representation.
Figure 69:
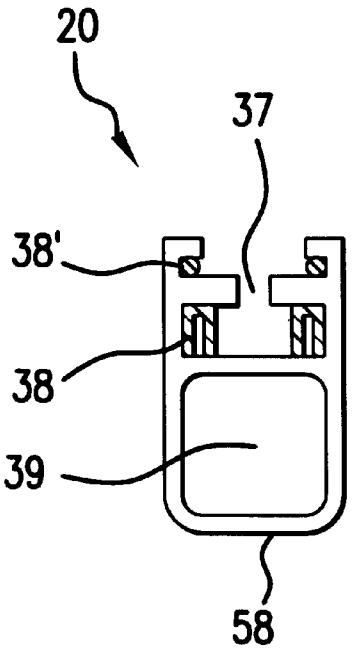
FIG. 69 shows the strip of FIG. 68 in a side view.
Figure 68:
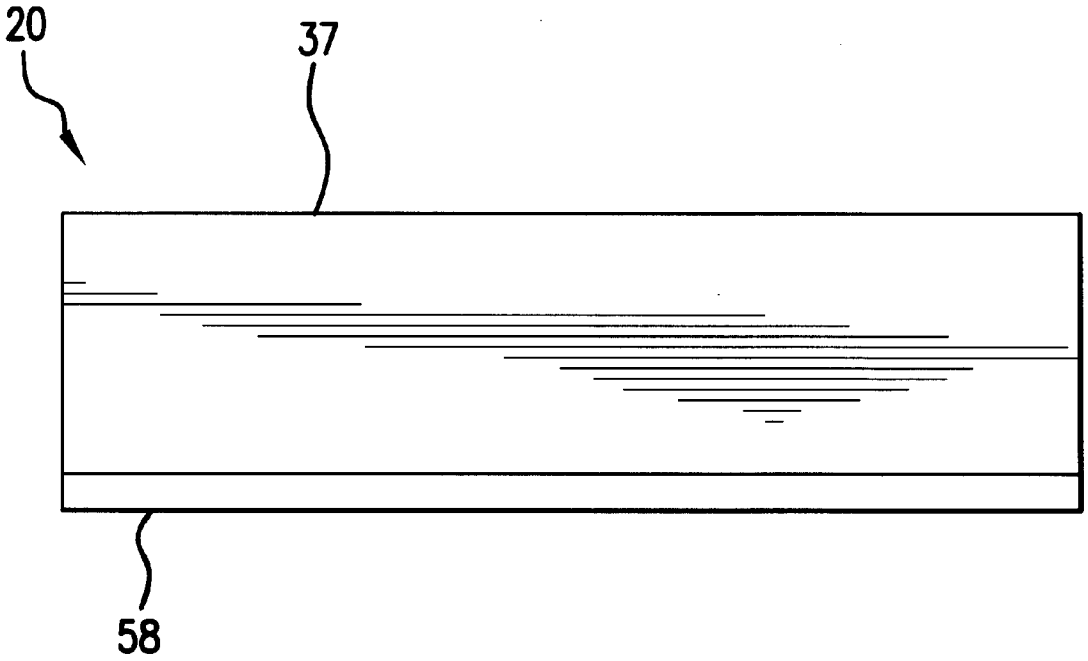
FIG. 68 shows a structurally element, constructed as a floor strip in a front view.
Figure 72:
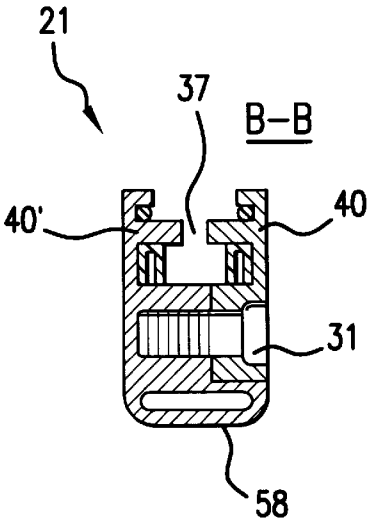
FIG. 72 shows the section B—B of FIG. 70.
Figure 71:
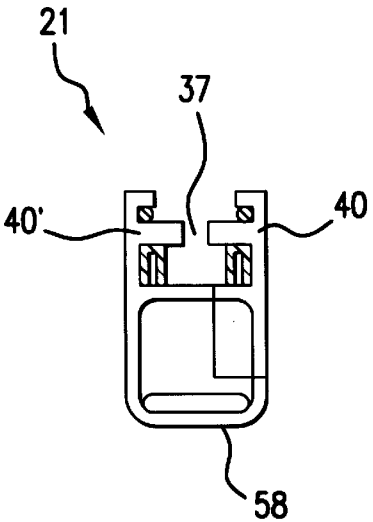
FIG. 71 shows the strip of FIG. 70 in a plan view.
Figure 70:
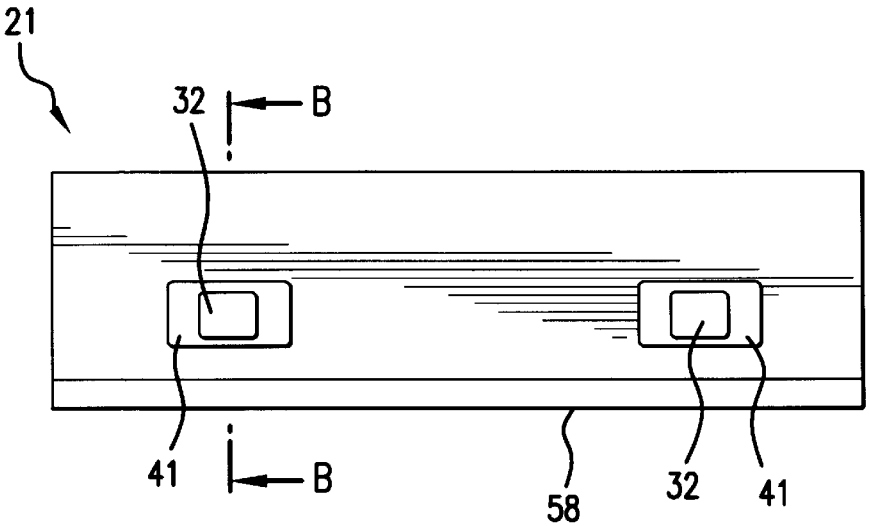
FIG. 70 shows the floor strip of FIG. 68 in a divided construction in a front view.
Figure 72A:
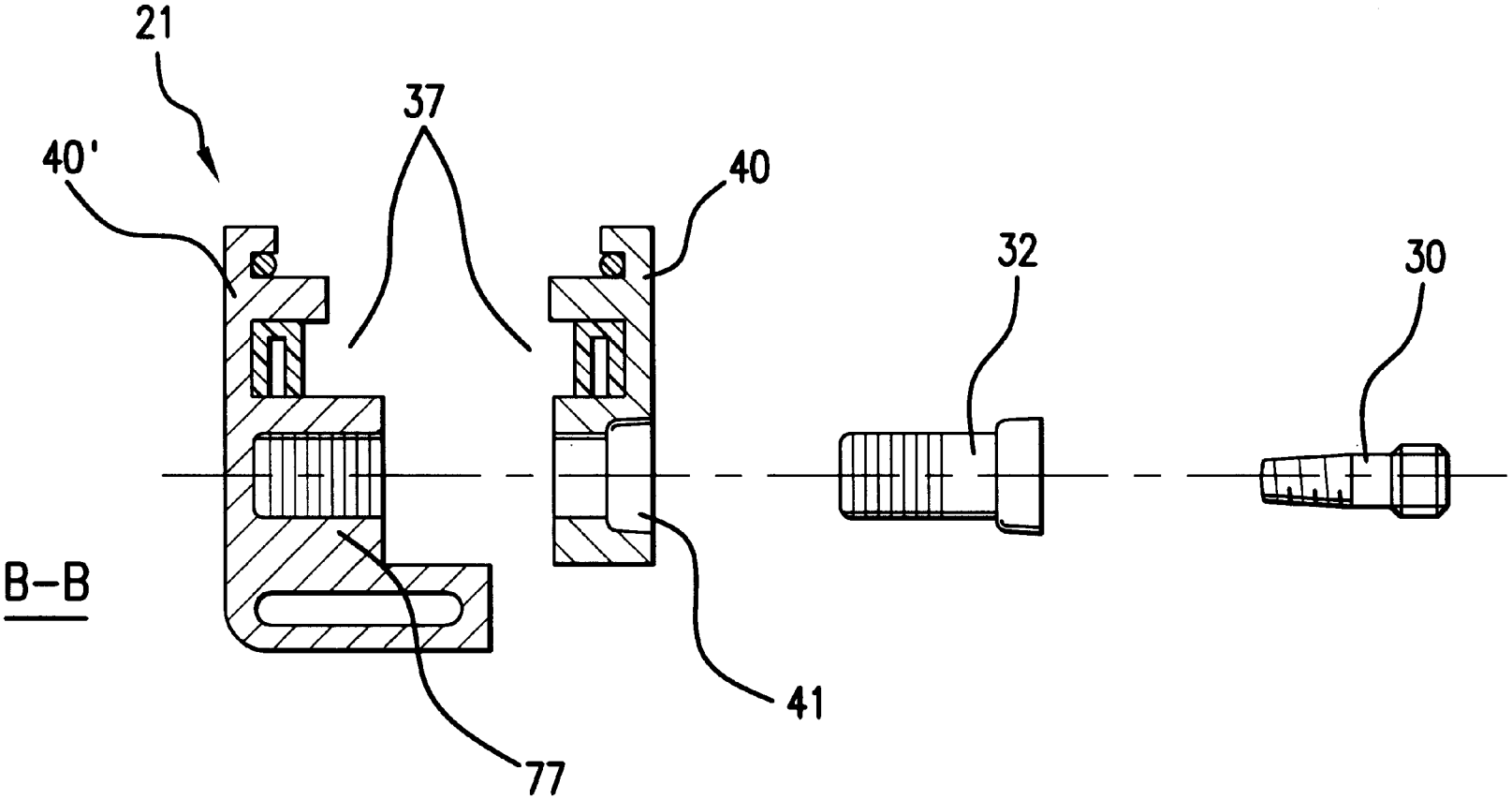
FIG. 72*a* shows the section B—B of FIG. 70 in an exploded representation.
Figure 73:
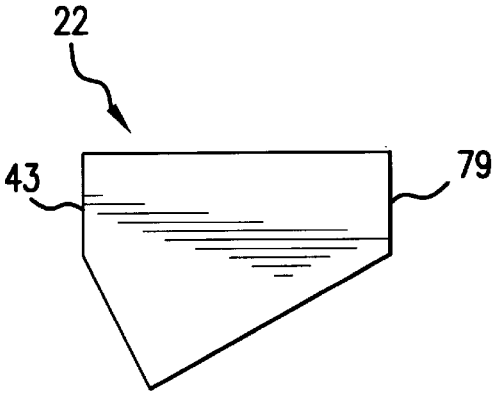
FIG. 73 shows a structural element, constructed as a wall corner, in a diagrammatic front view.

FIG. 67*a* is an exploded representation, which shows the course of the division between the upper part 40 and the lower part 40'. The lower part 40' remains connected to the basic body 60, the upper part 40 with the dowel seats 41, after the installation in the structural body, being connected to one another by straddling dowels 32. A floor strip 20 with an erecting surface 58 for erecting vertical walls is shown in FIG. 68 in a diagrammatic front view. On the upper, longitudinal edge opposite the contact surface 58, a guide 37 is disposed, as can be inferred from FIG. 69, which is a side view of FIG. 68. The guide 37 is constructed as a T-shaped internal profile 34', so that the floor strips 20 can be pushed onto the T-shaped profiles 34 and are seated securely due to the sealing elements 38; 38' which have already been mentioned frequently. It is self-evident that the longitudinal extent of the floor strip 20 is congruent with the longitudinal extent of the already previously explained connecting elements. The floor strip 21 of FIGS. 70; 71; 72 has the same dimensions as the floor strip 20, but is constructed in a divided form. The position and arrangement of a dowel seat 41 for introducing the straddling dowels 32 can be recognized from the view. The side view of the bottom strip 21 can be seen in FIG. 21, from which the arrangement of the division of the bottom strip 21 can be inferred. The division passes through the guide 37 and, in the case of the divided construction, opens the guide 37 in the position of the correspondence 77. FIG. 72 shows the section B—B of FIG. 70. The two parts 40; 40' of the floor strip 21 are shown here in the assembled state. A straddling dowel 32 is inserted with its denticulation 31 through the part 40 in the part 40', locking the latter. As is self-evident, this locking is undertaken when the floor strip 21 is installed, the guide 37 surrounds the T-shaped profile 34 of the basic elements a; b; c and the strip 21 becomes effective at the structural element. FIG. 72*a* shows a representation, which underlines the above explanation. A connecting element, constructed as a wall corner 22, is shown in a diagrammatic front view in FIG. 73.

Figure 74:
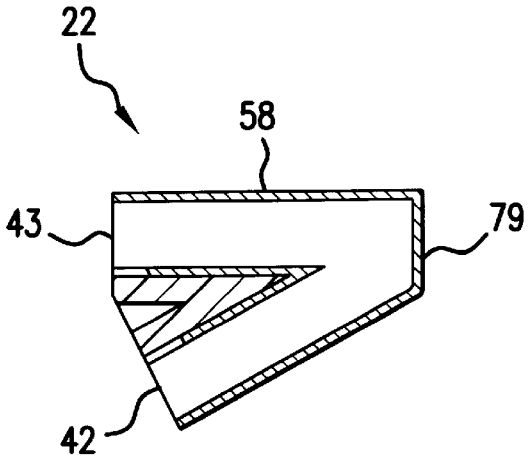
FIG. 74 shows the corner of FIG. 73 in a longitudinal section with the inserted sealing elements.
Figure 75:
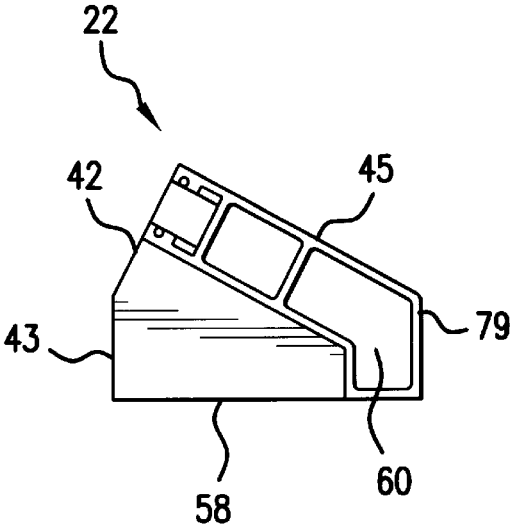
FIG. 75 shows the corner of FIG. 73, rotated by 180° about a horizontal axis in a front view.
Figure 76:
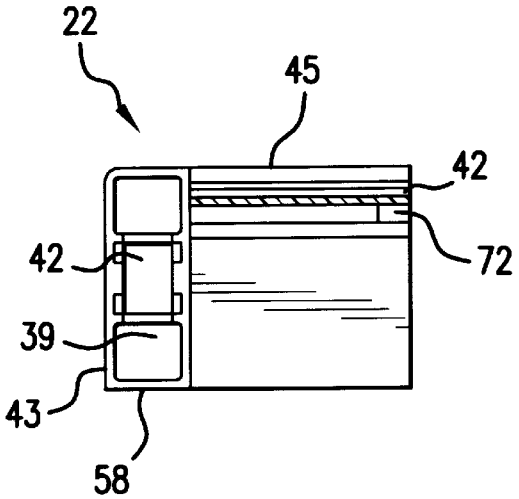
FIG. 76 shows the corner of FIG. 75 in a side view.
Figure 78:
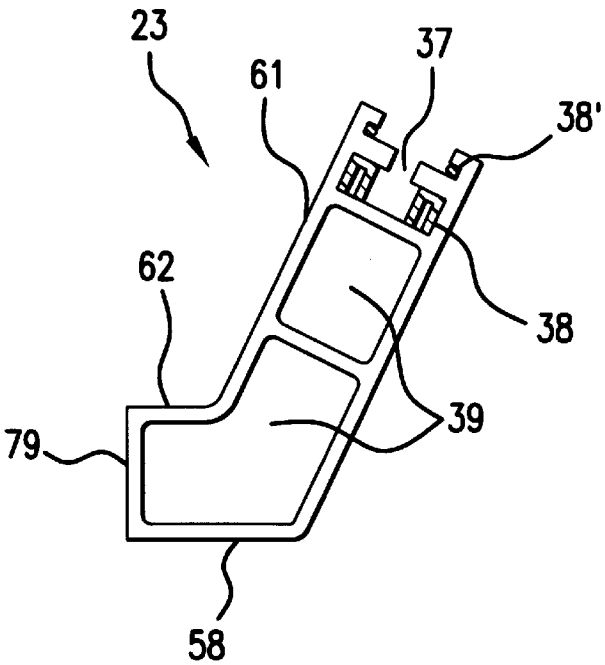
FIG. 78 shows the strip of FIG. 77, in a side view.
Figure 77:
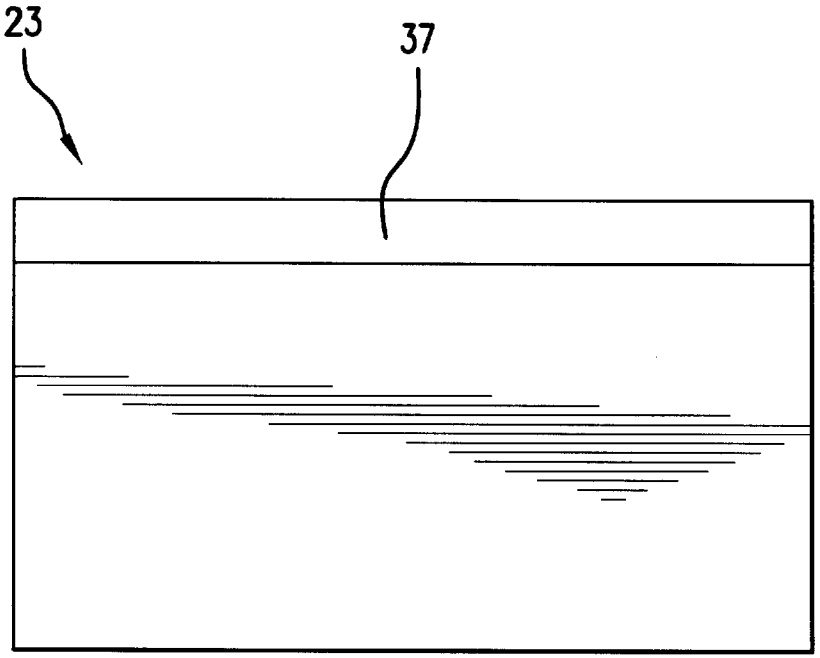
FIG. 77 shows the structural element constructed as a wall strip, in a front view.
Figure 81:
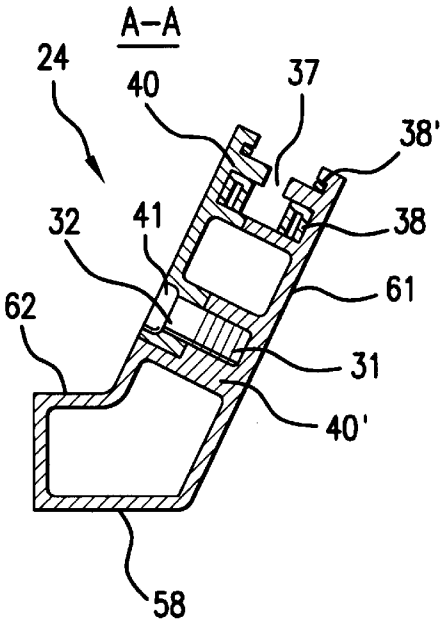
FIG. 81 shows the section A—A of FIG. 79.
Figure 80:
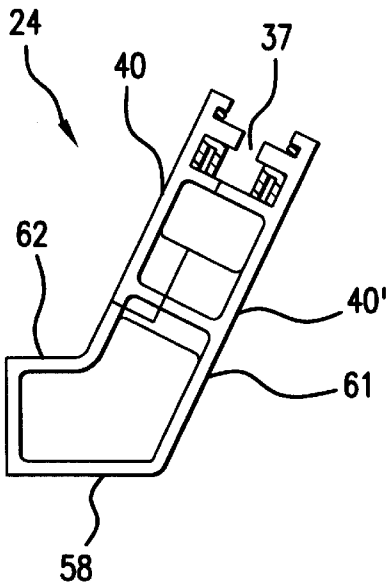
FIG. 80 shows the strip of FIG. 79 in a side view, swiveled to the left.
Figure 79:
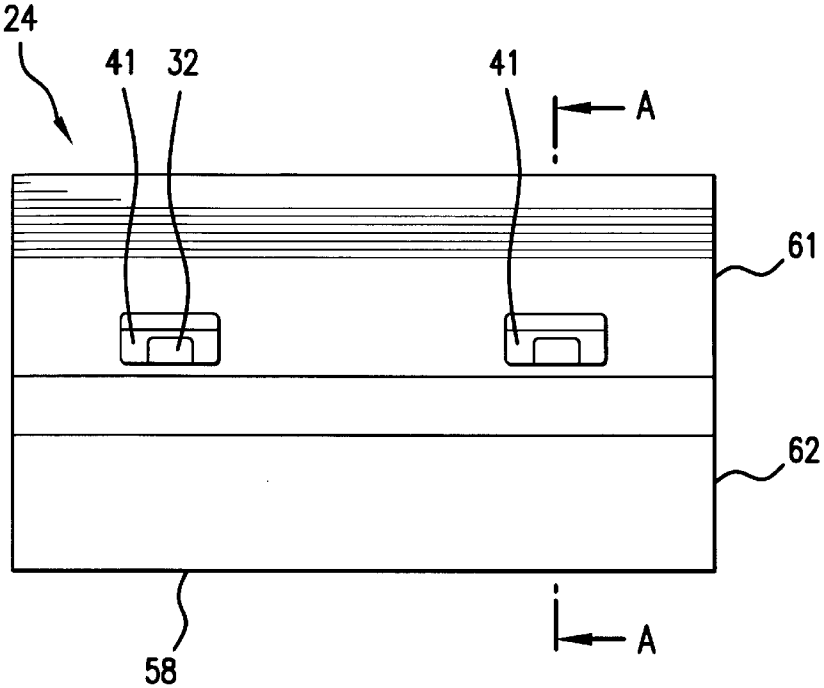
FIG. 79 shows the wall strip as in FIG. 77, in a divided construction in a front view.
Figure 81A:
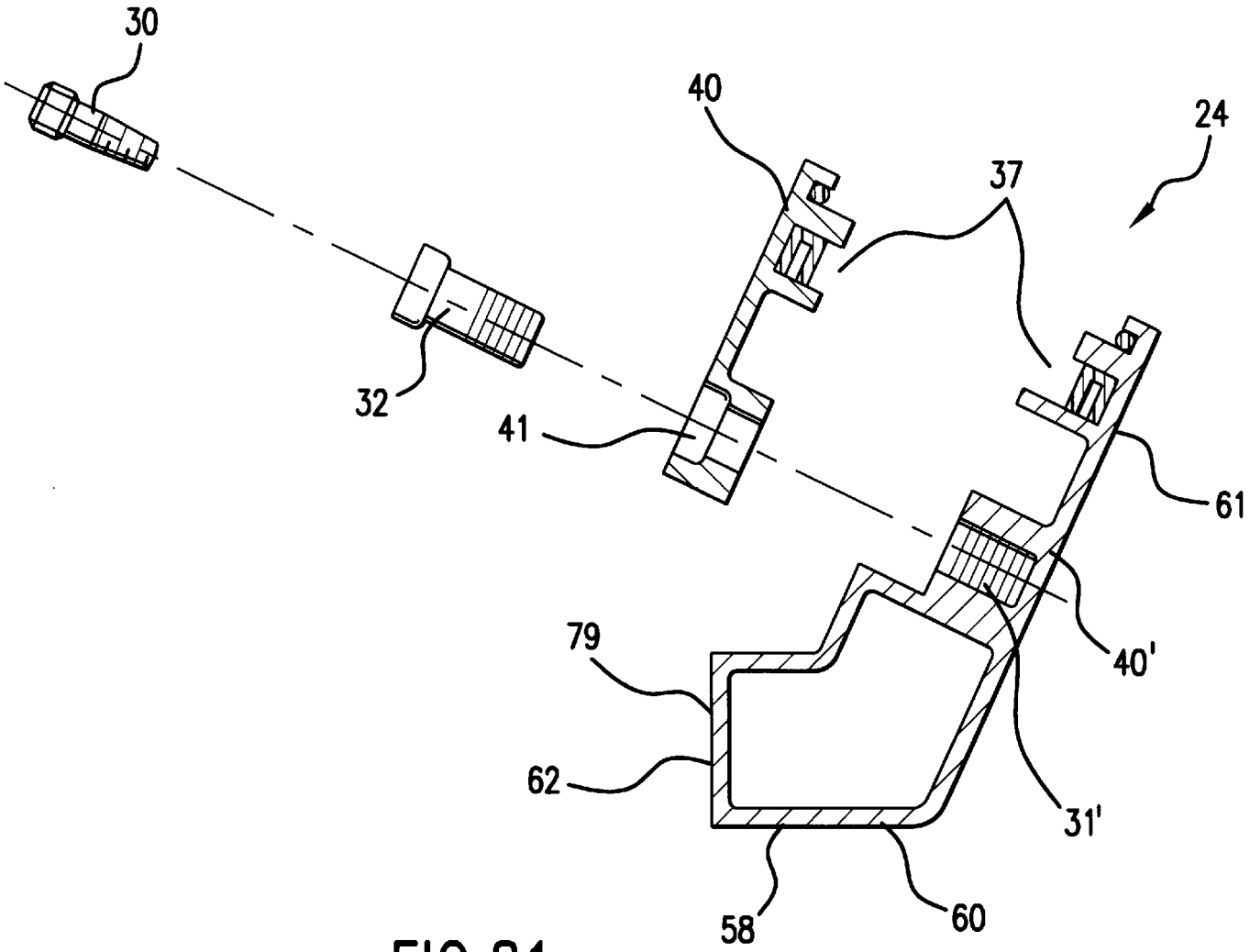
FIG. 81*a* shows FIG. 81 in an exploded representation.
Figure 82:
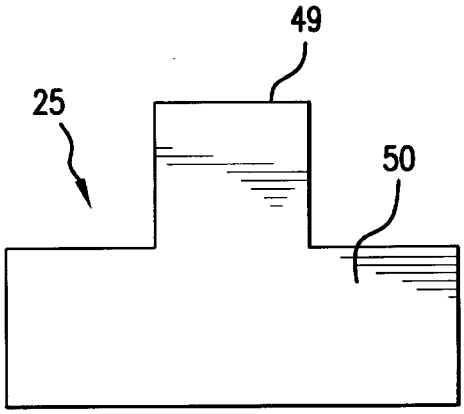
FIG. 82 shows a structural element, constructed as a T-shaped connector in a front view.
Figure 83:
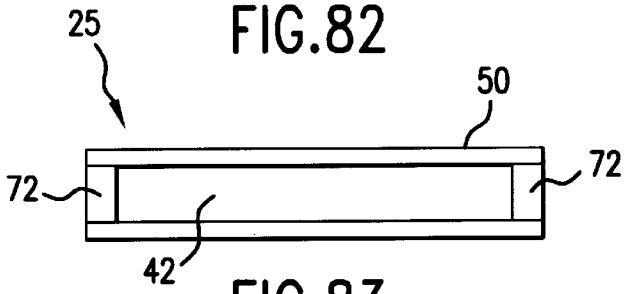
FIG. 83 shows the connector of FIG. 82 as seen from below.
Figure 84:
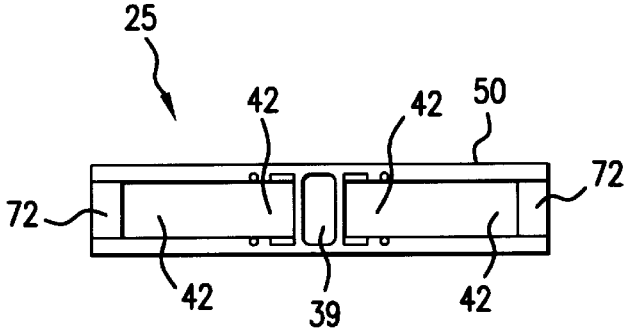
FIG. 84 shows the T-shaped connector of FIG. 82 in a plan view.
Figure 85:
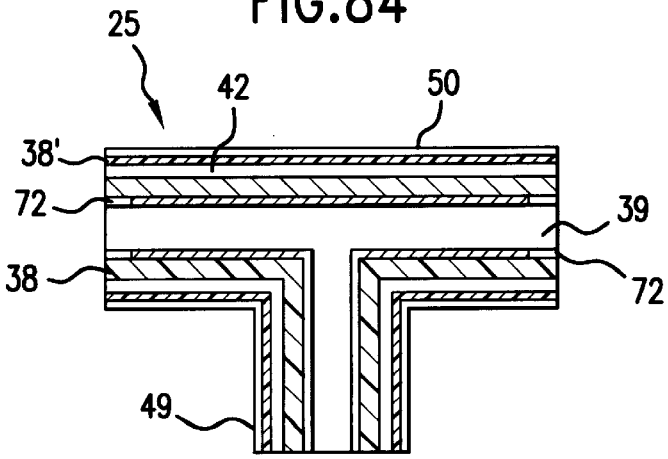
FIG. 85 shows the T-shaped connector of FIG. 82, rotated through 180° about a horizontal axis, in a front view in longitudinal section.
Figure 87:
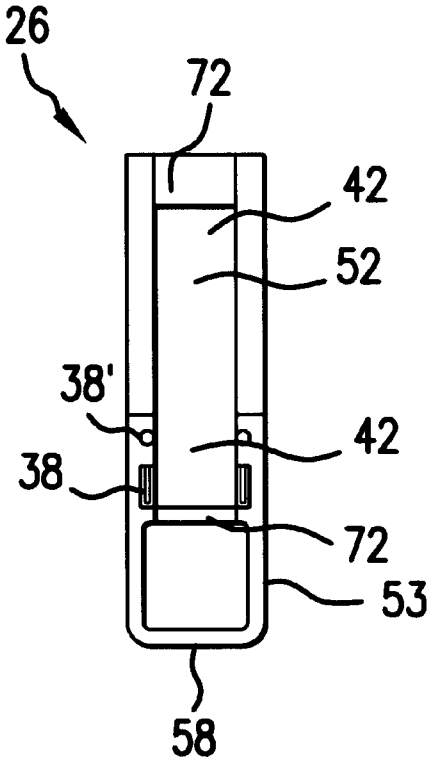
FIG. 87 shows the connector of FIG. 86, in a side view.
Figure 86:
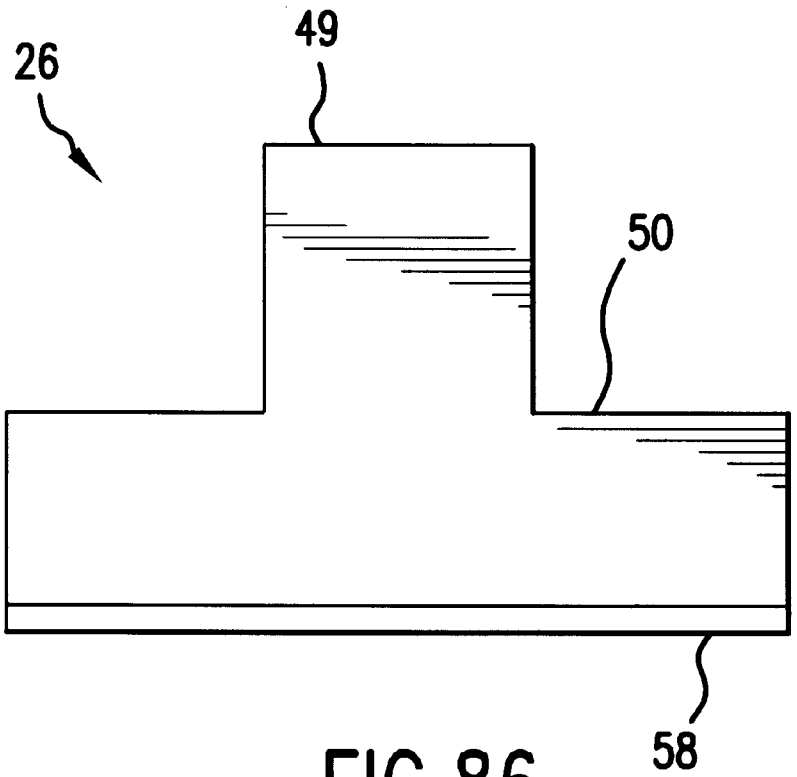
FIG. 86 shows a structural element, constructed as a floor connector, in a diagrammatic front view.
Figure 90:
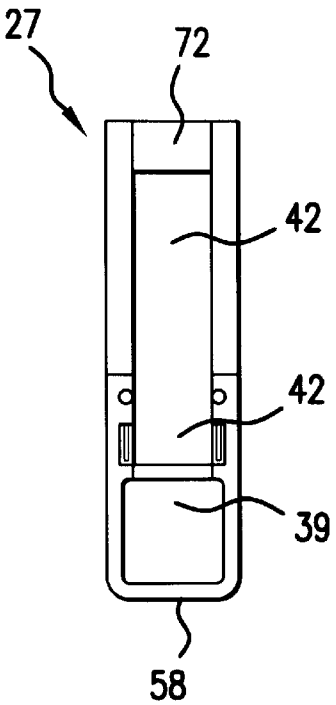
FIG. 90 shows the corner of FIG. 88, in a side view, swiveled towards the left.
Figure 89:
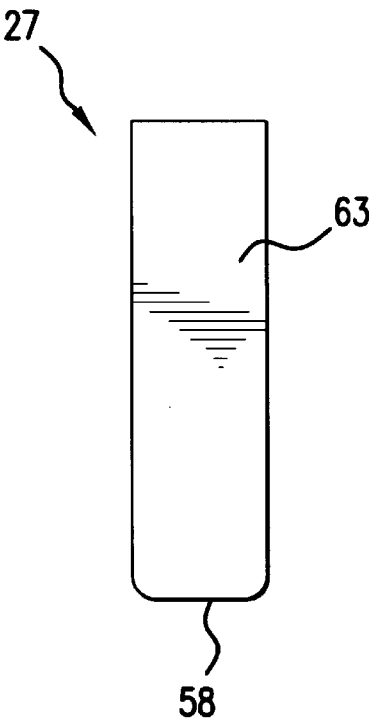
FIG. 89 shows the corner of FIG. 88 in a diagrammatic side view, swiveled through 90° towards the right.
Figure 88:
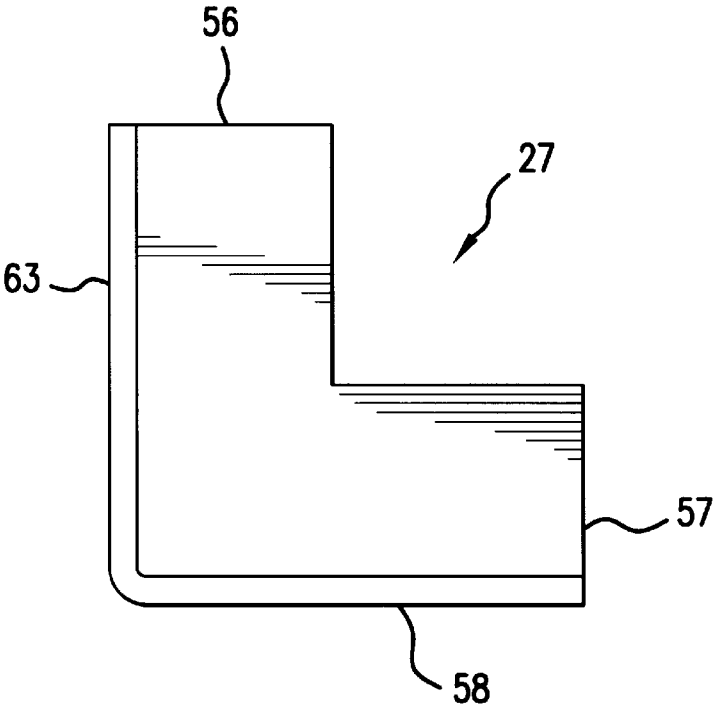
FIG. 88 shows a structural element, constructed as a floor-wall corner, in a front view.

The front view is defined by the leg 43. FIG. 74 shows a longitudinal section through the leg 43, shown in the position of FIG. 73 and shows that a basic element c is used here, which permits the wall corner 22 to slope at an angle of 27°. Opposite to the larger opening region of the leg 43, a bearing surface is disposed, with which the element 22, supported at a house wall, is brought into contact. The leg 45, which is fixed to the leg 43 at an angle of 90°, is bent and goes over into a part, which includes a contact surface 58 for leaning against the wall, as can be inferred from the more complex representation of the wall corner 22 of FIG. 75, follows the slope of the leg 43. Returning once again to FIG. 74, the incorporation of the guide 42 in the leg 43 can be inferred. Since FIG. 75 is rotated through an angle of 180° relative to FIG. 73 about a horizontal axis, the leg 45, striking at an angle of 90°, protrudes from the plane of the drawing, as can readily be seen. FIG. 76 shows a side view of FIG. 75 and the assignment of the legs 43; 45 to one another. The guide 42 on the leg 43 is congruent with the guide 42 in FIG. 74 and, in the complete construction of the guide 42 in FIG. 76, protrudes from the plane of the panel. The contact surface 58 encloses a hollow profile 39. The course of the leg 45 shows the position in the guide 42 in a diagrammatically shifted position. This component serves as the concluding wall corner 22, if the inclined plane of a surface of a structural member is to end, for example, at a house corner. For the installation with the corresponding basic elements a; b; c, the T-shaped profiles 34 of the latter are inserted into the guides 42 of the wall corner 22 and fixed securely in position with clamps 33. FIG. 77 shows a wall strip 23 in a diagrammatic front view, from which the ratio of the contours of the strip 23 can be inferred. The side view of FIG. 78 shows the position of the legs 61; 62 of the wall strip 23 relative to one another. The leg 62 is the shorter leg and adjoins the longer leg 61 at an angle α of 27°. At the head of the leg 61, a guide 37 is disposed, into which the T-shaped profiles 34 of the adjoining basic elements a; b; c can be pushed. A contact surface 58 is provided at the underside of the head of the leg 62, which has a bearing surface 79 for supporting an existing wall, with which the wall strip 23, after being inserted in an inclined structural member surface, such as the wall of a house, can lean against. Like all other connecting elements, this element also, for the reason of minimizing weight, is provided with a hollow profile 39 and the guide 37 is equipped with sealing elements 38; 38'. FIG. 79 shows the wall strip 24 of FIG. 77. The position and arrangement of the dowel seat 41 for the straddling dowel 52 can be inferred from the view. Since the shape of the wall strip 24 is similar to that of the wall strip 23, which has already being described, only the construction of the division is referred to here. FIG. 80 shows the abutting surface of the parts 40; 40' of the wall strip 84. As with the undivided wall strip 23, the guide 37 is disposed at the head of the leg 61 and is opened when the upper part 40 of the strip 24 is removed. The two parts 40; 40' of the wall strip 24 are connected with a straddling dowel 32, which is inserted in a dowel seat 41 and, with its denticulation 31, engages the correspondence 77 of the lower part 40', as shown in FIG. 81. The expert is provided with a connecting element here, with which, in the course of the installation completing the series of connecting elements, he can fasten the wall strip to the respective basic element a; b; c. It is obvious that complete elements, such as sealing elements 38; 38', are disposed in the guide 37 and that an expansion screws 31 can be introduced into the straddling dowel 32 for the final fixing. FIG. 81*a* shows the wall strip 24 in an exploded representation. The upper part 40 in the region of the guide 37, as well as the dowel seat 41 are shown separately here. In the dowel seat 41 of the lower part 40', the denticulation 31 in the correspondence 77 can be recognized in the form of an inner denticulation 31', into which the dowel seat 32 with its denticulated shaft part can be pushed, when the upper part 40, which embraces the T-shaped profile 34 of a basic element a; b; c, is fixed on this and, by penetration of the adjusting the screw 30 into the straddling dowel 32, is locked. FIG. 82 diagrammatically shows the front view of a T-shaped connector 25. The T-shaped connector 25 is formed from a vertical cross member 49 and a holding body 50. FIG. 83 shows the T-shaped connector in a view from below, in which the arrangement of the guide 42, which extends continuously on the back of the holding body, can be recognized. On the inside of the holding body 50, in the region of the cross member 49, mutually abutting guides 42 are provided, which make it possible to connect the now three basic elements a; b; c. This representation can be seen in FIG. 85, which shows a sectional course through the T-shaped connector of FIG. 82, rotated through 180° about a horizontal axis. FIG. 84 introduces the position of the guide 42 in the region where the cross member of 49 is tied into the holding body 50 and shows the construction of the guide 42, which ensures that the basic elements a; b; c can be pushed between the cross member 49 and the holding body 50, as well as at the back of the holding body 50. FIGS. 83 and 84 provide an overview of the possibilities for locking the pushed-in basic elements a; b; c by inserting a clamp 33 into the guide 42 and connecting the basic elements a; b; c by overlapping of the hollow profile 39 in the region of the recess 72. By means of the T-shaped connector, it is possible to connect three basic elements. At the same time, all basic elements have a parallel position and are connected on five sides with the T-shaped connector. The connecting of the basic elements a; b; c with the T-shaped connector 25 is meaningful, if the basic elements are to be assembled into a surface. A floor connector 26 of FIG. 86 is provided with the same contours as the T-shaped connector 25. From the diagrammatic representation of this Figure, it can be seen that the cross member 49 stands vertically on the holding body 50. The lower long side of the holding body 50 has a contact surface 58. The side view of FIG. 87 characterizes the position of the guides 42, which are incorporated in the cross member 49 as well as in the holding bodies 50. The locking of the two basic elements a; b; c, which are to be incorporated in the floor connector 26, is accomplished by means of pushing the basic elements a; b; c into the guide 42. The basic elements a; b; c are fixed in position by pushing clamps 33 into the connecting element in the region of the recesses 72. The floor connector 26 is used as connecting element in order to connect two basic elements a; b; c, which are to be installed near the floor, and to place the body side or the structural surface erected therewith by means of the contact surface 58 upon a foundation. Of course, the extent of the external dimensions of the floor connector is congruent with that of the other connecting elements. A further connecting element, as floor-wall corner 27, is shown in a diagrammatic front view in FIG. 88. FIG. 88 shows that, along the mutually perpendicular legs 56; 57 of the floor-wall corner, a contact surface 58 is provided at the horizontally extending leg 57 and a bearing surface at the rising leg 56. FIG. 89 shows the contour of the floor-wall corner 27 in a side view with the position of the contact surface 58 and the bearing surface 63. Starting out from FIG. 88 turned to the left, a side view of the floor-wall corner 27 is given in FIG. 90, and shows the position of the guide 42 in the inner region of the corner of the angle. A basic element a; b; c is pushed into the guides 42 and connected by means of clamps 33 over the recess 72 with the floor-wall corner 27. This component, constructed as a floor-wall corner 27, is to be used as the end of a structural surface standing on the floor, in relation to an adjoining house wall. The connecting element ensures precise fixation of the structural body surface in the xth region between foundation and house wall.

Figure 93:
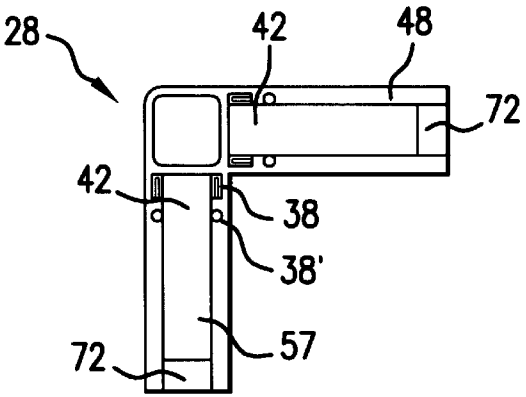
FIG. 93 shows the corner of FIG. 91, swiveled through 90° towards the left, in a side view.
Figure 92:
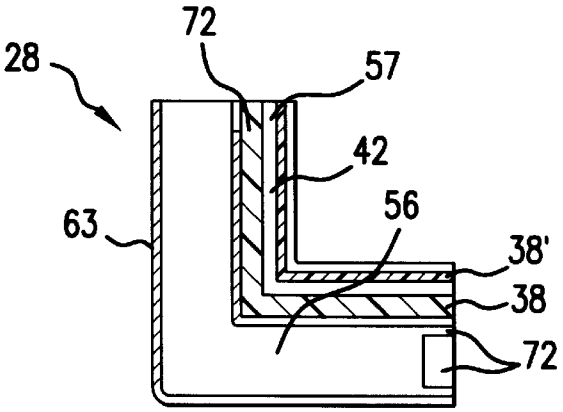
FIG. 92 shows the corner of FIG. 91, swiveled through 180° about a horizontal axis, with inserted sealing elements, in a longitudinal section.
Figure 91:
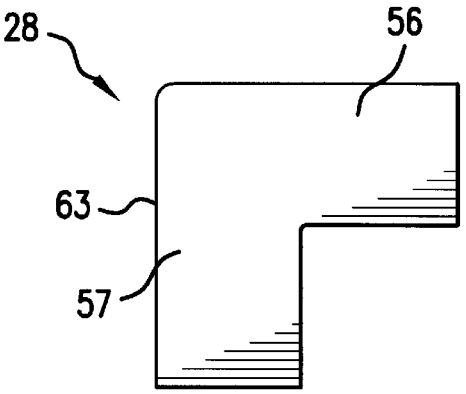
FIG. 91 shows a ceiling-wall corner in a diagrammatic front view.
Figure 95:
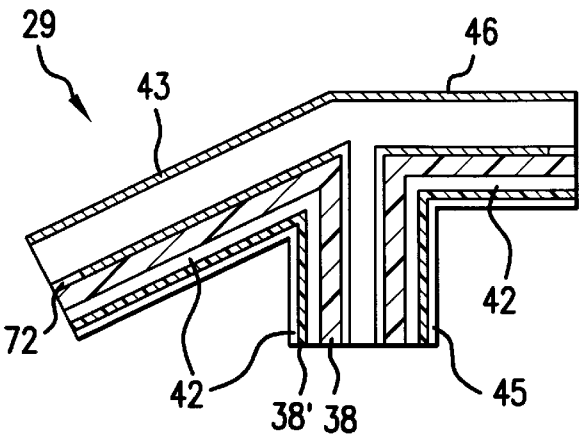
FIG. 95 shows a structural element, constructed as a transition part, in a longitudinal section with inserted sealing elements.
Figure 97:
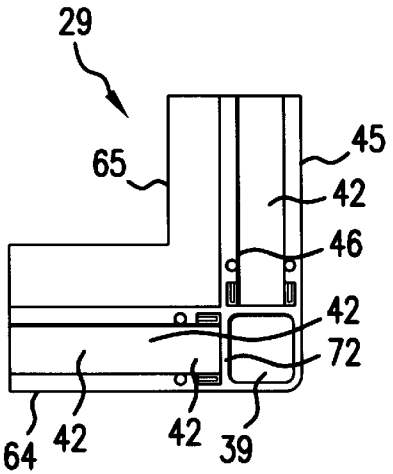
FIG. 97 shows the part of FIG. 96, in a side view, swiveled towards the left.
Figure 94:
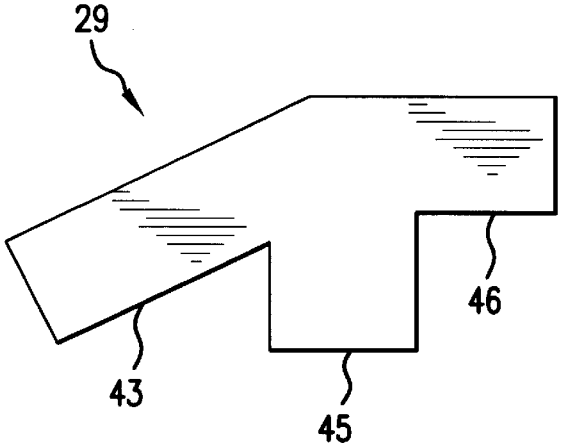
FIG. 94 shows a structural element, constructed as a transition element, in a diagrammatic front view.
Figure 96:
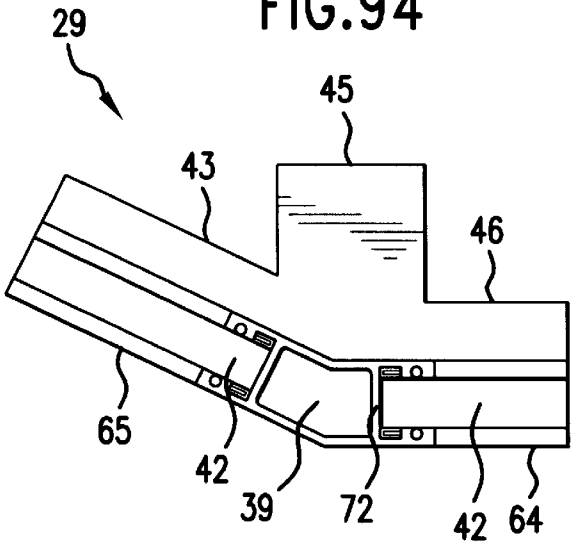
FIG. 96 shows the part of FIG. 94, swiveled through 180° about a horizontal axis, in a front view.

FIG. 91 shows a connecting element, which is constructed as a ceiling-wall corner 28, in a diagrammatic front view with the legs 56; 57 and the bearing surface 63, with which the connecting element is brought into contact, for example, with a house wall. FIG. 92 shows the element rotated through 180° about a horizontal axis in a side view in longitudinal section. Moreover, the position of the guide 42 as well as the incorporation of the sealing elements 38; 38' can be seen. FIG. 93 shows a side view of the ceiling corner of FIG. 91, rotated to the left. At the same time, the position of the leg 48, which according to FIG. 91 lies in the direction of the plane of the table and adjoins leg 56 at an angle of 90°, can be seen. Guides 42, into which the basic elements a; b; c are pushed, are incorporated in the legs 56; 57; 48. In a structural member, these basic elements a; b; c are disposed in a vertical side wall, in a vertical rear wall and in a horizontal ceiling. With that, the ceiling-wall corner 28 connects the basic elements a; b; c of two vertical structural member sides, which are inclined at an angle to one another, as well as of a horizontal ceiling side of the structural body. Of course, the respective basic element a; b; c, which is pushed into the guide 42, is secured with clamps 33, which engage the ceiling-wall corner 28 over recesses 72. FIG. 94 shows the diagrammatic front view of a connecting element in a construction as transition element 29. FIG. 94 shows the position of the legs 43; 45; 46, which can be seen in the view, in a vertical plane. FIG. 95 shows a downward directed leg 43, which forms an acute angle with the perpendicular leg 45. The leg 46 extends at an angle of 90° from the leg 45. FIG. 95 shows a longitudinal section through the element in the position of FIG. 94. The course of the guides 42 shows that it is possible to push in a basic element c, as well as a basic element a; b. Sealing elements 38; 38' are inserted in the dark-colored regions. FIG. 96 shows the representation of the transition part 29, rotated in a horizontal axis through 180° compared to FIG. 94. The vertical legs 43; 45; 46, which are directed vertically downward in FIG. 94, are now directed vertically upward. Legs 64; 65, which are not visible in FIG. 94 and protrude from the rear of the view of FIG. 94, now protrude from the plane of the table in FIG. 96 and show the position of the guides 42 in the legs 64; 65. In FIG. 97, which is a side view of FIG. 96, the position of the guides 42 in the legs 45; 64 is shown and permits the position of the guides 42 to be recognized. At the left inner side, the inclined leg 65 can be seen shortened in the plane of the drawing. The transition part is an extremely complicated connecting element, highly integrating the basic elements a; b; c in the kit. With this element, it is possible to connect a horizontal, a vertical as well an inclined rectangular basic element a; b; c with the structural member and to incorporate it in the perpendicular position with an angular range of 90°. The position of the guides 42 in the legs 43; 45; 46 as well as 64; 65 permit the respective basic elements a; b; c to be connected in their position and arrangement in an uncomplicated manner. For producing surfaces of the structural body, the elements of the kit are pushed together, that is, pushed into the guide and locked by means of clamps 33.

Figure 98:
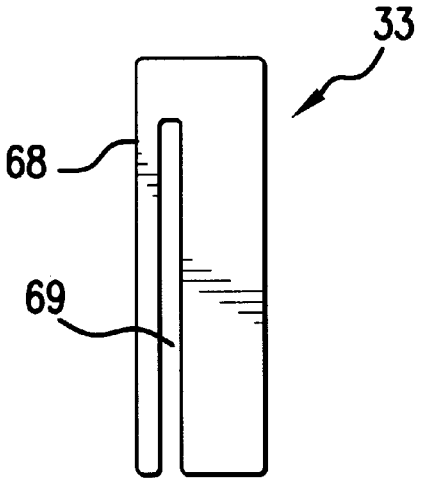
FIG. 98 shows a component, constructed as a clamp, in a front view.
Figure 99:
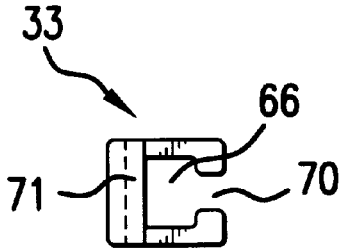
FIG. 99 shows the clamp of FIG. 98, in a plan view.
Figure 100:
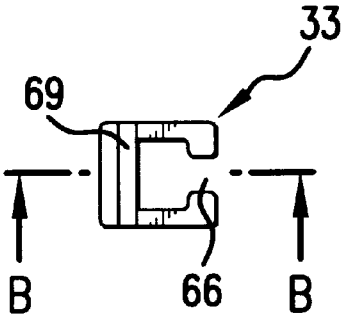
FIG. 100 shows the clamp of FIG. 98, swiveled upwards through 90° about a horizontal axis.
Figure 101:
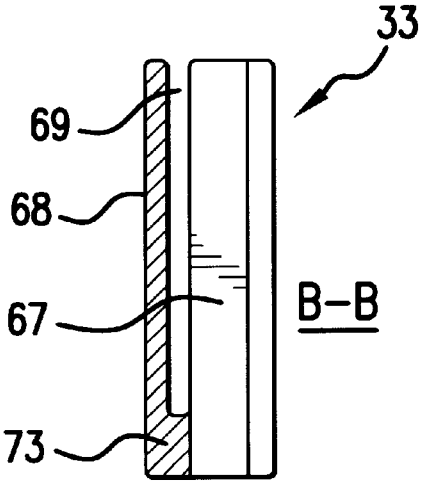
FIG. 101 shows the section B—B of FIG. 100.
Figure 102:
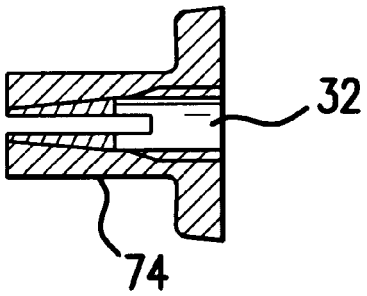
FIG. 102 shows a straddling dowel for the divided structural elements.
Figure 103:
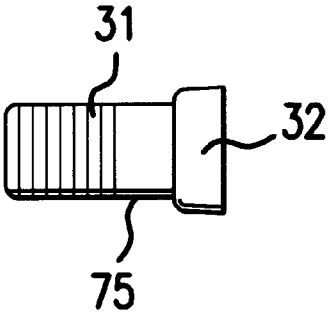
FIG. 103 shows the straddling dowel in a side view.
Figure 104:
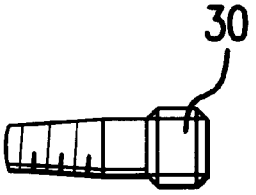
FIG. 104 shows an expansion screw, which is to be introduced into a straddling dowel.
Figure 106:
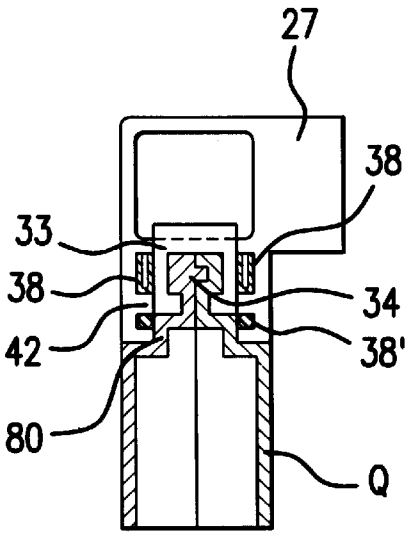
FIG. 106 shows the fastening in a side view, partially in section.
Figure 105:
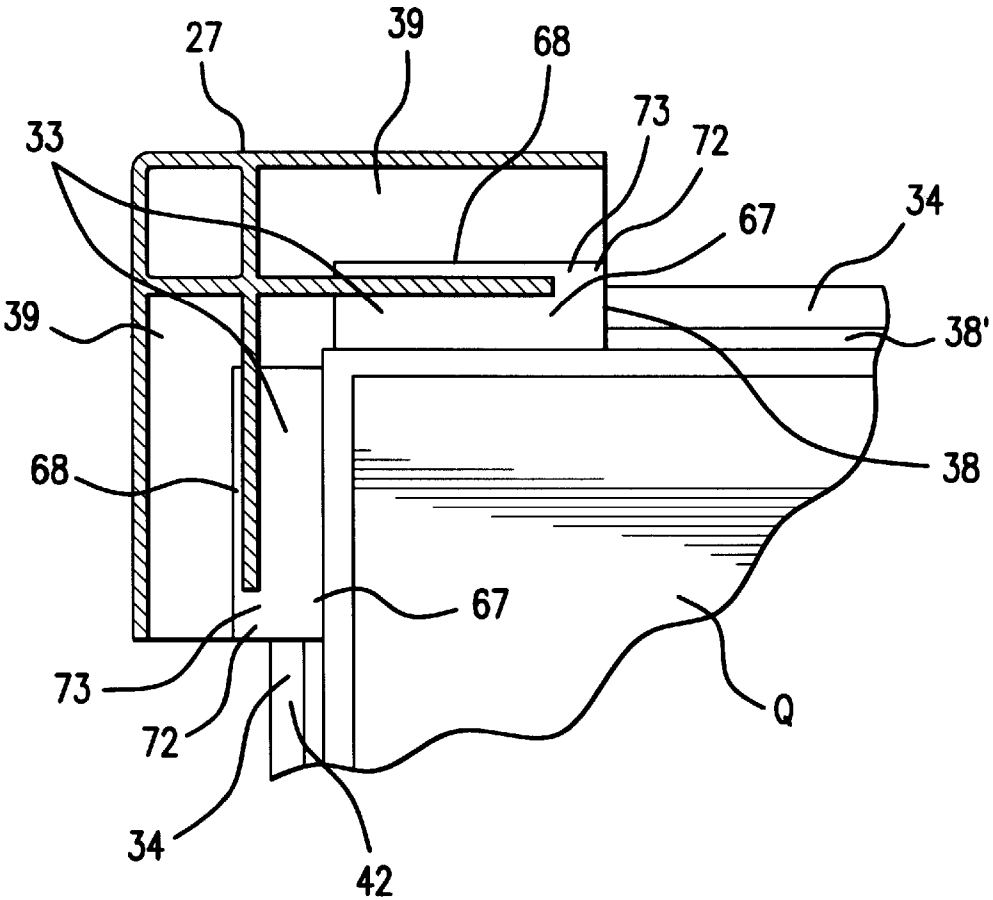
FIG. 105 shows the fastening of a basic element in a connecting element with corner formation, in a front view, partially in section.
Figure 107:
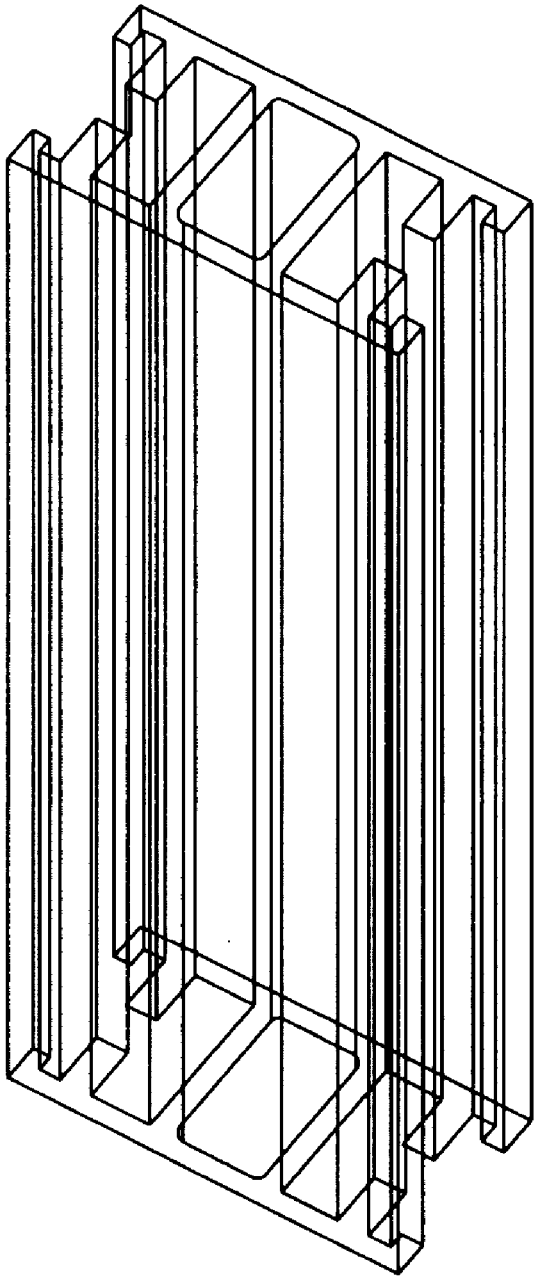
FIG. 107 shows the connecting strip of FIG. 7, in an axonometric representation.
Figure 108:
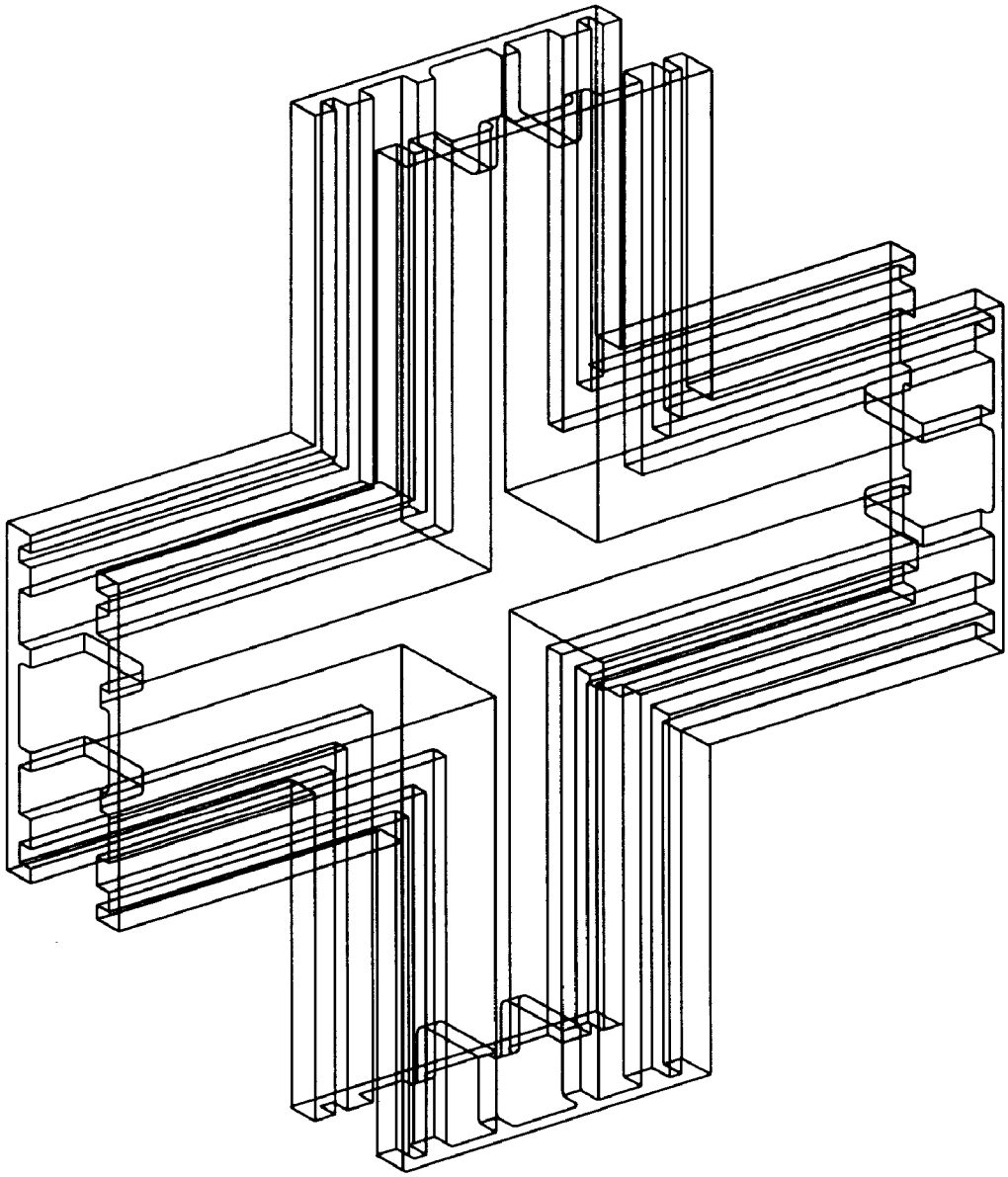
FIG. 108 shows the cross connector of FIG. 16 in an axonometric representation.
Figure 109:
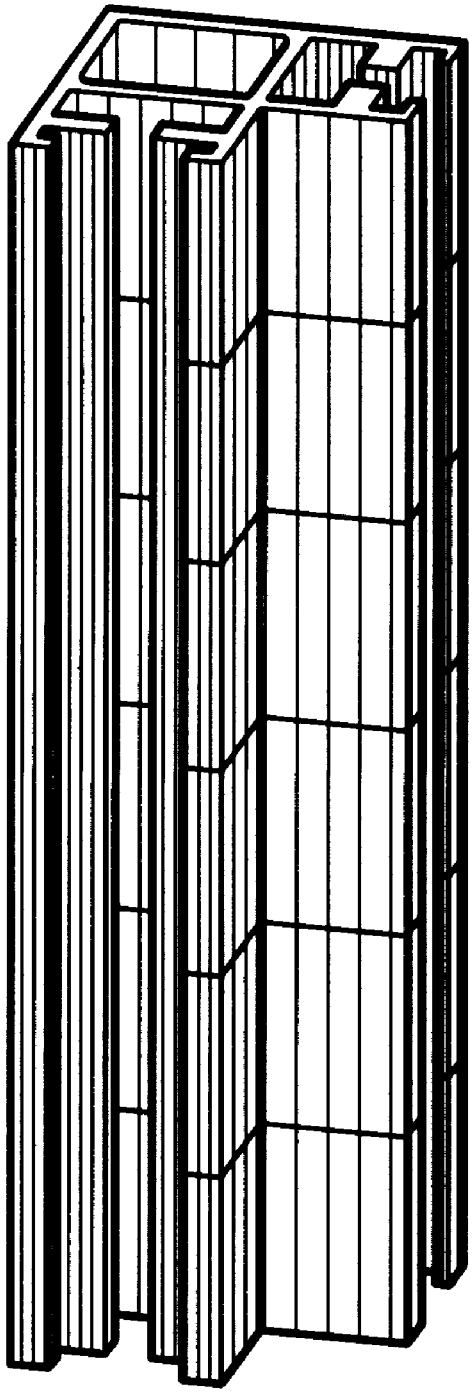
FIG. 109 shows the angular strip of FIG. 28 in an axonometric representation with shaded rear surfaces.
Figure 110:
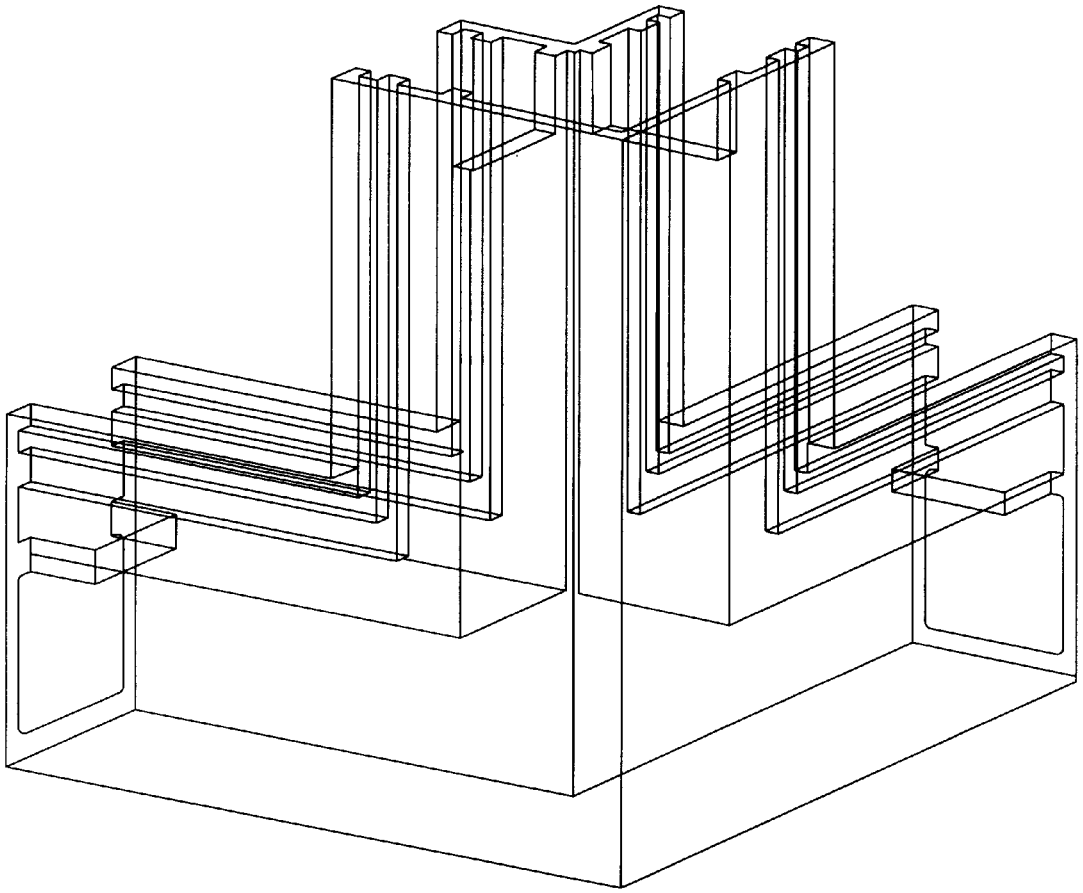
FIG. 110 shows the closing corner of FIG. 33 in a perspective representation from the front.
Figure 111:
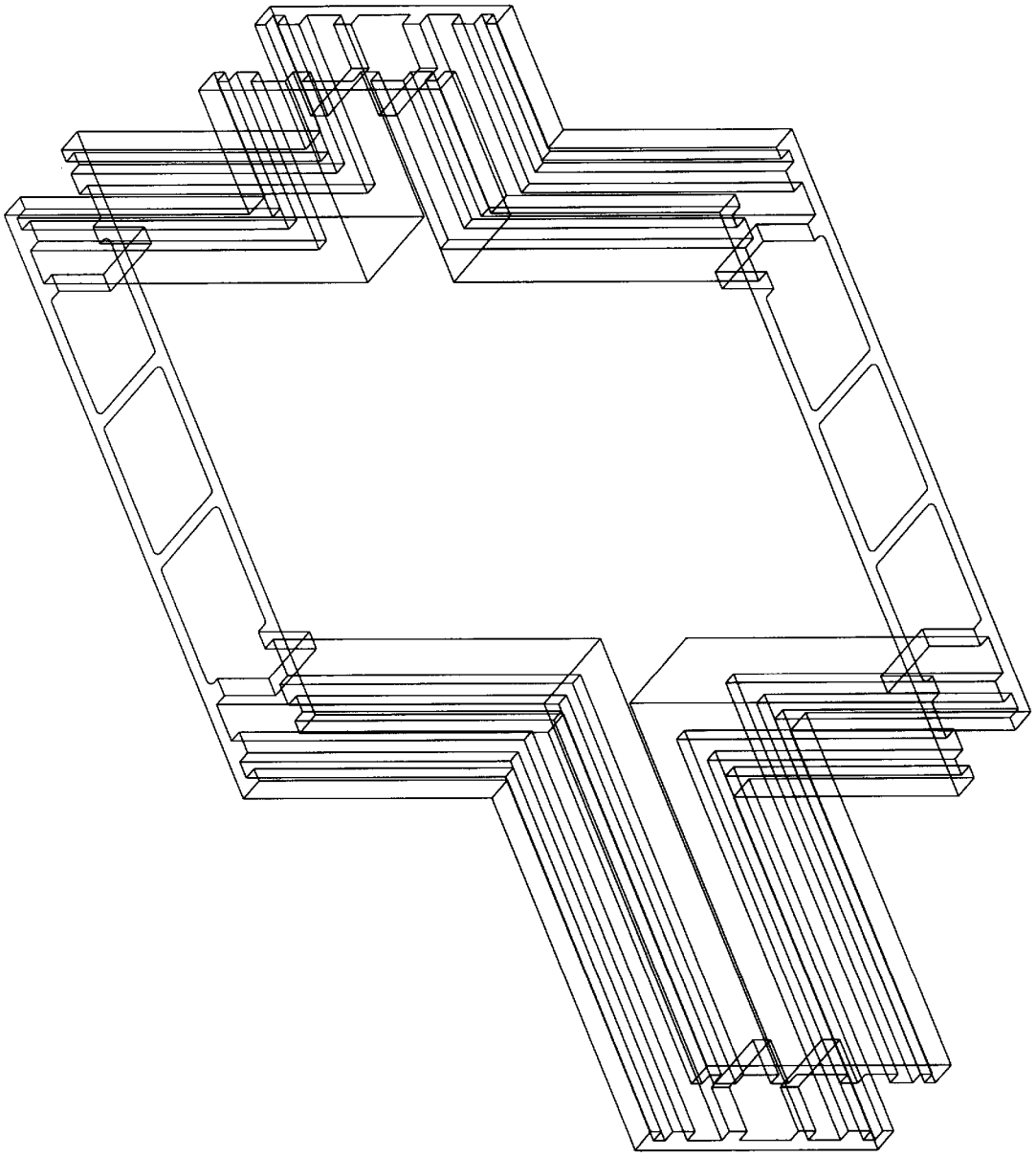
FIG. 111 shows the asymmetric cross connector of FIG. 41 in an axonometric representation.
Figure 112:
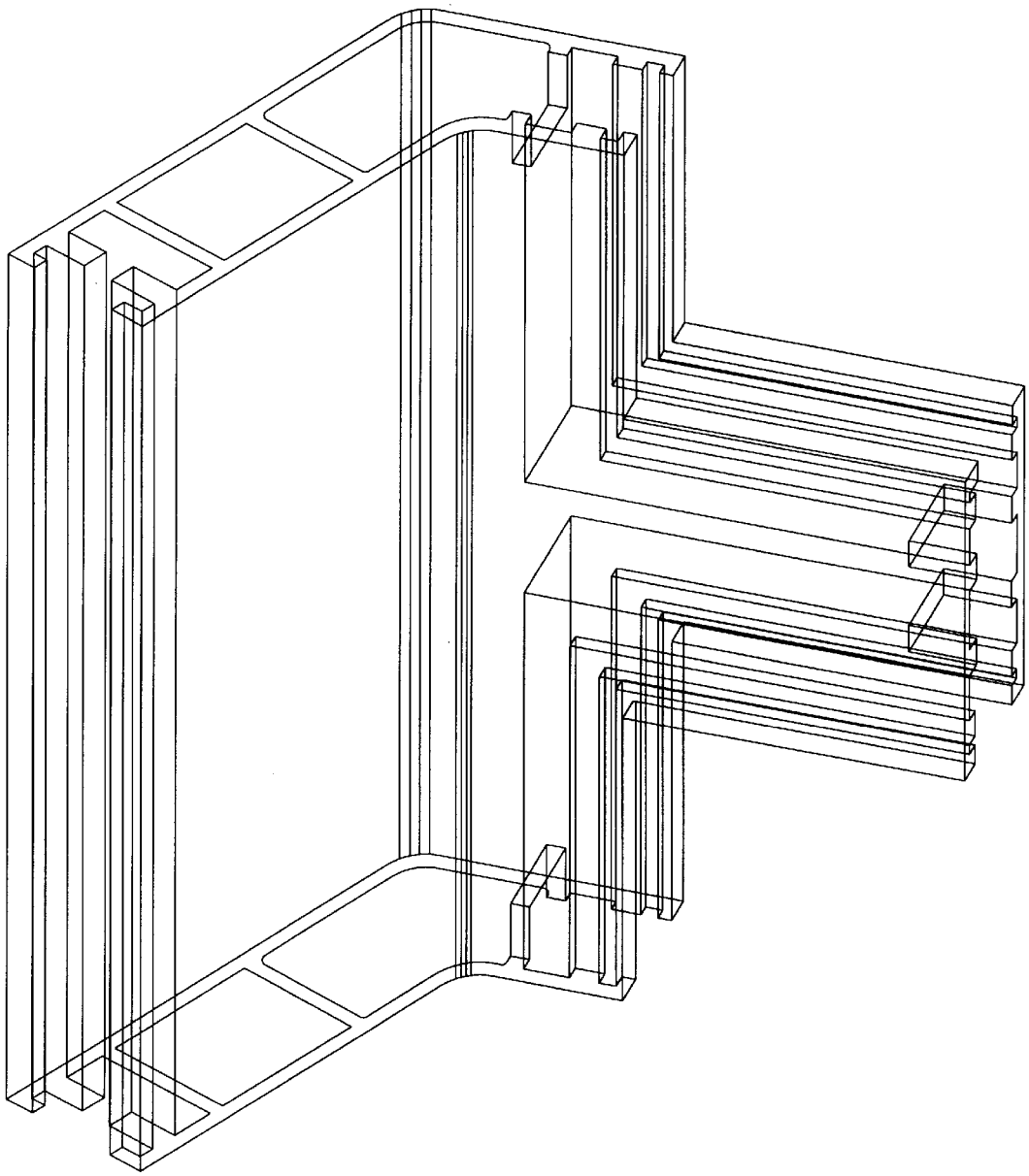
FIG. 112 shows a bent-over cross connector of FIG. 44, in an axonometric representation.
Figure 113:
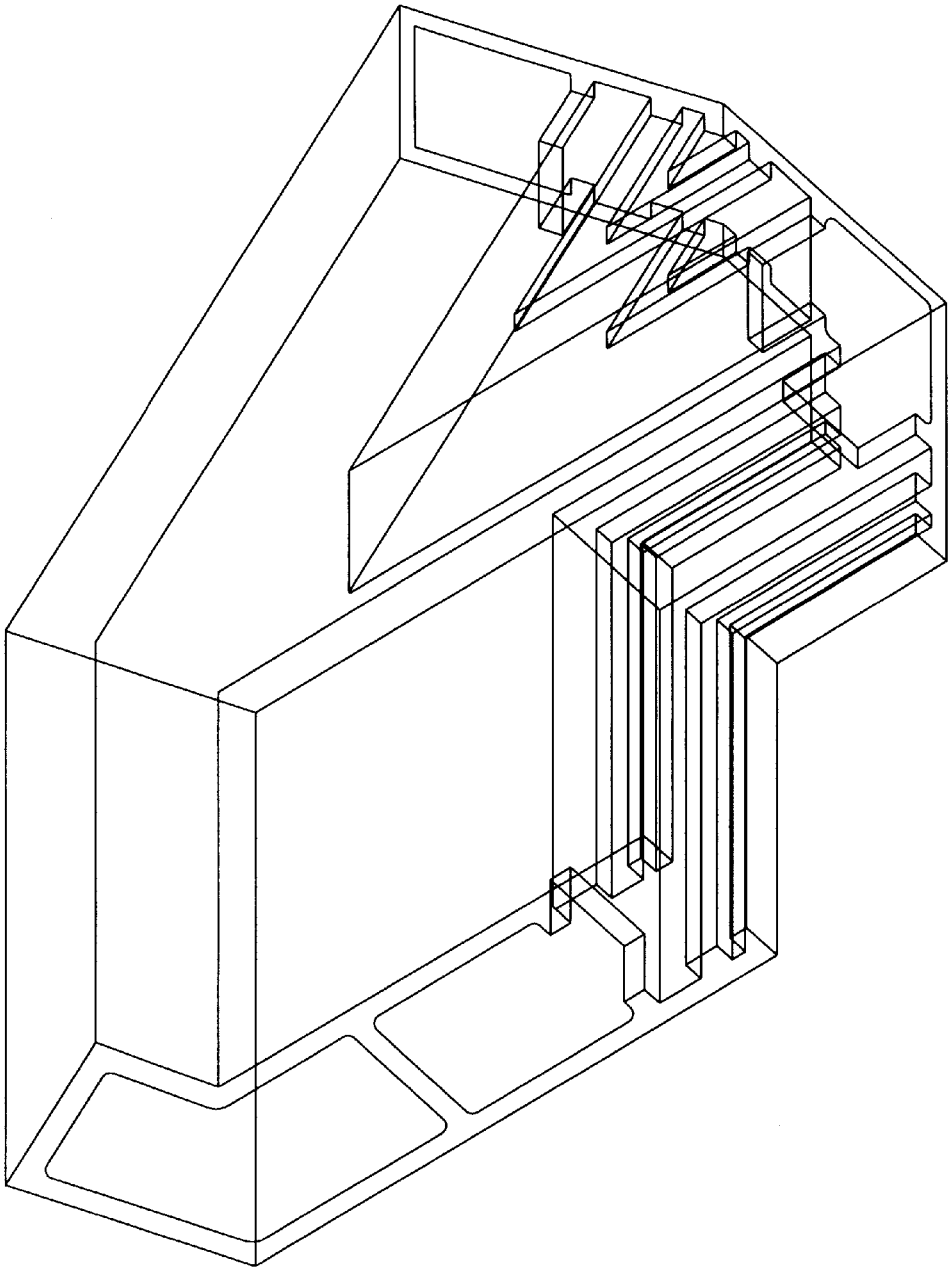
FIG. 113 shows a ceiling corner of FIG. 46 in an axonometric representation.
Figure 114:
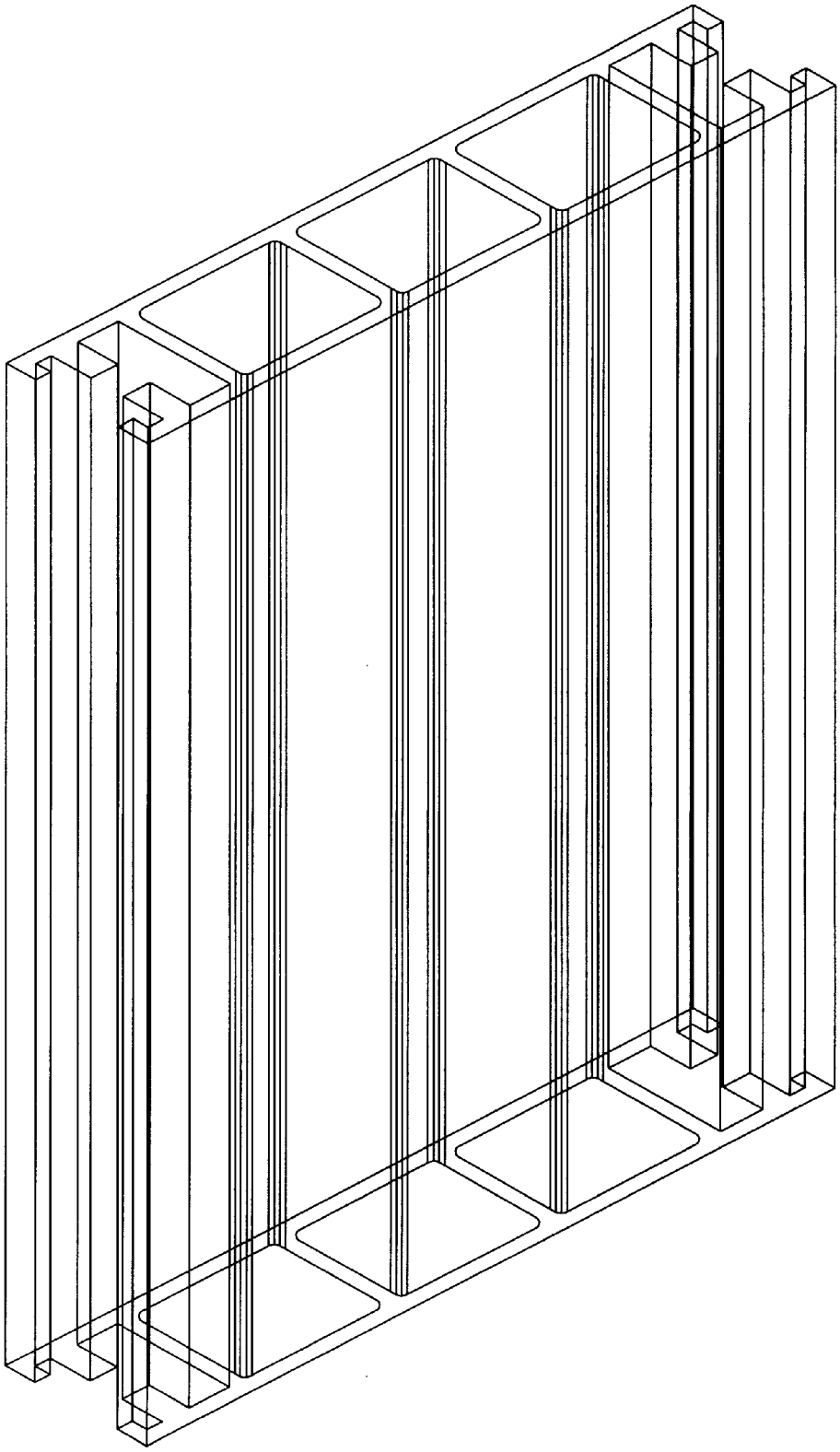
FIG. 114 shows a connecting strip of FIG. 54 with corners passing through the hollow profiles, in an axonometric representation.
Figure 115:
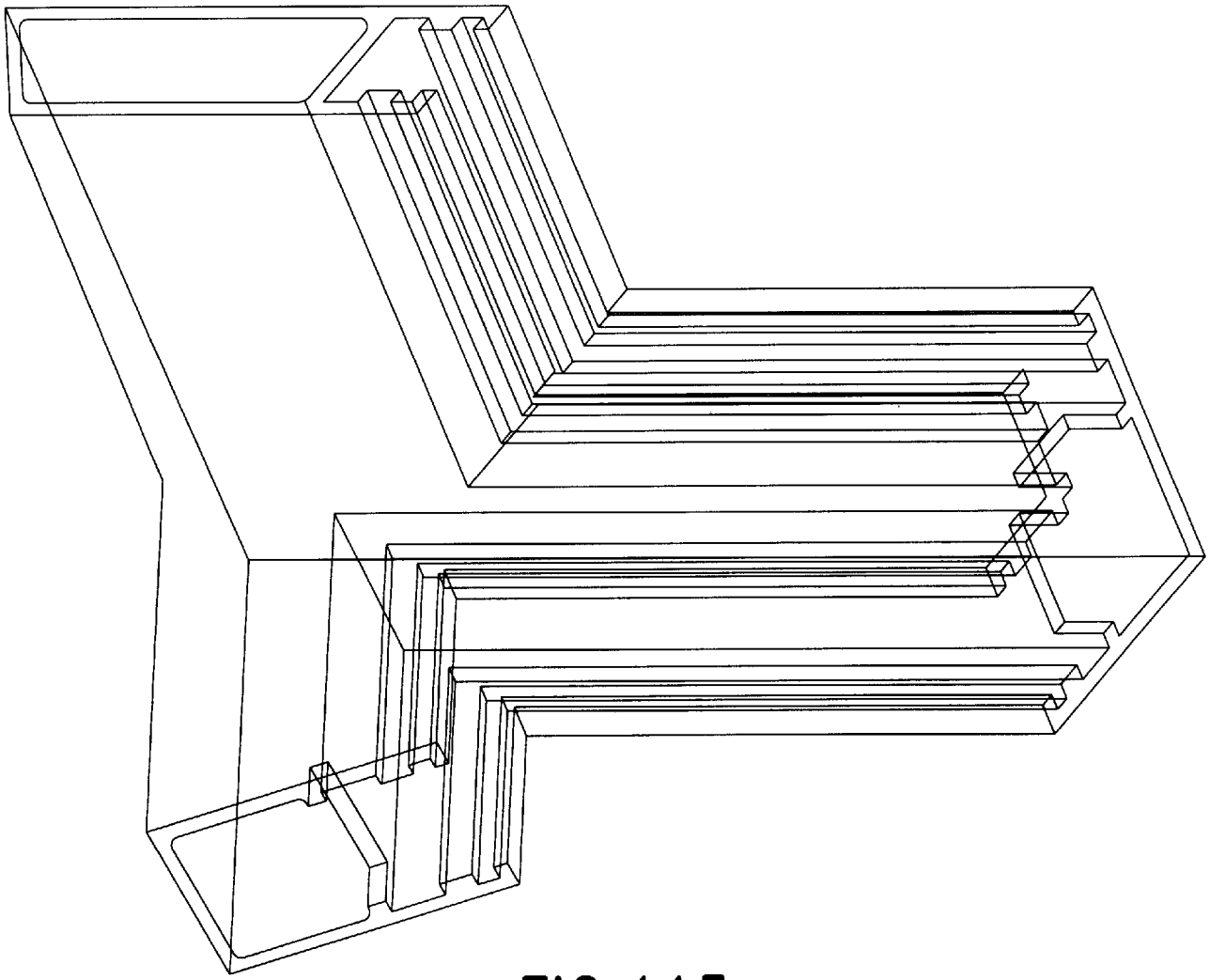
FIG. 115 shows a floor corner of FIG. 59, in a rear front view, as an axonometric representation.
Figure 116:
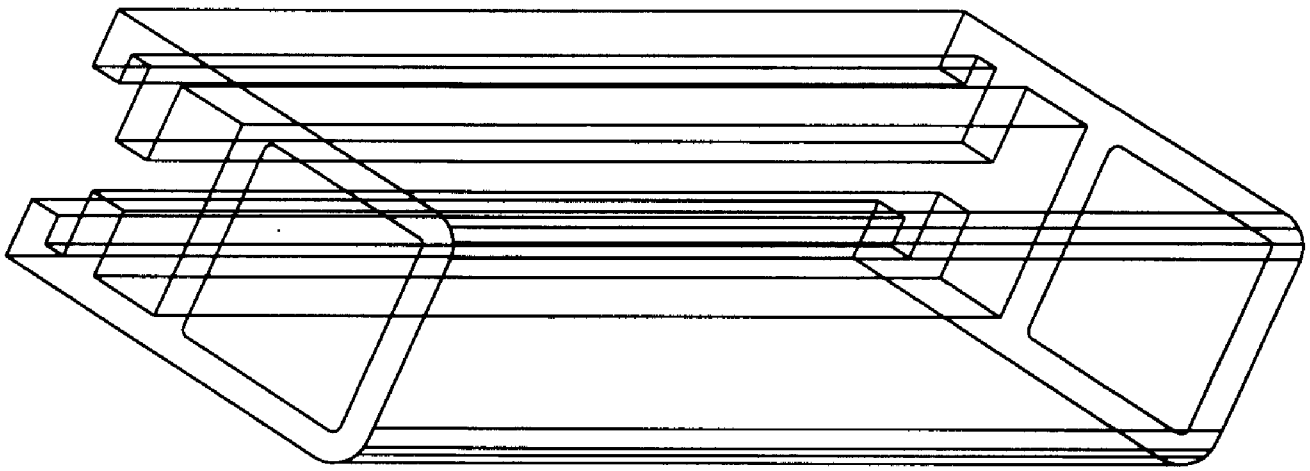
FIG. 116 shows a floor strip of FIG. 68 in an axonometric representation, with emphasized inner edges of the T-shaped profiles.
Figure 117:
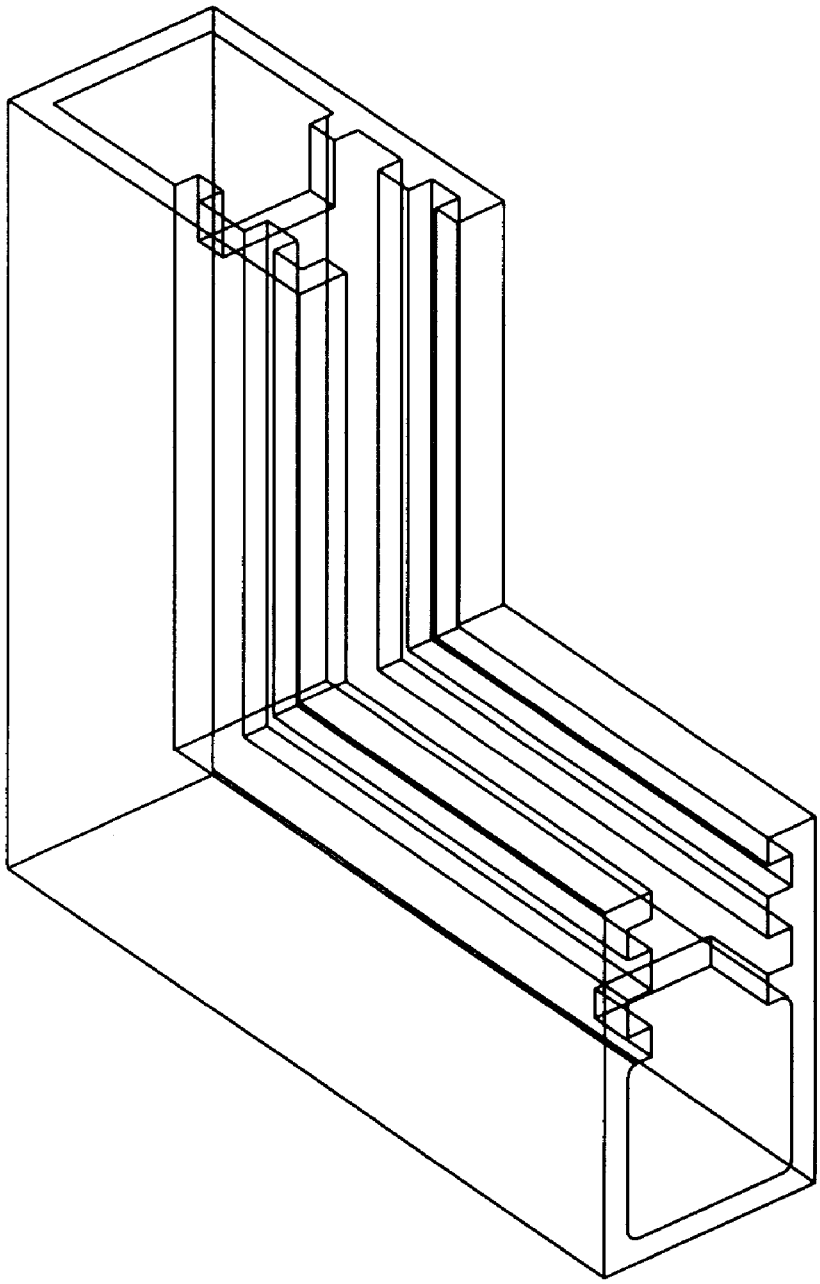
FIG. 117 shows a floor-wall corner of FIG. 88 in an axonometric representation, with clearly shown recesses for the clamps.

FIG. 98 shows the clamp 33 in a diagrammatic side view. A clamping clasp 68 is connected to the basic body 67 and rises up with formation of a gap 69 along the back of the basic body 67. The gap is constructed so that the wall of a hollow profile 39 can be accommodated through it. An inner profile 34', corresponding to the guide 37, that is, in the form of a T-shaped profile 34 with an opening 70 for the cross member 36, can be recognized in the profile opening 70. The T-shaped profile 34 of a basic element a; b; c is introduced into this profile opening 70, shown in FIG. 99. After the basic elements a; b; c are disposed in the guide 42 of the connecting elements, the clamping clasp 68 is pushed over the wall of the hollow profile 52 and locks the basic element a; b; c in the respective guide of the connecting element used. FIG. 100 shows a view from below of the element in the position of FIG. 98, turned through 90° upward. The course of the gap 69 can be recognized. FIG. 101 shows the clamp 33 in the course of the section B—B of FIG. 100 in a side view; at the same time, the guide 37 is opened and the course of the T-shaped profile can be recognized. Aside from the separator 73 in the profiled floor 71, the basic body 67 is opened, the clamping clasp 68 protruding over the opening. FIG. 102 shows a straddling dowel 32 in plan view in section. In the example, the configuration of the straddling dowel 32 is to be shown, which is constructed congruently with the shape of the dowel seat 41 and, in its interior, has a borehole 74 for accommodating an expansion screw 30. FIG. 103 shows the front view of the straddling dowel. At the shaft 75 of the straddling dowel, a denticulation 32 is provided, which connects with the denticulation 31 in the dowel seat 41 of the divided connecting elements and thus connects the upper parts 40 and the lower parts 40', locking them together before the connecting elements are locked after a fundamental alignment of all connecting elements at the structural body. FIG. 104 shows an expansion screw 30 for expanding the straddling dowel 32. In FIG. 105, the incorporation of the clamp 33 in the guide 42 of a connecting element 27 is shown. The connecting element 27 has a hollow profile 59. A basic element a is connected with clamps 33 in the region of its T-shaped profiled, which are aligned at an angle of 90° to one another, and pushed into the profiles 42 of the connecting elements 27. The clamping clasp 68 of the clamp 33 overlaps the wall of the hollow profile 59. The separator 73 fixing the clamping clasp 68 to the profiled floor 71 is pushed into the recess 72 and provides an accurate bearing surface between the following element and the already locked connecting element 27. The sealing elements 38; 38', shown in FIG. 105, guarantee that the clamps lie in the guide 42 of the connecting element 27 without play. It can be recognized from FIG. 106 that it is a question here of the insertion of a rectangular or square basic element a; b; c in the angle region of an angular connecting element 27. It may furthermore be inferred that, in the angular region where the guides 42 meet, the clamp 33 meet one another horizontally and vertically and ensure that the connecting elements 27 are locked securely in position with the basic element a in the direction of a y axis. With their clamping clasps 68 engaging the hollow profile 39, the pushed-in holding clamps 33 ensure the same connecting action as the T-shaped profiles 34 of the guides 37. It can be seen from FIG. 106 that the holding clamp 33, having T-shaped inner profiles 34', is constructed smooth and parallel at its outer sides. The smooth sides are introduced into the guides 42 and lie against sealing elements 38 in the guides 42 in this case in the connecting element 27. When the pushed-on clamp 33 is introduced completely into the guide 42, the sealing element 38' encircles the profiled region 80 of the basic element a, ensuring that, aside from the statically exceptionally stable connection of the basic element with the connecting element, an air-tight connection without play is produced.

FIGS. 107 to 117 show axonometric representations of the structural element of FIGS. 7; 16; 28; 33; 41; 44; 46; 54; 59; 68 and 88. The elements have not been provided with reference numbers, in order to concentrate the attention of the viewer on the structural details of the parts constructed as hollow bodies. The viewer will recognize that it is a question here of computer simulations, which expertly and diagrammatically show the inner functional parts of the structural elements

We claim:

1. A method for producing structural members and structural member parts, including:

providing a kit of pre-manufactured structural elements of different shape and construction, which are connectable with one another and used in a corner-overlapping and an edge-overlapping manner and which, when connected with one another, form planar formations and, by being joined together, lead to complete structural members:

assembling the structural elements together to form planar structural member parts and structural members by means of edge-overlapping and surface-overlapping connecting elements in which basic elements are to be inserted, the connecting elements being divided in a grid regime as smallest common multiple of the basic elements and shaped in each case separately for a type of connection to be selected, in collaboration with matchingly constructed types of guides of the connecting elements, shaped to correspond to the directions of motion of the joining together, being undertaken into and against the position and direction of large axes of the basic elements and the guides of the correspondingly shaped connecting elements suited thereto; and fixing and arresting the structural elements, after the structural elements are connected to one another, into a compact structural member after a complete structural state of the structural member is reached;

said step of assembling the structural elements including establishing a connection between the basic elements and the connecting elements by means of a fastening element introduced into the connecting elements which can be undone along and in a direction against an outer contour by shifting the inserted fastening element along the outer contour of the basic element.

2. The method of claim 1, wherein said step of connecting the structural elements includes guidably sliding at least one of the connecting elements onto profile guides disposed at an outer edge of the basic elements in movements directed differently onto the large axes of the basic elements.

3. The method of claim 1 or 2, wherein said step of connecting the structural elements includes sliding on the connecting elements at an angle directed towards the large axes of the basic elements.

4. The method of claim 1 or 2, wherein during said step of connecting the structural elements, the structural elements are connected by means of a guided sliding motion in a direction against an outer contour of the basic elements in the course of their large axes by at least one of the connecting elements in open non-profiled guides.

5. The method of claim 1 or 2, wherein the basic elements and the connecting elements are connected in hollow profiles thereof with a fastening element, engaging a connecting element, along and in a direction of an outer contour of the basic elements.

6. The method of claim 1, wherein structural members and surfaces thereof are produced by the meaningful joining together of one of the basic elements on their profiles disposed for a connection at an angle to large axes thereof and to the surfaces and parallel to small axes of the basic elements carrying guide profiles, with connecting elements, which are constructed in halves for an assembly and comprise structure complementary with the guide profiles of basic elements, which are to be connected, from the inside as well as from the outside of the structural member surface, and then are assembled positively and non-positively to a complete assembled connecting element.

7. The method of claim 1, wherein a partial change in one of a construction and a surface configuration of the construction following assembly thereof is effected by the additional steps of:

loosening the clamps use to mutually fix in the connecting elements and the basic elements, which are connected via profiles presented peripherally thereon; and removing one of the basic elements and connecting elements in a direction of large axes of a particular one of the basic elements to be assigned to a respectively used one of the connecting elements.

8. The method of claim 1, wherein a partial change in the construction or in the surface configuration of the construction is accomplished by loosening ones of the connecting elements which are constructed in halves and embrace a peripherally disposed guiding profile of the basic elements and permit a detachable connecting motion effective at an angle perpendicular to large axes thereof and parallel to small axes thereof, whereby a loosening of the basic element from the structural element structure takes place.

9. The method of claim 1, wherein a partial change in the structural member and its individual surface configuration and surface position is undertaken by a partial dismantling of the structural member surface parts that are to be changed.

10. The method of claim 1, wherein the production of the structural member and of the structural member parts, as well as their subsequent change, is carried out without mechanically processing the shape of the structural elements in order to fit them to the intended configuration of the structural member.

11. The method of claim 1, wherein the basic elements and the connecting elements are connected to one another, depending on a position of the guides, in a connecting motion directed horizontally or vertically onto large axis of the basic elements.

12. A method for producing structural members and structural member parts, including:

providing a kit of pre-manufactured structural elements of different shape and construction, which are connectable with one another and used in a corner-overlapping and an edge-overlapping manner and which, when connected with one another, form planar formations and, which, by being joined together, in turn lead to formation of complete structural members;

assembling the structural elements together to form planar structural member parts and structural members by means of edge-overlapping and surface-overlapping connecting elements in which basic elements are to be inserted, the connecting elements being divided in a grid regime as a smallest common multiple of the basic elements and shaped in each case separately for a type of connection to be selected, in collaboration with matchingly constructed types of guides of the connecting elements, shaped to correspond to the directions of motion of the joining together, being undertaken into and against the position and direction of large axes of the basic elements and the guides of the correspondingly shaped connecting elements suited thereto; and fixing and arresting the structural elements, after the structural elements are connected to one another, into a compact structural member after a complete structural state of the structural member is reached, said step of assembling including mounting the connecting elements on guiding profiles of the basic elements with a sliding motion in the direction of large axes thereof and said step of fixing and arresting including use of clamps, each which engages a hollow profile of the connecting element engaged therewith thereby creating a detachable connection between the basic elements and the connecting elements.

13. The method of claim 12, wherein a position of the basic elements and the connecting elements relative to one another in order to secure the position of the two elements is determined by a sliding motion of the clamps in the same plane and in two directions against inner regions of the guides of the connecting elements.

14. The method of claim 13, wherein the position determination of the basic elements and the connecting elements to one another is carried out by a sliding motion of the clamps in the same plane in at least two directions of superimposed axes in at least one of the corner-overlapping and an edge-overlapping connecting elements.

15. The method of claim 14, wherein the production of structural members of differently mounted planes is carried out with one of the corner-overlapping and edge-overlapping connecting elements and that the edge-overlapping connecting elements are connected with the basic elements independently of the position of the basic elements, in the guides of the connecting elements with a pushing-on motion of the connecting element, as well as subsequently of the clamp to secure the position, taking place horizontally and vertically in the direction against the large axes of the basic element and towards same.

16. The method of claim 14, wherein the edge-overlapping connecting elements are connected with the basic elements independently of the position of the basic elements with a motion pushing the basic elements onto the connecting elements as well as a motion to push on the clamps to secure the position.

17. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements being divided, and the parts being constructed in such a manner that the guides are divided uniformly over element halves, assembled once again on the profiles of the basic elements, surrounding and holding these, and fixed with fastening elements, the fastening elements comprising a dowel arrangement including a straddling dowel and an expansion screw.

18. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and a holding clamp having an internal profile which is congruent with a shape of the profiles of the basic elements and parallel thereto, and including a clamping clasp at an underside thereof for engaging the connecting element by insertion, the holding clamp fixing the basic element securely in position with the introduced connecting element when so received.

19. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and a clamp, the connecting elements including a cross connector in which the guides accommodate four basic elements, thereby installation of the basic elements in a manner such that four basic elements lie in one plane in a composite construction of the structural member, the guides for accommodating the basic elements being constructed without a profile and, for fastening the elements, permit said clamp to be pushed in, said clamp embracing, with an inner profile thereof, the profiles of the basic elements, the clamp being introduced with a side surface thereof in the cross connector, and pushed with clamping clasps carried thereon onto an inner cross beam of a hollow profile of the cross connector to fixedly hold the basic elements thereto.

20. The kit of claim 19, wherein the cross connector is constructed as a cross connector divided in a direction of large center lines thereof and accommodating four basic elements in the guides thereof, ensures the ability to install in the composite construction of the structural member and in that the guides for accommodating the basic elements are constructed congruent with the profiles of the basic elements and, by having the element halves placed against the profiles of the basic elements, the connection is produced, dowel seats for a positive and non-positive connection of the halves of the cross connector being provided on legs comprising the cross connector.

21. The kit of claim 20, wherein the dowel seats for connecting said divided cross connector are constructed so as to be positively locking and non-positively locking.

22. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a corner element for accommodating three parallel, as well as two non-parallel, basic elements, the corner element including legs, the guides of the corner element being disposed in said legs in such a manner that the basic elements, in the vertical position are fitted into the legs, and in the horizontal position are fitted into an inclined leg of said legs, and the guides for the horizontally inclined basic elements, in a leg fitted into the angle of 90°, are provided abutting on the legs corresponding to the basic elements fitted in a vertical position.

23. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including an angular strip for accommodating two basic elements directed at an angle of 90°, the guides of the angular strip being directed with longitudinal center lines thereof parallel to one another and with thereupon directed profile center lines thereof at an angle of 90° to one another, the angular strip being divided into an upper part, as well as into a lower part, configured such that the upper part is formed from regions of the guide seen towards the interior of the angle and from the adjoining parts of a hollow profile comprising the angular strip, the upper part including dowel seats the lower part including structure corresponding with said dowel seats, said structure being provided with an inner denticulation, and, with the assembled upper and lower parts, a coherence of the parts of the angular strip takes place with a positive and a non-positive connection.

24. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a closing corner suitable for accommodating four basic elements, the closing corner comprising two parts which carry portions of the guides which are not profiled and are directed at an angle of 90° to one another and are formed on legs having necks, the guides being inserted along the legs and the necks of the legs, the guides being equipped with recesses in the region of hollow profiles comprising the closing corner, the legs being constructed congruently and provided for connecting two basic elements in pairs in a vertical and in a horizontal plane.

25. The kit of claim 24, wherein the guides for pushing the basic elements into the hollow profiles presented thereby and for locking, with a pushed-on clamp, are constructed open.

26. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement;

the connecting elements including a ceiling corner for accommodating three basic elements which comprises two legs which are joined together at an angle of 90°, and a further appropriate angle is connected with the two legs at end surfaces of the second angle with the legs, the guides of the legs with inner guiding profiles corresponding to the profiles of the basic elements being held directionally oriented in two positions perpendicular to one another at an angle of 90° and one horizontally directed position; and clamps receivable in the guides for securing the basic elements to the ceiling corner.

27. The kit of claim 26 wherein the legs are connected in an apical region jointly with a hollow profile comprising the ceiling corner, into the end region of which the recesses for accommodating the clamps are incorporated.

28. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a cross connector of a T-shaped formation including a cross-member and a holding body, said guides being provided on both sides of the cross member and at the edges of the holding body, the guides being configured such that four basic elements are positionally oriented parallel to one another in one plane, the holding body being enlarged by the interposing of three hollow profiles in the spaces between the guide, and a stop, effective on both sides and separating the guide, being incorporated between the guides on a side thereof opposite to the cross member.

29. The kit of claim 28, wherein all external regions of the guides include recesses in hollow profiles comprising the cross connector adapted to reception of the clamps.

30. The kit of claim 24 or 29, wherein a cross connector is formed at a holding body with a position of the cross member similar to the construction of the T shape, the cross member being disposed bent in the region of its connection to the holding body.

31. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a ceiling corner, said ceiling corner including five legs, three legs thereof lying in one plane and meeting a remaining two legs thereof at an angle of 90° in an effective connection, all of said legs including the guides, two of the three legs coming together in a first plane at an angle of 90° and, during assembly, taking up a third leg of the three legs at an angle of 27° at the apical point for guiding an acutely angled basic element, the three legs taking up two basic elements and the triangular basic element combined into a vertical front, and the remaining two legs, having taken up a horizontally lying basic element and a horizontally lying, inclined basic element in a respective one of the guides, being assembled, held with clamps, and assembled into a structural member with a horizontal ceiling, going over into a slope, and having vertical sides thereon.

32. The kit of claim 31, wherein the basic elements are held in the guides with clamps pushed onto the profiles.

33. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including an angular strip which includes two legs of unequal size which are inclined to one another at an angle of 27°, external sides of the legs having the guides with inner profiles in which the profiles of the basic elements are received, a horizontally inclined surface of a structural member which transitions into a vertical surface being thereby formed when assembled.

34. The kit of claim 33, wherein the legs have hollow profiles.

35. The kit of claim 33 or 34 wherein the angular strip is divided into an upper part and a lower part, which, due to longitudinal division, each carry half an inner profile, and dowel seats being provided on the parts of the leg which, disposed on the upper part, have an assigned correspondence in the lower part for accommodating a positive and non-positive connection of the parts fixed on the profiles of the basic elements that are to be connected and, after the insertion of an expanding screw, are oriented in position.

36. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a floor corners, said floor corner including a horizontal leg to which an inclined leg is assigned in a common plane, and a further leg, following the course of the inclined leg, which adjoins the inclined leg at an angle of 90°, the guides for accommodating a triangularly configured one of the basic elements in the horizontal and inclined legs in a vertical position and another one of the basic elements thereupon adjoining at an angle of 90°, inclined on the vertical, being pushed into the guides of the further leg, and lower horizontal surfaces of the horizontal leg and the further leg being constructed as contact surfaces.

37. The kit of claim 36, wherein the inclined leg, with the adjoining further leg, is inclined at an angle of 27° to the horizontal leg, whereby a corner formation of a structural member, standing on the floor and with a surface inclined from the vertical, is formed when assembled, for which structural member which includes two basic elements pushed into the guides, are held with clamps.

38. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including an inclined floor strip which, formed at a basic body, has one of the guides at an upper longitudinal edge thereof, a lower longitudinal edge thereof being constructed as a contact surface extending obliquely at the basic body, such that when set up on a contact surface, the floor strip is inclined at an angle of 27° to the vertical, and the basic elements, when pushed onto an inner profile of the guide, being connected to form inclined surfaces of structural members.

39. The kit of claim 38, wherein the floor strip, commencing in the upper region of the basic body, is split and has upper and lower parts which, in each case, have a configuration corresponding to one half of the profile of the profiles and, in the upper part, a device is disposed for the positive and non-positive connection of the upper and lower parts, which form an inner profile, which embraces the guiding profiles of the basic elements.

40. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a wall corner, the wall corner including a vertically standing leg in which one of the guides for accommodating an acute angle of a triangularly configured one of the basic elements and a horizontally inclined leg, placed before the vertically standing leg at an angle of 90° and which, connected with an angular basic body, forms a contact surface adjoining an underside of the vertically standing leg, the guides of the legs being disposed opened in one direction for accommodating the basic elements, the horizontally inclined leg following a rising course of the vertically standing leg and, at the top, having a horizontal guide in which one of the non-triangular basic elements is received and, in the vertically standing leg with its vertically extending guides, the triangularly configured basic element, introduced in a vertical position, interacting with its bearing surface, is brought into an effective connection during assembly, and is locked with a clamp.

41. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a wall strip, the wall strip including a horizontal leg which includes a bearing surface at a head side thereof for placement against the wall of an already existing structural member and a contact surface at an underside thereof, the wall strip further including another leg being fixed to and inclined to the horizontal leg, said another leg including one of the guides at a head side thereof, the guide being disposed which is pushed onto the T-shaped profile of one of the basic elements and supporting the basic element in an inclined position on the foundation material, as well as against the wall of an existing structural member.

42. The kit of claim 41 wherein said another leg is in a position inclined at an angle of 27° to the horizontal leg.

43. The kit of claim 41 wherein the wall strip is constructed in a divided form, the division being undertaken by a partial splitting of the another leg into an upper part and a lower part as far as the basic body, forming the guide in two equal parts, and, for assembling the upper part and the lower part, facilities being provided, in order to fix the upper and lower parts of the wall strip positively and non-positively, after they are connected with a now assembled guide encompassing the profile of the basic element.

44. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a floor-wall corner which comprises legs directed at an angle of 90° to one another, a contact surface being formed as a bearing surface at the vertical leg and as a surface directed to the floor on the leg at back surfaces thereof, and the guides, in which a one of the basic elements, held with clamps, is incorporated, being provided in an inner angular region of the legs.

45. The kit of claim 44, wherein end surfaces of the legs of the floor-wall corner have recesses in a region of hollow profiles comprising the floor-wall corner.

46. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and the connecting elements including a transition part which comprises contour-forming legs and roof-forming legs, the roof-forming legs being disposed to meet at an angle of 90° on the contour-forming legs, a horizontal structural body plane and a horizontally inclined structural body plane produced from two basic elements and interacting with two other basic elements to form a vertical wall, being inserted during assembly.

47. The kit of claim 46, wherein the legs extend so as to meet at right angles, directed at an apical point thereof counter to one of the contour-forming legs, said one of the contour-forming legs being disposed inclined out of the plane of the remaining contour-forming legs and a further leg, meeting two of the contour-forming legs at right angles and following the roof-forming legs, is attached to the so constructed contour of the transition part, the guides for accommodating four basic elements being incorporated in all of the legs.

48. The kit of claim or 46 or 47, wherein recesses are provided in the guides for accommodating clamps in a region of hollow profiles comprising the transition part.

49. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and a clamp which has a basic body including a T-shaped inner profile in a longitudinal extent with a shape substantially identical with and fitting a T-shaped profile carried peripherally about the basic elements and, along a back side thereof, a clamping clasp, connected over a separator with the basic body, extending along the back of the basic body, and a gap for accommodating a wall of a hollow profile of a connecting element, for the holding connection of one of the basic bodies pushed into the guides of the connecting element, being provided between the clamping clasp and the back of the clamping clasp.

50. The kit of claim 49 wherein the clamp is opened at the back in the region of the base of the profile as far as the separator, which is introduced into the recess of the respective connecting element, and the head of the T-shaped profile of the basic element is put directly against the wall of the hollow profile.

51. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and a straddling dowel, the connecting elements of the kit being divided in halves, said straddling dowel fitting a dowel seat provided in the divided connecting elements for a positive as well as a non-positive connection therebetween and, a lower end of said straddling dowel has a denticulation which is constructed to counteract an inner denticulation in correspondences in the dowel seats of the connecting elements.

52. The kit of claim 51, wherein a hollow cross section of the straddling dowel, after the straddling dowel is pressed in, forms a positive and non-positive locking between the connecting elements and the basic elements.

53. A kit for producing structural members and structural member parts, comprising:

basic elements, at least two of which are of different form and construction, which can be assembled and connected with one another to form planar formations, the subsequent joining together of the planer formations leading to creation of structural members, the basic elements presenting profiles along a periphery thereof;

connecting elements for the mutual connection of the basic elements one to the other, at least two of said connecting elements being of different form and construction, the connecting elements including guides for engageably receiving said profiles of said basic elements such that the basic elements are guidably held with the connecting elements, a combination of the connecting elements and the basic elements being mutually assemblable into various planar and spatial formations of different geometric shapes when brought into particular relative relationships with one another;

edge lengths of the basic elements forming a uniform multiple of corresponding structural dimensions of the connecting elements, such that when brought into connection with the basic elements via the guides thereof, the basic elements are completely enclosed at outer contours thereof by the connecting elements and combined with one another, said connecting elements including direction changing connecting elements, insertion of the profiles of selected ones of the basic elements into the guides of said direction changing connecting elements permitting assembly of a rigid, spatial formation of discrete geometric form and spatial arrangement; and an arrangement for connecting and fixing connecting elements with the guides, into which the basic elements are pushed, and guides, directed in one or several planes at an angle of 90° to one another, being provided, and the basic element carries clamps, which are pushed onto its profiles and are disposed over the walls of the hollow profile, pushed into the recess with the clamping clasps up to the stop of the separator and lock the basic element in the direction an x axis and a y axis or undo the locking when the clamp is loosened with an opposite direction of motion.

54. The kit of claim 53, wherein the holding clamp is constructed in corner regions of the basic elements, clamped together with the connecting elements, with their outer ending flush with the end surfaces of the respective connecting element and the holding clamp is prevented from sliding out by the end face contact of the next in sequence connecting element.

55. The kit of claim 53 or 54, wherein the arrangement of the clamps is provided in the guides of the connecting elements in each case in the corner regions of the basic elements.

56. The arrangement of claim 53, wherein a lower profile region of the basic elements is inserted in sealing elements of the guides.

* * * * *